US008244145B2

(12) United States Patent
Yamaguchi et al.

(10) Patent No.: US 8,244,145 B2
(45) Date of Patent: Aug. 14, 2012

(54) IMAGE FORMING APPARATUS INCLUDING IMAGE PROCESSING MEMBER DETERMINED BY METHOD OF EVALUATING DISTRIBUTION OF ADHESION FORCES OF TONER THERETO

(75) Inventors: Daichi Yamaguchi, Sagamihara (JP); Yasuyuki Yamashita, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 1020 days.

(21) Appl. No.: 12/230,482

(22) Filed: Aug. 29, 2008

(65) Prior Publication Data

US 2009/0060602 A1 Mar. 5, 2009

(30) Foreign Application Priority Data

| | | |
|---|---|---|
| Aug. 29, 2007 | (JP) | 2007-222274 |
| Aug. 29, 2007 | (JP) | 2007-222277 |
| Jan. 9, 2008 | (JP) | 2008-001842 |
| Apr. 1, 2008 | (JP) | 2008-095481 |
| May 16, 2008 | (JP) | 2008-129071 |

(51) Int. Cl.
*G03G 15/02* (2006.01)
*G03G 15/00* (2006.01)

(52) U.S. Cl. ..... 399/31; 399/9

(58) Field of Classification Search ..... 399/9, 31, 399/34, 49, 159, 265, 279, 349, 350, 353, 399/354, 357

See application file for complete search history.

(56) References Cited

U.S. PATENT DOCUMENTS

| | | | | |
|---|---|---|---|---|
| 6,122,475 | A * | 9/2000 | Seto et al. | 399/308 |
| 7,035,575 | B2 | 4/2006 | Ikeguchi et al. | |
| 7,060,407 | B2 * | 6/2006 | Nagayama et al. | 430/97 |
| 7,103,301 | B2 | 9/2006 | Watanabe et al. | |
| 7,209,699 | B2 | 4/2007 | Yamaguchi et al. | |
| 7,267,916 | B2 | 9/2007 | Sugino et al. | |
| 7,314,693 | B2 | 1/2008 | Ikegami et al. | |
| 7,341,810 | B2 | 3/2008 | Kurimoto et al. | |
| 7,734,237 | B2 * | 6/2010 | Mukai | 399/307 |
| 2005/0002701 | A1 | 1/2005 | Ikeguchi et al. | |
| 2005/0026058 | A1 | 2/2005 | Kami et al. | |
| 2005/0053853 | A1 | 3/2005 | Sugino et al. | |
| 2005/0058474 | A1 | 3/2005 | Watanabe et al. | |
| 2005/0058918 | A1 | 3/2005 | Kurimoto et al. | |

(Continued)

FOREIGN PATENT DOCUMENTS

| | | |
|---|---|---|
| JP | 6-82226 | 10/1994 |

(Continued)

OTHER PUBLICATIONS

English abstract for JP 62-143061 published Jun. 26, 1987.

(Continued)

*Primary Examiner* — Sandra Brase
(74) *Attorney, Agent, or Firm* — Harness, Dickey & Pierce, P.L.C.

(57) ABSTRACT

An image processing member that is included in an image forming apparatus employing method of evaluating and determining adhesion forces thereof, includes an optical writing unit configured to optically write an image, and an image processing member configured to process the image formed by the optical writing unit. The image processing member has good cleaning performance, which is determined by a method of determining a distribution of adhesion forces generated between a surface of the image processing member and a particle of a powder used to reproduce the image in the image forming apparatus in which the adhesion forces are measured at multiple points on the surface of the image processing member.

19 Claims, 25 Drawing Sheets

U.S. PATENT DOCUMENTS

| | | | | |
|---|---|---|---|---|
| 2005/0118518 | A1 | 6/2005 | Ikegami et al. | |
| 2005/0191099 | A1 | 9/2005 | Yamaguchi et al. | |
| 2006/0133872 | A1 | 6/2006 | Sugiura et al. | |
| 2006/0198663 | A1 | 9/2006 | Miyoshi et al. | |
| 2006/0210334 | A1 | 9/2006 | Tokumasu et al. | |
| 2006/0240346 | A1 | 10/2006 | Toda et al. | |
| 2006/0292470 | A1 * | 12/2006 | Iimura | 430/108.1 |
| 2007/0042281 | A1 | 2/2007 | Orito et al. | |
| 2007/0059617 | A1 | 3/2007 | Toda et al. | |
| 2007/0059618 | A1 | 3/2007 | Kurimoto et al. | |
| 2007/0166087 | A1 | 7/2007 | Yamaguchi et al. | |
| 2007/0212139 | A1 | 9/2007 | Sugiura et al. | |
| 2008/0193179 | A1 | 8/2008 | Sugimoto et al. | |

FOREIGN PATENT DOCUMENTS

| | | |
|---|---|---|
| JP | 09-015979 | 1/1997 |
| JP | 2002-006650 | 1/2002 |
| JP | 2002-062253 | 2/2002 |
| JP | 2002-082401 | 3/2002 |
| JP | 2002-131934 | 5/2002 |
| JP | 2003-330264 | 11/2003 |
| JP | 2004-004504 | 1/2004 |
| JP | 2004-325487 | 11/2004 |
| JP | 2005-031396 | 2/2005 |
| JP | 2005-201884 | 7/2005 |
| JP | 2005-265907 | 9/2005 |
| JP | 2006-343188 | 12/2006 |
| JP | 3955423 | 5/2007 |
| JP | 2007-171470 | 7/2007 |

OTHER PUBLICATIONS

English abstract for JP 2001-183289 published Jul. 6, 2001.

Takeuchi, M. et al., "Measurements of Adhesion Forces of Toner Particles by Centrifugal Method", Proc. IS&T 7$^{th}$ Int. Congress Adv. Non-Impact Printing Technology, 21991, vol. 1, pp. 200-2003.

Manne, S. et al. "Imaging metal atoms in air and water using the atomic force microscope" Appl. Phys. Lett. 56(18), Apr. 30, 1990, pp. 1758-1759.

Miyatani T. et al. "Mapping of electrical double-layer force between tip and sample surfaces in water with pulsed-force-mode atomic force microscopy" Appl. Phys/ Lett. 71(18), Nov. 3, 1997, pp. 2632-2634.

* cited by examiner

| | |
|---|---|
| MEAN ROUGHNESS (Ra): | 1.883E−01 nm |
| MAX P−V DIFFERENCE (P−V): | 3.834E+00 nm |
| RMS SURFACE ROUGHNESS (RMS): | 2.427E−01 nm |
| n−POINTS MEAN ROUGHNESS (Rz): | 2.190E+00 nm (10 Points) |
| SURFACE AREA (S): | 9.012E+06 $nm^2$ |
| SURFACE AREA RATIO (S ratio): | 1.00026 |

| | |
|---|---|
| MEAN ROUGHNESS (Ra): | 1.883E−01 nm |
| MAX P−V DIFFERENCE (P−V): | 3.834E+00 nm |
| RMS SURFACE ROUGHNESS (RMS): | 2.427E−01 nm |
| n−POINTS MEAN ROUGHNESS ($R_z$): | 2.190E+00 nm (10 Points) |
| SURFACE AREA (S): | 9.012E+06 $nm^2$ |
| SURFACE AREA RATIO (S ratio): | 1.00026 |

Ra1>100nm: NO AFFECT ON ADHESION FORCE
Ra2<100nm: AFFECTED ON ADHESION FORCE

IMAGE FORMING APPARATUS INCLUDING IMAGE PROCESSING MEMBER DETERMINED BY METHOD OF EVALUATING DISTRIBUTION OF ADHESION FORCES OF TONER THERETO

CROSS-REFERENCE TO RELATED APPLICATIONS

The present patent application claims priority pursuant to 35 U.S.C. §119 from Japanese Patent Application No. 2007-222274, filed on Aug. 29, 2007 in the Japan Patent Office, Japanese Patent Application No. 2007-222277, filed on Aug. 29, 2007 in the Japan Patent Office, Japanese Patent Application No. 2008-001842 filed on Jan. 9, 2008 in the Japan Patent Office, Japanese Patent Application No. 2008-095481, filed on Apr. 1, 2008 in the Japan Patent Office, and Japanese Patent Application No. 2008-129071, filed on May 16, 2008 in the Japan Patent Office, the contents and disclosures of each of which are hereby incorporated by reference herein in their entirety.

BACKGROUND OF THE INVENTION

1. Field of the Invention

Embodiments of the present patent application generally relate to an image forming apparatus including an image processing member, and more particularly, to an image forming apparatus including an image processing member such as a photoconductor, a cleaning blade, a toner collection roller, and a developing roller, and employing a method of evaluating a distribution of adhesion forces of toner to the image processing member and powder removability indicating a degree of difficulty of removing powder particles from the image processing member.

2. Discussion of the Related Art

Related-art image forming apparatuses generally include image forming components such as a photoconductor, a developing unit, and a cleaning unit. The cleaning unit includes a cleaning blade and/or a cleaning brush to clean a surface of the photoconductor by removing toner adhering to the surface thereof.

Consequently, related-art cleaning methods of removing toner adhering to a surface of a photoconductor include brush-type cleaning, blade-type cleaning, and the like.

A known cleaning unit that employs brush-type cleaning includes a cleaning brush and a toner collection roller. The cleaning brush is disposed in contact with a surface of a photoconductor to scrape and remove toner from the surface of the photoconductor, and the toner collection roller serves as a cleaning member and is disposed in contact with the cleaning brush to collect the toner therefrom. Further, the toner collected by the toner collection roller is removed from a surface thereof by a cleaning blade that is disposed in contact with the toner collection roller. Since the cleaning blade removes the toner from the surface of the toner collection roller, the toner collection roller can remain clean and therefore can prevent a reduction of toner collection performance from the cleaning brush.

Another known image forming apparatus minimizes a friction coefficient between a surface of a photoconductor and a cleaning member such as a cleaning blade or a cleaning brush, so that such cleaning member can effectively remove toner from the surface of the photoconductor.

Thus, for example, a known toner collection roller has a surface with a friction coefficient smaller than a given friction coefficient so that toner can be effectively removed from the surface of the toner collection roller. The smaller friction coefficient of the surface of the toner collection roller prevents the cleaning blade from curling upon contact with the toner collection roller, thereby preventing a gap from forming between the cleaning blade and the toner collection roller through which toner might otherwise slip or fall. Therefore, the smaller friction coefficient of the surface of the toner collection roller can lead to more effective toner collecting performance or cleaning performance.

However, when actual cleaning performance of the toner collection roller was examined, the inventors of the present patent application often found that, even though the friction coefficient of the surface of the toner collection roller was small, the toner could not be removed from the surface of the toner collection roller effectively. Because of the above-described result, the inventors found that it was difficult to fully rely on a method of evaluating the performance of collecting the toner from the surface of the toner collection roller based on the friction coefficient.

On the other hand, some methods of measuring adhesion forces generated between a powder and a member, i.e., an image processing member, have been proposed. In one method, for example, adhesion forces between an image processing member and one PMMA (polymethylmethacrylate) particle having a composition, particle diameter, and shape similar to those of a toner particle are measured by using an atomic force microscope or AFM.

The measured adhesion forces between the powder particle and the image processing member represent a characteristic value indicating a contact condition of the powder particle and the image processing member. Thus, whether or not the powder can be effectively removed from the image processing member can be evaluated based on measurements of the adhesion forces between the powder particle and the image processing member.

However, when the above-described evaluation is performed based on the thus-measured adhesion forces, it is likely to cause the following problems, details of which are described with reference to FIGS. 1 and 2.

FIG. 1 is a graph showing measurements of adhesion forces that are generated between the surfaces of image processing members A and B and a power particle taken at multiple points on the surfaces thereof. FIG. 2 is a graph showing measurements of adhesion forces that are generated between a powder particle and the surfaces of the image processing member A and of an image processing member C, which is different from the image processing members used in the test having the results shown in the graph of FIG. 1, taken at multiple points on the surfaces thereof. In FIGS. 1 and 2, the horizontal axis of each graph indicates adhesion force between a powder particle and an image processing member, and the vertical axis indicates frequency of powder per specific adhesion forces.

Both image processing members A and B in FIG. 1 have frequencies in proximity to respective mean values of adhesion forces measured at the above-described multiple points, and the results thereof form respective graphs with a sharp peak in the center. That is, most adhesion forces of toner are plotted close to the respective mean values of the adhesion forces of toner to the members A and B, and therefore are significantly correlated when the mean value of the adhesion forces of toner is substituted for the adhesion force.

The mean value of the adhesion force of toner to the image processing member A, which is represented by "x" indicated with a dashed-dotted line, and the mean value of the adhesion force of toner to the image processing member B, which is represented by "y" indicated with another dashed-dotted line, are different. That is, the mean value of the adhesion force "y" is greater than the mean value of the adhesion force "x", which shows that the image processing member B has a greater mean value of the adhesion forces than the image processing member A. At the same time, it is easily expected that the cleaning performance of the image processing member B is poorer than the cleaning performance of the image processing member A. For example, when with the adhesion forces smaller than an adhesion force "z" shown in FIG. 1 one can perform good cleaning and with the adhesion forces greater than the adhesion force "z" one cannot remove toner effectively from the image processing member A, it can be foreseen that the toner on the overall surface of the image processing member A may be removable whereas the toner on the surface of the image processing member B may not.

In FIG. 2, the image processing member B is replaced by the image processing member C to show results of comparison of the adhesion forces of toner to the image processing member A and adhesion forces of toner to the image processing member C. As shown in FIG. 2, a frequency distribution of adhesion forces of toner to the image processing member C is much more evenly distributed, or gentle curved or sloped, than a frequency distribution of adhesion forces of toner to the image processing member A, while the mean value of the adhesion force thereof is same as the image processing member A, and therefore is indicated by "x."

In other words, although the mean value of the adhesion force of toner to the image processing member C is substantially the same as the mean value of adhesion forces of toner to the image processing member A, at any given portion on the surface of the image processing member C the adhesion forces of toner to the image processing member C may be greater or smaller than those of the image processing member A. For example, even when the mean value of the adhesion forces of toner to the image processing member C is equal to or smaller than the adhesion force "z", the adhesion forces beyond the adhesion force "z" of toner to the image processing member C may be greater than the image processing member A at some portions on the image processing member C. Therefore, even when most toner can be removed from the image processing member C, some amount of toner still remains at some portions on the image processing member C.

Therefore, even when the degree of toner adhesion to a member such as the image processing member C having the above-described tendency of toner adhesion is evaluated based on the mean value of the adhesion forces and it is determined that the image processing member C has good toner cleaning performance, some toner can still remain on the surface of the image processing member C without being removed effectively.

It is therefore important to determine in advance whether the adhesion force is equal at any portion on a surface of an image processing member to which toner adheres, in other words, evaluate a distribution of adhesion forces of toner to an image processing member.

Further, the above-described problems may arise not only with the toner collection roller but also with any image processing member to which toner adheres in an image forming apparatus, for example, a photoconductor or a developing member. That is, the above-described problems may occur at any portion where a powder particle moves from one member to another.

A description is given of example problems that can arise with a developing member such as a developing roller.

A related-art developing unit that generally develops a latent image into a visible toner image with, for example, one-component developer including toner, is known to include a developing roller, a developer regulating member, and a developer supplying roller. The developing roller is disposed facing a photoconductor of an image forming apparatus.

The one-component developer or toner contained in the related-art developing unit is supplied to the developing roller while the toner is frictionally charged appropriately by sliding contact with the developing roller and the developer supplying roller. The toner carried on the surface of the developing roller is regulated by the developer regulating member to form a uniform thin layer and, at the same time, is supplied with a given electrical charge. The photoconductor and the developing roller form a development area where the toner on the surface of the developing roller is attracted by a development electrical field and transferred to a latent image formed on the photoconductor to develop the latent image into a visible toner image.

Residual toner that remains on the surface of the developing roller without being used in the development area is collected by the developing roller at a contact point where the developing roller contacts the developer supplying roller. At the same time, with the rotation of the developer supplying roller, new or unused toner is supplied to the surface of the developing roller. In addition, the toner collected by the developer supplying roller is mixed with toner contained in the developing unit by the rotation of the developer supplying roller for eventual reuse.

Such residual toner that has not been used for image forming remains on the surface of the developing roller may be subjected to significant repetitive stress and may deteriorate, losing its toner charge property. Further, such toner deterioration can easily cause so-called toner filming on the surface of the developing roller. The toner filming may prevent providing and maintaining good charging performance on the surface of the developing roller, which may result in a significant adverse affect on image formation.

Therefore, it is important to determine in advance the distribution of adhesion forces of toner to the surface of the developing roller with respect to the toner, so that the developer supplying roller can effectively collect the toner remaining on the surface of the developing roller at any point on the surface of the developing roller.

SUMMARY OF THE INVENTION

Exemplary aspects of the present invention have been made in view of the above-described circumstances.

Exemplary aspects of the present invention provide an image forming apparatus that can include image processing members having good cleaning performance, which is evaluated and determined by a method of evaluating a distribution of adhesion forces between a powder particle and any of the image processing members.

In one exemplary embodiment, an image forming apparatus includes an optical writing unit configured to optically write an image, and an image processing member configured to process the image formed by the optical writing unit. Adhesion forces generated between a surface of the image processing member and a particle of a powder used to reproduce the image in the image forming apparatus are measured at multiple points on the surface of the image processing member.

The image processing member may be an image carrier configured to carry the image on a surface thereof. With this configuration, the image carrier may satisfy a relation of $X/2Y>1.3$, where "X" represents a mean value of the adhesion forces and "Y" represents a standard deviation or a root square of variance of the measured adhesion forces.

The powder may include a toner.

Particles of the toner may have a diameter in a range of from 1 μm to 20 μm.

The image processing member may be an image carrier configured to carry the image on a surface thereof. With this configuration, a cumulative relative frequency of the measured adhesion forces, which is a ratio obtained by dividing a cumulative frequency corresponding to the number of the measured adhesion forces in a given range by the total number of the measured adhesion forces may be 95% or greater.

The image processing member may be a cleaning blade configured to remove powder on a surface of a target member. With this configuration, the cleaning blade may satisfy relations of $X<5Z$ and $Y<5Z$, where "X" represents a mean value of the adhesion forces, "Y" represents a standard deviation or a root square of variance of the measured adhesion forces, and "Z" represents an adhesion force generated between the powder and a silicon substrate of the cleaning blade.

A surface roughness of the silicon substrate of the cleaning blade may be equal to or less than 1 nm.

The image processing member may be a collection roller configured to remove powder on a surface of a target member. With this configuration, the collection roller may satisfy a relation of $X/Y>4$, where "X" represents a mean value of the adhesion forces and "Y" represents a standard deviation or a root square of variance of the measured adhesion forces.

The image processing member may be to a developing roller provided to a developing unit configured to develop a latent image formed on an image carrier with a developer. The developing roller may be configured to carry the developer on a surface thereof to convey the developer to a development area facing the image carrier in an endless loop. With this configuration, the developing roller may satisfy a relation of $X+Y<5Z$, where "X" represents a mean value of the adhesion forces, "Y" represents a standard deviation or a root square of variance of the measured adhesion forces, and "Z" represents an adhesion force generated between the powder and a silicon substrate of the developing roller.

A surface roughness of the silicon substrate of the developing roller may be equal to or less than 1 nm.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
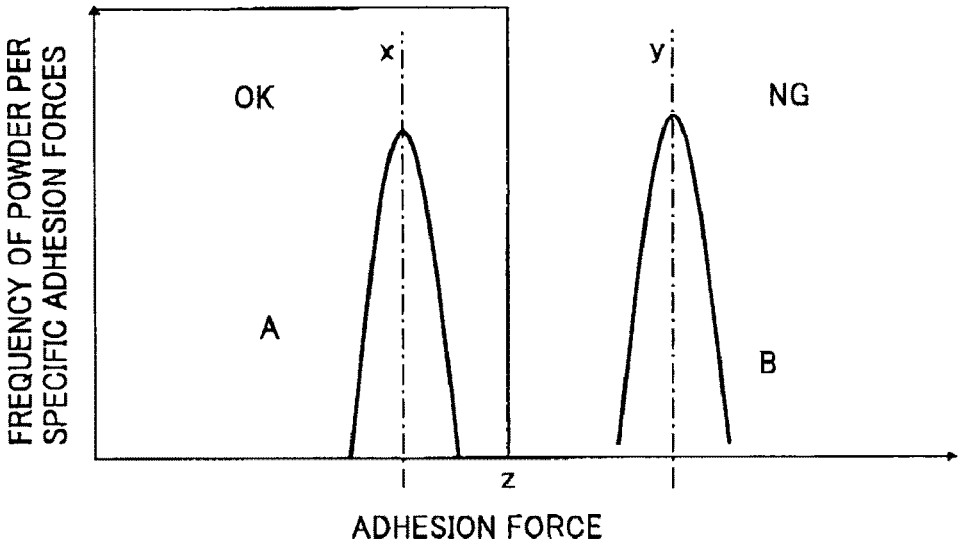
FIG. 1 BACKGROUND ART
FIG. 1 is a graph showing example measurements of adhesion forces generated between respective surfaces of members A and C and a power particle.
Figure 2:
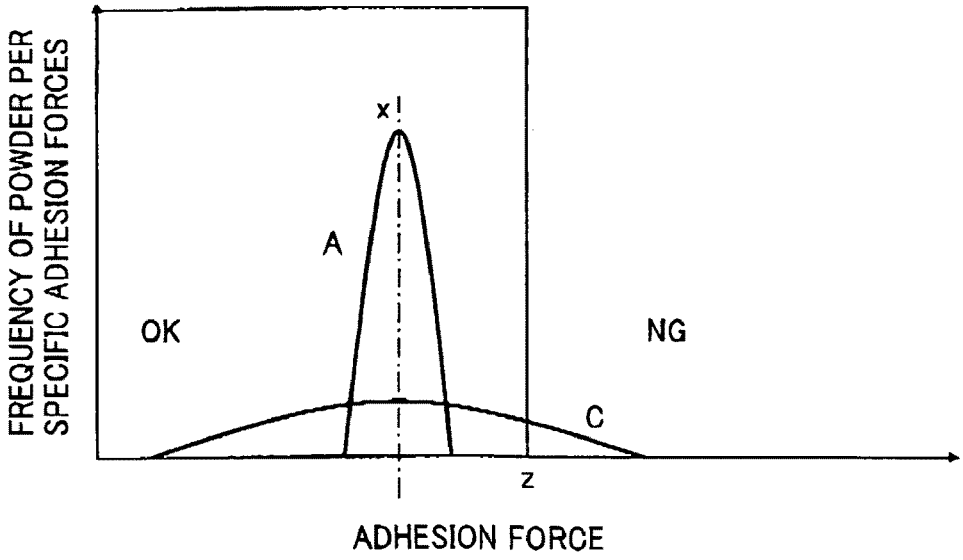
FIG. 2 BACKGROUND ART
FIG. 2 is a graph showing another example measurements of adhesion forces generated between respective surfaces of the member A and a member C and a powder particle.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

First Embodiment

Figure 3:
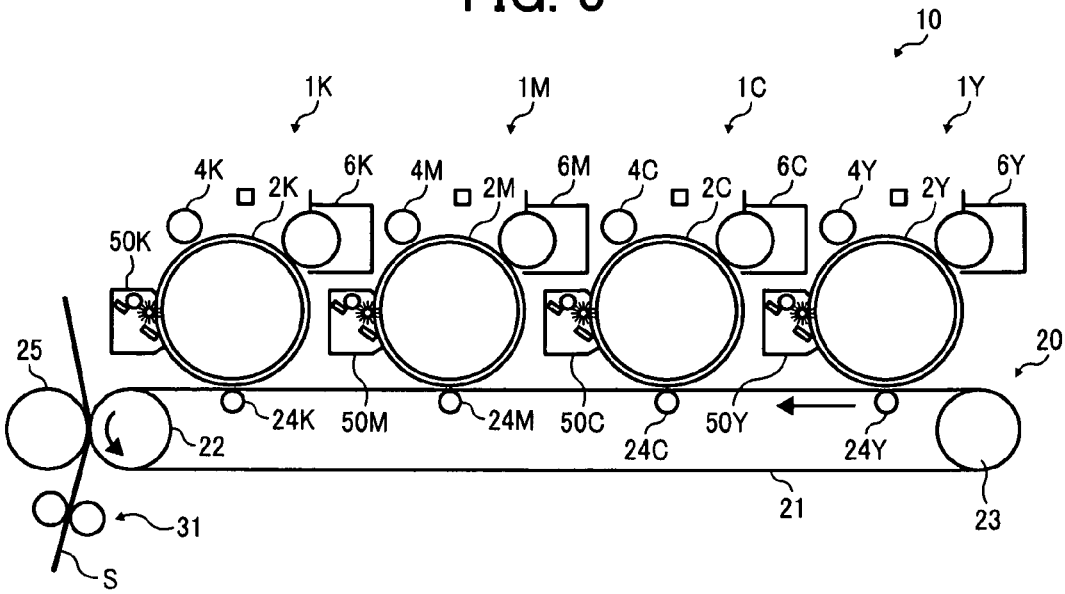
FIG. 3 is a schematic configuration of a printer according to a first embodiment of the present patent application.
Figure 4:
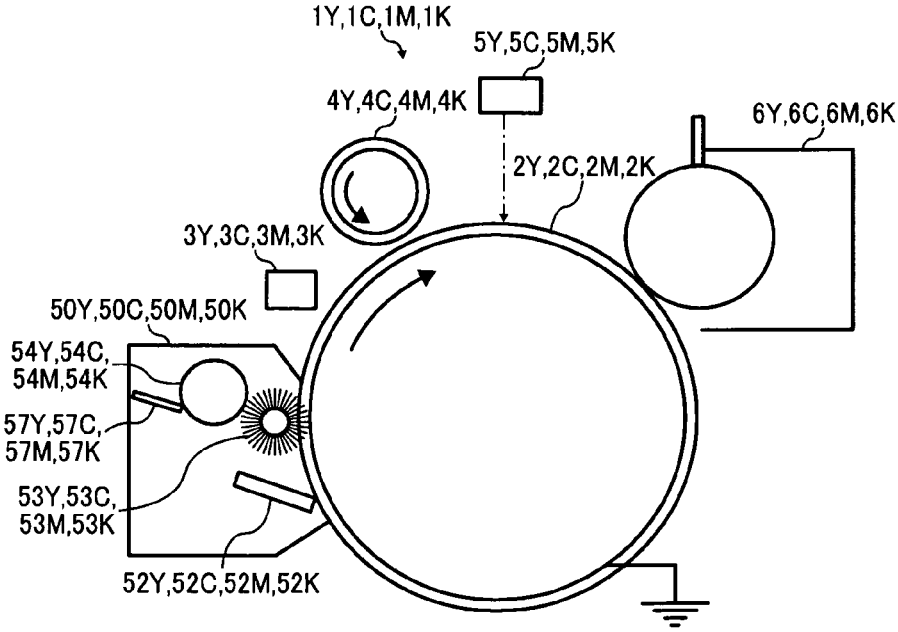
FIG. 4 is a schematic structure of an image processing mechanism of the printer of FIG. 3.

Referring to FIGS. 3 and 4, descriptions are given of an image forming apparatus according to a first embodiment of the present patent application.

FIG. 3 illustrates a schematic configuration of an image forming apparatus. The image forming apparatus corresponds to an electrophotographic printer (or simply "printer") 10 according to the first embodiment of the present patent application.

The printer 10 includes four image processing mechanisms 1Y, 1C, 1M, and 1K, which respectively form yellow (Y), cyan (C), magenta (M), and black (K) toner images. Each of the image processing mechanisms 1Y, 1C, 1M, and 1K have similar structure and functions, except for different toner colors. Accordingly, FIG. 4 illustrates a schematic structure of the image processing mechanism 1Y.

As shown in FIG. 4, the image processing mechanism 1Y includes a photoconductor 2Y, a cleaning unit 50Y, a discharging unit 3Y, a charging roller 4Y, an optical writing unit 5Y, and a developing unit 6Y. The photoconductor 2Y is rotated by a drive unit, not shown, in a clockwise direction as shown in FIG. 4, and is surrounded by the cleaning unit 50Y, the discharging unit 3Y, the charging roller 4Y, the optical writing unit 5Y, and the developing unit 6Y in this order.

The charging roller 4Y is disposed in contact with the photoconductor 2Y or faces the photoconductor 2Y in proximity thereto with a given gap. A charge bias is applied from a charge bias power source, not shown, to the charging roller 4Y so that the charging roller 4Y can uniformly charge a surface of the photoconductor 2Y while rotating in a counterclockwise direction in FIG. 4.

A charging member to charge the photoconductor 2Y is not limited to the charging roller 4Y. Instead of the charging roller 4Y, a charging brush can be employed to contact the surface of the photoconductor 2Y. Further, a charger such as a scorotron charger can be employed as a charging member for uniformly charging the photoconductor 2Y.

It is desirable that the charging roller 4Y has a roller part including a rigid conductive material, faces the photoconductor 2Y with a small gap therebetween, and has the following structure. That is, size of the charging roller 4Y in an axial direction may be set longer or greater than the maximum width of a printable image, which is approximately 290 mm for a machine processing A4-size sheets.

Further, the charging roller 4Y is provided with gap bearings disposed at both ends in the axial direction thereof. The gap bearings serve as an insulating spacer and have a diameter greater than a diameter of a center part of the charging roller 4Y. With the above-described structure, the charging roller 4Y contacts the gap bearings disposed at both ends to a non-image forming area arranged at both ends in an axial direction of the photoconductor 2Y. By so doing, a small gap ranging preferably from approximately 5 μm to approximately 100 μm and more preferably from approximately 20 μm to approximately 65 μm can be easily formed between the center portion of the charging roller 4Y and the surface of the photoconductor 2Y. In the first embodiment, the gap may be set to 55 μm.

The surface of the photoconductor 2Y, which has uniformly been charged by the charging roller 4Y, may be exposed and scanned by light emitted from the optical writing unit 5Y so as to hold an electrostatic latent image for yellow toner thereon.

The optical writing unit 5Y emits a laser light beam or light-emitting diode modulated based on image data sent from an external personal computer, etc.

The developing unit 6Y supplies yellow toner or Y-toner onto the electrostatic latent image on the surface of the photoconductor 2Y to develop the electrostatic latent image into a Y-toner image. The Y-toner image is transferred primarily onto an intermediate transfer belt, which will be described later.

The cleaning unit 50Y removes residual toner from the surface of the photoconductor 2Y after a primary transfer process of the Y-toner image onto the intermediate transfer belt. The cleaning unit 50Y of FIG. 4 includes a cleaning blade 52Y, a cleaning brush 53Y, a toner collection roller 54Y, and a toner collection roller cleaning blade 57Y.

The cleaning brush 53Y is disposed downstream from the cleaning blade 52Y in a rotation direction of the photoconductor 2Y and in contact with the surface of the photoconductor 2Y. The toner collection roller 54Y is held in contact with the cleaning brush 53Y. The toner collection roller cleaning blade 57Y is held in contact with the toner collection roller 54Y to remove the residual toner.

After the cleaning unit 50Y has removed the residual toner from the surface of the photoconductor 2Y, the discharging unit 3Y that includes a discharge lamp, not shown, electrically discharges the clean surface of the photoconductor 2Y for a subsequent image forming operation.

As previously described, the image processing mechanisms 1Y, 1C, 1M, and 1K have similar structures except respective toner colors. Specifically, as shown in FIG. 3, the image processing mechanism 1C includes a photoconductor 2C, a discharging unit 3C, a charging roller 4C, an optical writing unit 5C, a developing unit 6C, a cleaning unit 50C, and related units and components. Similarly, the image processing mechanism 1M includes a photoconductor 2M, a discharging unit 3M, a charging roller 4M, an optical writing unit 5M, a developing unit 6M, a cleaning unit 50M, and related units and components, and the image processing mechanism 1K includes a photoconductor 2K, a discharging unit 3K, a charging roller 4K, an optical writing unit 5K, a developing unit 6K, a cleaning unit 50K, and related units and components.

In FIG. 3, the printer 10 further includes a transfer unit 20, four primary transfer rollers 24Y, 24C, 24M, and 24K, a secondary transfer roller 25, a belt cleaning unit, not shown, and a pair of registration rollers 31.

The transfer unit 20 is disposed below the image processing mechanisms 1Y, 1C, 1M, and 1K, and includes an intermediate transfer belt 21 that is loop-shaped and rotates in a counterclockwise direction in FIG. 3.

The intermediate transfer belt 21 is extended by and spanned around a drive roller 22 and a driven roller 23, which are disposed inside the loop, and rotates in a counterclockwise direction in FIG. 3 in response to rotations of the drive roller 22.

The four primary transfer rollers 24Y, 24C, 24M, and 24K are disposed in contact with an outer surface of the intermediate transfer belt 21 to sandwich the intermediate transfer belt 21 between the four primary transfer rollers 24Y, 24C, 24M, and 24K and the photoconductors 2Y, 2C, 2M, and 2K, respectively. Accordingly, a primary transfer nip for forming yellow toner-image is formed between the primary transfer roller 24Y and the photoconductor 2Y, a primary transfer nip for forming cyan toner image is formed between the primary transfer roller 24C and the photoconductor 2C, a primary transfer nip for forming magenta toner image is formed between the primary transfer roller 24M and the photoconductor 2M, and a primary transfer nip for forming black toner image is formed between the primary transfer roller 24K and the photoconductor 2K. A transfer bias having a polarity opposite to the toner is applied to a back side (or inner loop side) of the intermediate transfer belt 21.

In the process of sequentially passing the primary transfer nips with the rotation of the intermediate transfer belt 21, yellow toner image, cyan toner image, magenta toner image, and black toner image formed on the photoconductors 2Y, 2C, 2M, and 2K, respectively, are primarily transferred onto an outer surface of the intermediate transfer belt 21. With this transfer operation of the toner images, one color toner image having four single colors thereon (hereinafter, referred to as a four-color toner image) is formed on the intermediate transfer belt 21.

Outside the loop of the intermediate transfer belt 21, the secondary transfer roller 25 is disposed to which a secondary transfer bias that is output by a power source, not shown, is applied. The secondary transfer roller 25 is held in contact with the drive roller 22, which is disposed inside the loop, via the intermediate transfer belt 21 that is sandwiched therebetween so that a secondary transfer nip may be formed between the secondary transfer roller 25 and the drive roller 22.

A sheet feeding cassette is set below the transfer unit 20. The sheet feeding cassette accommodates a stack of recording sheets including a recording sheet S atop the stack.

The recording sheet S is fed to a sheet path at a given timing. When the recording sheet S reaches a pair of registration rollers 31 that is disposed at a far end of the sheet path, the pair of registration rollers 31 guides the recording sheet S between the rollers thereof. On sandwiching the recording sheet S by the rollers thereof, the pair of registration rollers 31 stops its rotation so as to convey the recording sheet S to the secondary transfer nip in synchronization with the four-color toner image formed on the intermediate transfer belt 21.

Due to nip pressure or a secondary transfer electrical field formed between the secondary transfer roller 25 to which the secondary transfer bias is applied and the drive roller 22 that is grounded, the four-color toner image formed on the intermediate transfer belt 21 is secondarily transferred onto the recording sheet S within the secondary transfer nip. Then, the four-color toner image merges with white color of the recording sheet S to form a full-color toner image.

After the recording sheet S has passed through the secondary transfer nip, the intermediate transfer belt 21 may still hold residual toner that has not been transferred onto the recording sheet S. Such residual toner is removed by the belt cleaning unit that sandwiches the intermediate transfer belt 21 with the driven roller 23.

A fixing unit is disposed above the secondary transfer roller 25. The fixing unit fixes the full-color toner image to a surface of the recording sheet S by application of heat and pressure, which is a known technique used in an electrophotographic image forming apparatus.

Since the yellow toner, cyan toner, magenta toner, and black toner on the photoconductors 2Y, 2C, 2M, and 2K may respectively receive the primary transfer bias that has a polarity opposite thereto at the primary transfer nips, the yellow toner, cyan toner, magenta toner, and black toner may be charged to the opposite polarity. Therefore, regularly charged toner particles and oppositely charged toner particles are mixed in the residual toners remaining on the photoconductors 2Y, 2C, 2M, and 2K.

In the printer 10 having the above-described basic configuration, the four image processing mechanisms 1Y, 1C, 1M, and 1K correspond to toner image forming mechanisms by which a toner image is formed on a surface of each of the photoconductors 2Y, 2C, 2M, and 2K that can rotate endlessly. Further, a combination of the four image processing mechanisms 1Y, 1C, 1M, and 1K and the transfer unit 20 also serves as a toner image forming mechanism to form the toner image on the surface of the intermediate transfer belt 21 that serves as an image conveying member.

Next, a description is given of affects to frequency of toner adhesion exerted when toner on the toner collection roller 54 disposed in the cleaning unit 50 is separated by the toner collecting roller cleaning blade 57.

Known evaluating methods generally performs an evaluation of a characteristic of toner adhesion to a member such as the toner collection roller 54 only with frictional force that is a mean value of adhesion forces and a friction coefficient. In this case, the frictional force is a force that is needed to remove toner from a member. For example, a known evaluating method is used to measure changes or variation of a drive torque of a member caused when scraping a large amount of toner on the member in rotation to obtain an average load calculated based on the measurements as a frictional force.

However, when separation phenomenon with respect to the friction coefficient was evaluated, the inventors of the present patent application often found that, even though the friction coefficient of the surface of the toner collection roller 54 was small, the toner was not effectively removed from the surface of the toner collection roller 54.

Figure 5:
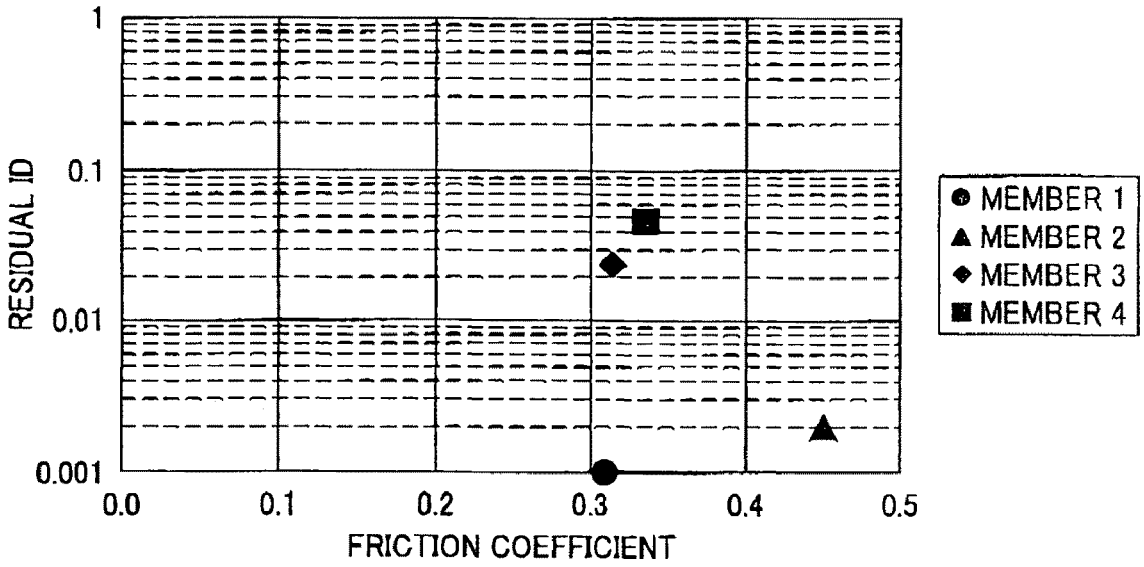
FIG. 5 is a graph showing relations of friction coefficient and cleaning performance of sample members corresponding to a toner collection roller included in the image processing mechanism of FIG. 2.
Figure 6A:
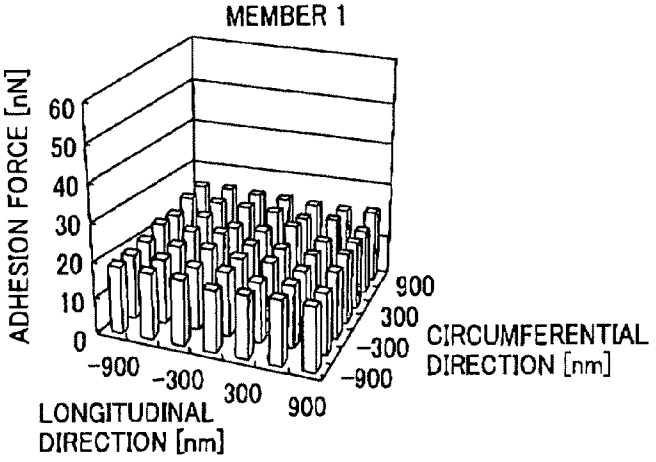
FIGS. 6A, 6B, 6C, and 6D are graphs showing respective measurement of adhesion forces of toner to sample members.
Figure 6B:
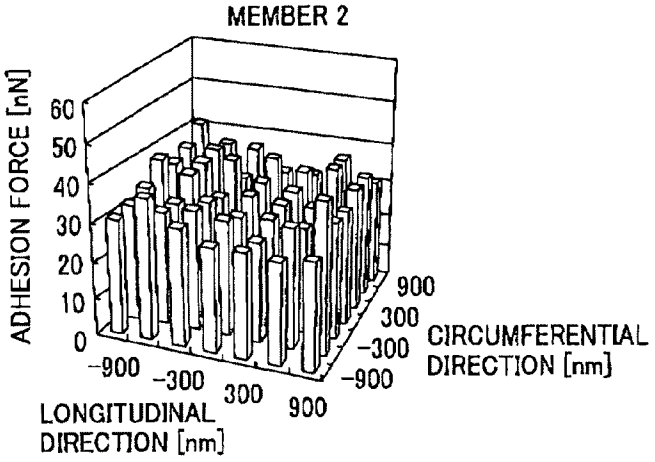
Figure 6C:
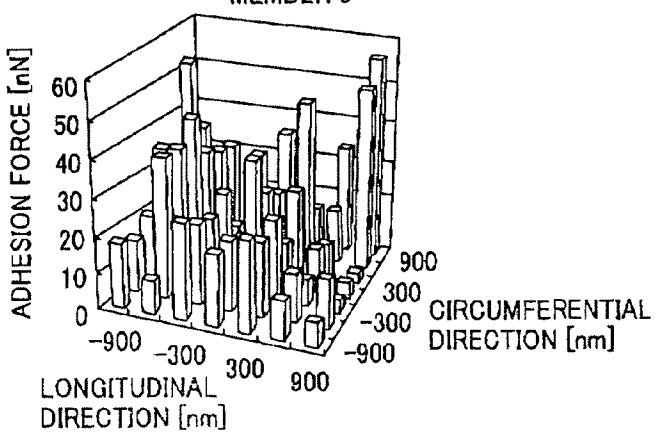
Figure 6D:
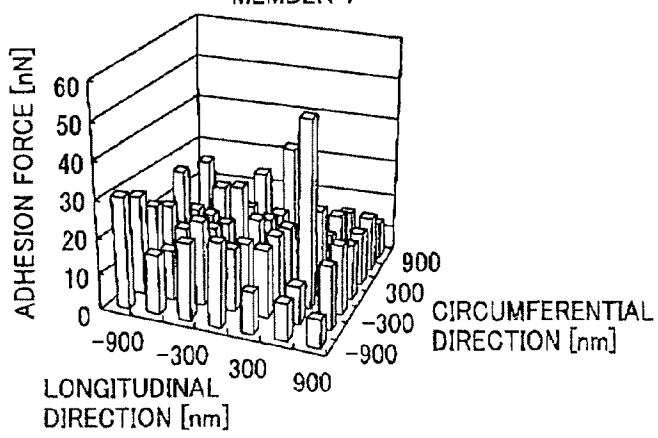

FIG. 5 is a graph showing relations of friction coefficient and cleaning performance of different sample members 1 through 4 corresponding to the toner collection roller 54. The sample member 1 corresponds to the toner collection roller 54 having a surface including a PVDF tube with UV coating, the sample member 2 corresponds to that including ceramic hard type C1, the sample member 3 corresponds to that including stainless steel, and the sample member 4 corresponds to that including a PVDF tube.

The friction coefficient of the surface of the toner collection roller 54 indicated in the horizontal axis of the graph of FIG. 5 is measured by an Euler belt method. A paper sheet is cut so that the longer edge of the paper sheet is parallel to the machine direction in the paper manufacturing process. Two hooks are set at each shorter edge of the paper sheet, and a load is set at one hook and a digital force gauge is set at the other hook. The paper sheet is pulled horizontally with the digital force gauge while the load is controlled so as not to dance. Provided when a force at which the paper sheet starts to move is F (unit: N), the coefficient μ of static friction of the toner collection roller 54 is determined by the following equation: $\mu=(2/\pi)\ln(F/0.98)$.

The vertical axis of the graph of FIG. 5 shows residual image density or residual ID indicating amounts of residual toner remaining on the toner collection roller 54 after the toner collection roller cleaning blade 57 has removed the residual toner conveyed from the surface of the photoconductor 2. The greater residual ID indicates that the greater amount of residual toner remains on the toner collection roller 54.

As can be seen from FIG. 5, both friction coefficient and residual ID of the sample member 2 is greater than those of the sample member 1. According to this result, conventional evaluation of cleaning performance has been based on friction coefficient. However, even though the friction coefficients of the sample members 2, 3, and 4 are substantially equal or similar to each other, the residual IDs of the sample members 3 and 4 are greater than that of the sample member 2. That is, even though the frictional force is smaller than that of the sample member 2, toner on the toner collection roller 54 corresponding to either the sample member 3 or the sample member 4 may not be removed effectively from the toner collection roller 54. Accordingly, it has become clear that there is no correlation between the friction coefficient and the cleaning performance.

From the above-described conclusion, in the measurement with a method such as the above-described Euler belt method, friction coefficients are measured not in a contact area of a surface to which one toner particle contacts but in an area of a surface having an averaged surface condition. This area is far wider than the contact area. However, the contact area with a surface condition in a range of some square micrometers ($\mu m^2$), for example, is not always same as the wider area with a surface condition in a range of some square millimeters ($mm^2$) For example, even when the overall surface of the wider area is ragged, the overall surface of the contact area becomes undulating. To be exact, with respect to one toner particle, the measured friction coefficient may be different from the friction coefficient of one toner particle contacting the contact area. Therefore, even through being smaller than the friction coefficient at a point in the contact area of toner, the friction coefficient at a point in the wider area of a member is different from that in the contact area of toner. As a result, it is contemplated that an appropriate cleaning condition cannot be set, which can lead to poor toner removability. It is therefore contemplated to be difficult to evaluate the cleaning performance of the toner collection roller 54 adequately according to the friction coefficient. Because of the above-described result, it had been still difficult to rely on the above-described method of evaluating the toner adhesion phenomenon.

Further, from the above-described reasons, in the above-described surface condition, it is contemplated that, by only defining a surface roughness of a member, poor toner separation from a member is difficult to overcome.

Consequently, the inventors of the present patent application thought it important to evaluate adhesion ability of one toner particle with respect to the toner collection roller 54. The inventors measured adhesion forces of one toner particle with respect to the toner collection roller 54, and determined whether or not the cleaning performance of the toner collection roller 54 can be evaluated accurately, based on the measured adhesion forces.

Next, a description is given of how important to obtain a distribution of characteristic values of adhesion forces of toner on the surface of the toner collection roller 54 according to a measurement of adhesion force with respect to one toner particle.

Many of known measurement methods of adhesion forces of powder such as toner conduct a measurement of adhesion forces generated between a mass of powder and a member. However, powder as a mass has distributions of particle diameter, shape, etc., and therefore it is difficult to maintain accuracy to repeatedly evaluate a distribution of the characteristic values of the surface of the member.

For example, in a method of measuring adhesion forces using a centrifugal force described in "M. Takeuchi, A. Onose, M. Anzai, R. Kojima and K. Kawai: Proc. IS&T 7th Int. Congress Adv. Non-Impact Printing Technology, 21991, vol. 1, pp. 200-208", a sample substrate with a powder attached thereto is prepared to evaluate the centrifugal force to separate the powder from the sample substrate. However, according to the above-described reasons, this measuring method cannot determine a distribution of the characteristic values of the surface of a member. In the first embodiment, adhesion forces are measured with a constantly same particle, e.g., one toner particle, so as to maintain accuracy to repeatedly determine a distribution of the adhesion forces of toner to the surface of the member.

Figure 7:
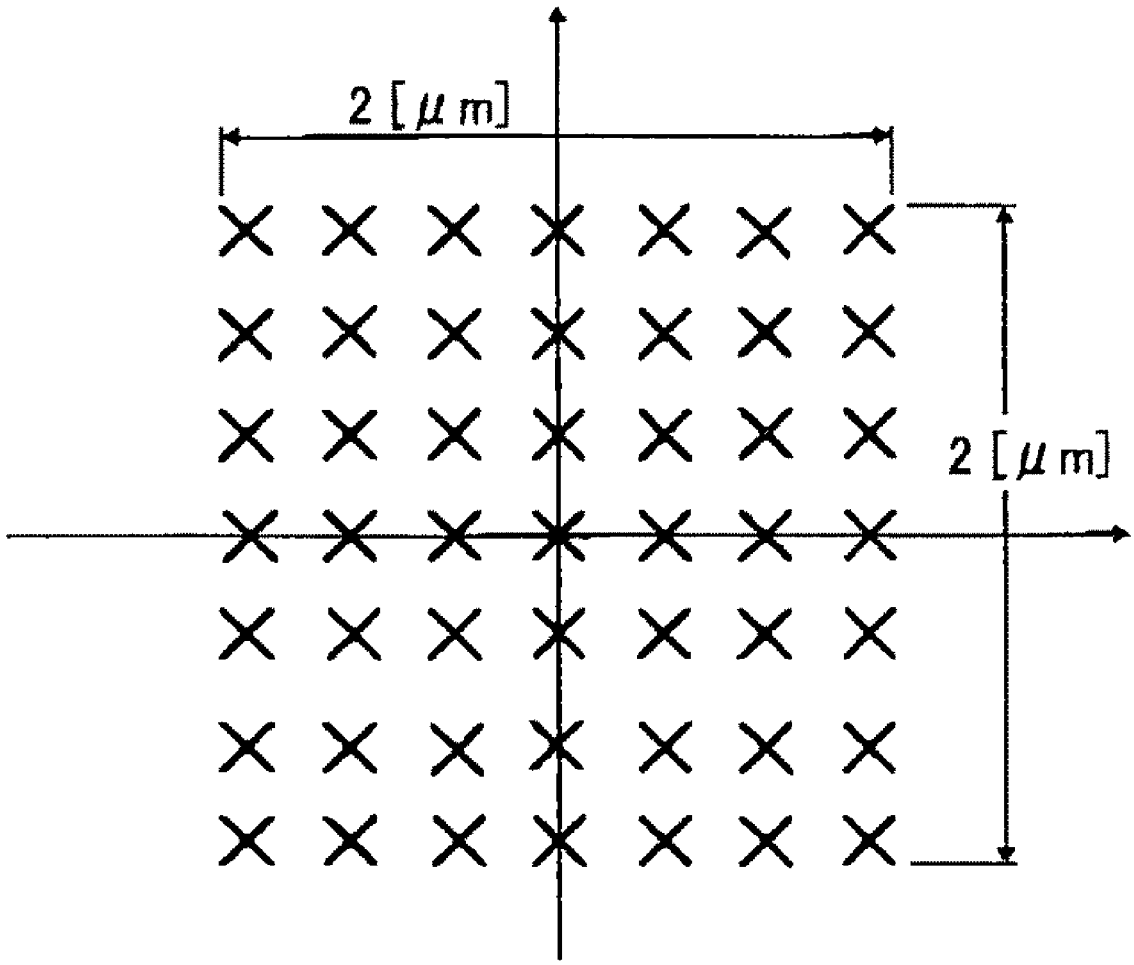
FIG. 7 is a drawing of an area for a measurement of adhesion forces.

FIGS. 6A, 6B, 6C, and 6D are graphs showing respective measurements of adhesion forces of one toner particle with respect to sample members 1 through 4, which corresponds to the toner collection roller 54. Specifically, the adhesion forces generated between one toner particle and each of the sample members 1 through 4 were measured at multiple points on the surface of the toner collection roller 54, specifically, at 49 points (=7 points×7 points) in an area of 2 micrometer square ($\mu m^2$) as shown in FIG. 7.

This measurements of adhesion forces can conduct with an atomic force microscope or AFM, for example. A summary of the AFM and measurements of adhesion forces with the AFM is described below. However, the method of measuring adhesion forces generated between one powder particle such as toner and a member such as the toner collection roller 54 is not limited to be conducted with the AFM. For example, a method of measuring adhesion forces can be performed with an instrument or unit that can measure adhesion forces at multiple points on a member. Alternatively, a method disclosed in Japanese Patent Laid-open Publication No. 2001-183289 can be applied, for example.

Principle of operation of the AFM is described in many public documents (for example, Appl. Phys. Lett., Vol. 56, No. 18, 30 Apr. 1990, Pages 1758-1759). A principle of operation of non-contact type AFM is described as follows: A cantilever with a tip of needle (probe chip or chip) having a surface made of substance such as silicon nitride, silicon dioxide attached thereto is used to scan a sample surface. The cantilever with the probe chip is brought close to a surface of a target sample to measure a force between the sample surface and the probe chip by the deflection of a laser light beam to a photodiode as curl or bend of the cantilever. Then, a signal based on the measurements is set to a feed back control so as to control a distance between the probe chip and the sample surface by piezo element.

When measuring adhesion forces with an AFM, the cantilever may need to be decorated. Specifically, target powder is attached to the tip of the cantilever by an adhesive such as epoxy resin by using a dedicated unit as disclosed in Japanese Patent Laid-open Publication No. 2002-062253 or by using the AFM.

Further, there are two methods of measuring adhesion force with an AFM.

A force curve measurement method or force-distance curve measurement method is an adhesion force measuring method in which a tip of a cantilever and a sample surface are contacted to each other and separated from each other continuously, so that adhesion forces between the cantilever and the sample surface can be obtained based on an amount of flexure of the cantilever on separation of the tip of the cantilever and the sample surface. (For example, Japanese Patent Laid-open Publication No. 2002-062253.)

The other method is pulsed-force-mode atomic force microscopy (PFM-AFM). The PFM-AFM is applied based on the force curve measurement (for example, Appl. Phys. Lett., Vol. 71, No. 18, 3 Nov. 1997, Pages 2632-2634).

While the concept of the force curve measurement is to measure one point, the PFM-AFM performs the force curve measurement in a two-dimensional region repeatedly. Specifically, while scanning the sample surface in a range of from approximately 0.1 Hz to approximately 10 Hz, a table with the sample thereon was vibrated in a vertical direction at approximately 100 Hz to approximately 1000 Hz. By so doing, the tip of the cantilever and the sample surface can contact with each other and separate from each other continuously.

It is preferable to evaluate the sample in measurement area conditions in a range of from 500 nm to 10,000 nm. While evaluating the distribution of the adhesion force, when the area is too small, local variance of the adhesion forces may affect significantly to obtain a standard deviation appropriate to determine based on the distribution of the adhesion forces. Accordingly, depending on an evaluation target, the measurement area condition is set to a range of 500 nm or greater.

Further, when the AMF is used as an adhesion force measurement unit, a significantly large area cannot be set. For example, the maximum settable area with the PFM-AFM is from some thousand nm to 10,000 nm. In addition, the AFM has a speed of movement of a sample table or a cantilever of some thousand nm/s at maximum. Therefore, it is not preferable to take a long measurement period for a significantly large area.

Further, it is preferable to measure 25 points in a square of 5 points×5 points as data for mapping distribution of adhesion force. It is highly likely to cause variance in data with measurement data of smaller than 25 points.

Table 1 shows results of the thus measured mean and dispersion values of adhesion forces of toner to the sample members 1 to 4.

TABLE 1

| Adhesion force | Sample Member 1 | Sample Member 2 | Sample Member 3 | Sample Member 4 |
|---|---|---|---|---|
| Average [nN] | 24.6 | 31.2 | 22.3 | 16.9 |
| Dispersion [$nN^2$] | 3.2 | 9.0 | 157.9 | 50.0 |

From Table 1 and FIG. 5, the sample member 1 is smaller than the sample member 2 in both a mean value of the adhesion forces and a residual ID. At the same time, the sample members 3 and 4 have a smaller mean value of the adhesion forces but a greater residual ID than the sample member 2. That is, similar to a relation between friction coefficient and cleaning performance, a mean value of the adhesion forces and a residual ID or cleaning performance have no correlation therebetween.

Then, the inventors of the present patent application focused on variation (or frequency distribution) of adhesion forces to determine whether or not the adhesion forces are substantially equal at any point on the surface of the toner collection roller 54. Instead of the variation (frequency distribution) of adhesion forces as shown in Table 1, variation of standard deviations can be applied.

From Table 1 and FIG. 5, the sample members 1 and 2 that have a smaller residual ID have small dispersion, and the sample members 3 and 4 that have a greater residual ID have large dispersion. That is, when the adhesion force values measured at the multiple points gather in proximity to the mean value of the adhesion forces, the adhesion forces may be substantially equal at any point on the surface of the toner collection roller 54. Therefore, the toner collection roller cleaning blade 57 cleaned the surface of the toner collection roller 54 stably at any point thereon, which led to good cleaning performance of the toner collection roller 54, and as a result, the residual ID became small.

By contrast, when the adhesion force values measured at the multiple points are significantly away from the mean value of the adhesion forces, the adhesion forces may be significantly different at some points on the surface of the toner collection roller 54. Therefore, the toner collection roller cleaning blade 57 could not clean the surface of the toner collection roller 54 stably at some points thereon, which degraded cleaning performance of the toner collection roller 54, and as a result, the residual ID became large. Accordingly, it is possible to accurately evaluate the cleaning performance of the toner collection roller 54 according to the dispersion of the adhesion forces measured at the multiple points (standard deviation), that is, frequency of variations of adhesion forces (frequency distribution).

A member that can be applied to the present patent application is not limited to the toner collection roller 54, but a member that has a substantially even surface can be applied to the present patent application. For example, the present patent application can apply a member that can be included in an image forming apparatus, as shown in FIG. 3, having at least one of the photoconductor 2, the developing unit 6, the charging roller 4 serving as a charging unit, and the transfer unit 20. Particularly, the present patent application can be effectively applied to the photoconductor 2, the developing unit 6, the intermediate transfer belt 21, the cleaning unit 50, and other image processing member to which toner directly contact. Further, the present patent application can be effectively applied to the charging roller 4 and other image processing member that should avoid adhesion of toner. By applying the present patent application to the above-described image processing members, image processing members to which toner cannot easily adhere can be determined and developed effectively.

The following descriptions are given of image processing members included in an image forming apparatus according to the first embodiment of the present patent application.

<Electrophotographic Photoconductor>

An electrophotographic photoconductor used as an image processing member provided to an image forming apparatus for the present patent application is illustrated in detail with reference to the drawings.

The photoconductor serving as an image carrier of the present patent application can be an electrophotographic photoconductor. Since electrophotographic photoconductor is used to carry a toner image to transfer to a recording sheet or an intermediate transfer member, it is not preferable to have adhesion force to toner. Accordingly, the present patent application can be preferably used.

Figure 8:
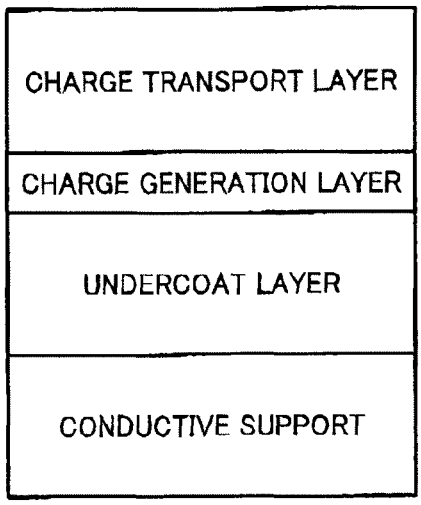
FIG. 8 is a drawing of layers of a photoconductor.
Figure 9:
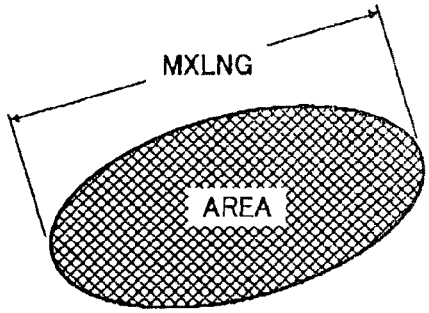
FIG. 9 is a drawing showing a roundness of a toner particle.

Electrophotographic photoconductor may be formed by multiple layers including at least an undercoat layer and a photoconductive layer on a conductive support. For example, FIG. 8 represents a functionally-separated electrophotographic photoconductor including a photoconductive layer formed of a charge generation layer (CGL) and a charge transport layer (CTL).

Suitable materials for use as the conductive support include material having a volume resistivity not greater than $10^{10}$ Ω·cm. Specific examples of such materials include, but are not limited to, plastic films, plastic cylinders, or paper sheets, on the surface of which a metal such as aluminum, nickel, chromium, nichrome, copper, gold, silver, platinum, and the like, or a metal oxide such as tin oxides, indium oxides, and the like, is formed by deposition or sputtering. In addition, a metal cylinder can also be used as the conductive support, which is prepared by tubing a metal such as aluminum, aluminum alloys, nickel, and stainless steel by a method such as a drawing and ironing method, an impact ironing method, an extruded ironing method, and an extruded drawing method, and then treating the surface of the tube by cutting, super finishing, polishing, and the like treatments. Alternative to the above-described materials, a plate nickel belt and an endless stainless belt can be used as the conductive support.

Otherwise, one for which electrically conductive powder is dispersed in a proper binder resin and coating is made on the conductive support, can be also used as the conductive support in the present patent application. As the electroconductive powder, carbon black, acetylene black, metal powder of aluminum, nickel, iron, nichrome, copper, zinc, silver, or the like and metal oxide powder of electrically conductive tin oxide, ITO (indium tin oxide), or the like, can be provided.

Also, as a binder resin that is simultaneously used, thermoplastic resins, thermosetting resins, and photo-setting resins, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly(vinyl formal), poly(vinyltoluene), poly(N-vinylcarbazole), acrylic resin, silicone resin, epoxy resin, melamine resin, urethane resin, phenol resin, and alkyd resins can be provided. Such an electrically conductive layer can be provided by dispersing the electrically conductive powder and the binder resin in a proper solvent such as tetrahydrofuran, ethyl methyl ketone, and toluene and by applying them.

Furthermore, one made by providing on a proper cylindrical substrate an electrically conductive of a heat-shrinkable tubing that contains the aforementioned electrically conductive powder in a material such as poly(vinyl chloride), poly (propylene), polyester, poly(styrene), poly(vinylidene chloride), poly(ethylene), chlorinated rubber, and Teflon (Registered trademark), can be used well as the conductive support in the present patent application.

Next, the undercoat layer is described.

The undercoat layer may be formed between the conductive support and the photoconductive layer. The undercoat layer is formed for the purpose of improving adherence of the photoconductive layer to the conductive support, preventing moire, improving coating capability of the above layer, and decreasing a residual potential.

The undercoat layer typically includes a resin as a main component. Since the photosensitive layer is typically formed on the undercoat layer by a wet coating method, the undercoat layer preferably has a good resistance to the solvent included in the coating liquid of the photosensitive layer. Suitable resins for use in the undercoat layer include, but are not limited to, water-soluble resins such as polyvinyl alcohol, casein, and sodium polyacrylate; alcohol-soluble resins such as copolymer nylon and methoxymethylated nylon; and cured resins forming a three-dimensional network structure such as polyurethane, melamine resins, alkyd-melamine resins, and epoxy resins. Specifically, the alkyd-melamine resins are preferably used to meet various functions required as the undercoat layer.

The undercoat layer may include fine powders of metal oxides such as titanium oxide, silica, alumina, zirconium oxide, tin oxide, and indium oxide, metal sulfides, and metal nitrides. Specifically, titanium oxide can remain white when exposed to visible light and near-infra red light, and it is preferable to cause electrophotographic photoconductor to have high sensitivity.

The undercoat layer can be formed by a conventional coating method using a proper solvent. However, to enhance chargeability of an electrophotographic photoconductor, the solvent of the coating method for the undercoat layer preferably includes at least from 0.1 wt % to 3 wt % of ethylene glycol monoisopropyl ether.

Further, a metal oxide layer formed by, e.g., a sol-gel method using a silane coupling agent, titanium coupling agent or a chromium coupling agent is effectively used as the undercoat layer.

In addition, a layer of aluminum oxide, which is formed by an anodic oxidation method and a layer of an organic compound such as polyparaxylylene (parylene) or an inorganic compound such as $SnO_2$, $TiO_2$, ITO, or $CeO_2$, which is formed by a vacuum evaporation method, may be used as the undercoat layer as well.

The undercoat layer preferably has a thickness of from approximately 0.1 μm to approximately 10 μm, and more preferably from approximately 1 μm to approximately 5 μm.

Next, the photoconductive layer is described.

The charge generation layer can include a charge generating material. Any known charge generation materials can be used for the present patent application. Specific examples of usable charge generation materials include, but are not limited to, phthalocyanine-based pigments such as metal phthalocyanine such as titanyl phthalocyanine and chlorogallium phthalocyanine and no-metal phthalocyanine, azulenium salt pigments, a methane squarate pigment, symmetric or asymmetric azo pigments having a carbazole skeleton, symmetric or asymmetric azo pigments having a triphenylamine skeleton, symmetric or asymmetric azo pigments having a diphenylamine skeleton, symmetric or asymmetric azo pigments having a dibenzothiophene skeleton, symmetric or asymmetric azo pigments having a fluorenone skeleton, symmetric or asymmetric azo pigments having an oxadiazole skeleton, symmetric or asymmetric azo pigments having a bisstilbene skeleton, symmetric or asymmetric azo pigments having a distyryl oxadiazole skeleton, symmetric or asymmetric azo pigments having a distyryl carbazole skeleton, parylene-based pigments, anthraquinone-based or polycyclic quinone-based pigments, quinoneimine-based pigments, diphenylmethane or triphenylmethane-based pigments, benzoquinone or naphthoquinone-based pigments, cyanine or azomethine-based pigments, indigoid-based pigments, bis(benzimidazole)-based pigments, etc.

Specifically, no-metal phthalocyanine or metal phthalocyanine is used for the charge generation material used in the present patent application, and is obtained by a synthetic method described in Moser et al., "Phthalocyanine Compounds" (1963) or other appropriate method.

Specific examples of metal phthalocyanine used for the charge generation material include, but are not limited to, copper, silver, beryllium, magnesium, calcium, zinc, indium, sodium, lithium, titanium, tin, lead, vanadium, chromium, manganese, iron, cobalt, and the like as a central metal. Also, instead of the above-described metal atom, metal halide having trivalent atom or greater can exist in a core of phthalocyanine. Phthalocyanine is known to have various crystal forms. As metal phthalocyanine, the known crystal forms such as α-form, β-form, Y-form, ε-form, τ-form, X-form and the like and known amorphous forms can be used.

Among these materials, it is more preferable to use titanyl phthalocyanine (hereinafter, TiOPc) having titanium as the central metal since it has a high sensitivity and good property.

Next, the charge transport layer (CTL) is described.

As described above, the charge transport layer is formed by dissolving or dispersing a charge transportation material and a binder resin in a proper solvent, coating it on a charge generation layer, and drying it. Also, if necessary, a plasticizer, a leveling agent, an antioxidant, etc., can be added.

The charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, benzoquinone derivatives, and the like compounds. These electron transport materials can be used alone or in combination.

Specific examples of the positive-hole transport materials include, but are not limited to, known materials such as poly-N-carbazole and its derivatives, poly-ν-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like. These charge transfer materials can be used alone or in combination. In addition, polymeric charge transfer materials having both charge transport ability and a function as binder can also be used.

Specific examples of the binder resin for use in the CTL include known thermoplastic resins and thermosetting resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the charge transfer material in the CTL is preferably from 20 parts by weight to 300 parts by weight, and more preferably from 40 parts by weight to 150 parts by weight, per 100 parts by weight of the binder resin included in the CTL.

The thickness of the CTL is preferably equal to or greater than 30 μm in view of resistivity of the photoconductor as described above. Since an extremely thick CTL can decrease the resolution, it is preferable that the thickness of the CTL is in a range of from 30 μm to 50 μm.

The solvent used here is preferably non-halogen solvent in an attempt to reduce pressure on the environment. Specific examples of the non-halogen solvent include, but are not limited to, tetrahydrofuran, cyclic ether such as dioxolane and dioxane, aromatic carbon hydride such as toluene and xylene, and their derivatives.

The photoreceptor of the present patent application may include a protective layer on an outermost layer in the purpose of protecting a photoconductive layer and maintaining of a low surface friction coefficient.

Specific examples of binder resins for use in the protective layer include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like resins.

Further, fillers may be incorporated in the protective layer in order to improve the wear resistance. Fillers are classified into organic fillers and inorganic fillers; inorganic fillers are advantageous in order to enhance the wear resistance owing to the higher hardness of filler. Examples of the inorganic filler include, but are not limited to, powders of metals such as copper, tin, aluminum, and indium and the like; metal oxides such as silica, tin oxide, zinc oxide, titanium oxide, alumina, zirconium oxide, indium oxide, antimony oxide, bismuth oxide, calcium oxide, tin oxide doped with antimony, and indium oxide doped with tin and the like; and metal fluorides such as tin fluoride, calcium fluoride, aluminum fluoride and the like; titanate potassium, boron nitride, etc.

These fillers may be surface-treated with at least one surface-treating agent, which is preferable in terms of dispersion properties of the inorganic filler. Poor dispersion properties of the inorganic filler cause decreased transparency of coated film and formation of film defects as well as increase of residual potential. Further, it may deteriorate wear resistance of the coated film and thus may lead to serious problems impeding high durability or image quality.

As the surface-treating agent, though any known surface-treating agent can be used, a surface-treating agent capable of maintaining the insulation of the inorganic filler is preferred. Specific examples of such surface-treating agents include, but are not limited to, titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and mixtures thereof. These are preferable because of being able to impart good dispersibility to fillers and to prevent the blurred image problem. When a filler treated with a silane coupling agent is used, the blurred image problem tends to be caused. However, when used in combination with the surface treating agents mentioned above, the problem can be avoided. The content of a surface treating agent in a coated filler, which depends on the average primary particle diameter of the filler, is from 3% by weight to 30% by weight, and more preferably 5% by weight to 20% by weight. When the content is too low, good dispersibility cannot be obtained. To the contrary, when the content is too high, residual potential seriously increases. These fillers can be used alone or in combination.

Suitable solvents for use in the coating liquid include, but are not limited to, tetrahydrofuran, dioxane, toluene, dichloromethane, monochlorobenzene, dichloroethane, cyclohexanone, methyl ethyl ketone, acetone, and the like solvents, which can be used for the charge transfer layer 23.

Further, addition of the charge transfer material picked up for the charge transfer layer to the photoconductive layer is effective and useful to reduce the residual potential and increase the image quality.

The protective layer can be coated by a coating method such as dip coating, spray coating, bead coating, nozzle coating, spinner coating and ring coating. In particular, spray coating is preferably used in view of uniformity of the protective layer.

The thickness of the protective layer may be optionally determined; however, the thickness is preferably designed to be minimum within the necessary range, since the image quality tends to decrease when the thickness of the protective layer is unnecessarily large. The thickness of the protective layer is preferably from 0.1 μm to 10 μm.

<Toner>

The toner of the present patent application preferably includes an additive contained in a toner particle. Any known additive materials can be used for the present patent application. Specific examples of usable additive materials include, but are not limited to, oxides such as Si, Ti, Al, Mg, Ca, Sr, Ba, In, Ga, Ni, Mn, W, Fe, Co, Zn, Cr, Mo, Cu, Ag, V, and Zr, and composite oxides, etc. Among these, silica, titania, alumina, which are oxides of Si, Ti, and Al, are preferably used. An amount of the additive is preferably from 0.5 parts to 1.8 parts with respect to 100 parts of mother toner particle, and more preferably from 0.7 parts to 1.5 parts with respect to 100 parts of mother toner particle.

The toner is preferably surface-treated with a surface treating agent such as an organic silane compound. Specific examples of the organic silane compounds include, but are not limited to, alkyl chlorosilane derivatives such as methyl trichlorosilane, octyl trichlorosilane, and dimethyl dichlorosilane; and alkyl methoxysilane derivatives such as dimethyl dimethoxysilane and octyl trimethoxysilane. Also, hexamethyl disilazane, silicone oil, and the like can be used.

The process of surface treating a toner is not particularly limited, but well-known methods are applicable. For example, a process involving adding an additive in a solvent(s) containing an organic silane compound, and then drying, a process involving spraying a solvent containing an organic silane compound to an additive, and then drying, and the like can be applied.

The average particle diameter of the toner used for electrophotographic image forming apparatus is preferably from 3 μm to 7 μm.

<Shape of Toner>

A shape factor "SF-1" is a parameter representing the roundness of a particle. The shape factor "SF-1" of a particle is calculated by a following Equation 1:

$$SF1=\{(MXLNG)^2/AREA\}\times(100\pi/4) \quad \text{Equation 1}$$

where "MXLNG" represents the maximum major axis of an elliptical-shaped figure obtained by projecting a toner particle on a two dimensional plane, and "AREA" represents the projected area of elliptical-shaped figure.

In the first example, the image forming apparatus is preferably configured to use spherical toner containing particles having a shape factor SF-1 in a range of from approximately 100 to approximately 150.

<Carrier>

As the magnetic carrier C, any known carrier having a particle diameter of from 20 μm to 200 μm such as iron powder, ferrite powder, magnetite powder, magnetic resin carrier, etc. can be used.

The magnetic carrier used in the printer 10 according to the first embodiment of the present patent application has a mean diameter of 55 μm, includes magnetic material such as ferrite in a core material including metal or resin, and has a surface coated with a silicone resin. Specific examples of the coating material of the surface of the magnetic carrier include, but are not limited to, amino resin such as urea-formaldehyde resin, melamine resin, benzoguanamine resin, urea resin, polyamide resin, and epoxy resin; and other resins such as polyvinyl resin, polyvinylidene resin, acrylic resin, polymethyl methacrylate resin, polyacrylonitrile resin, polyacetic acid vinyl resin, polyvinyl alcohol resin, polyvinyl butyral resin, polystyrene resin, and the like Other specific examples of the coating material of the magnetic carrier include, but are not limited to, polystyrene resin such as styrene acryl copolymer, halogenated olefin resin such as polyvinyl chloride, polyester resin such as polyethylene terephthalate resin and polybutylene terephthalate resin, polycarbonate resin, polyethylene resin, polyvinyl fluoride resin, polyvinylidene fluoride resin, polytrifluoroethylene resin, polyhexafluoropropylene resin, copolymer of vinylidene fluoride and acrylic monomer, copolymer of vinylidene fluoride and vinyl fluoride, fluoroterpolymer such as terpolymer of tetrafluoroethylene and vinylidene fluoride and non-fluoride monomer, silicone resin, and the like.

As needed, the coating material of the magnetic carrier can contain conductive powder. Specific examples of the conductive powder include, but are not limited to, metallic powder, carbon black, titanium oxide, tin oxide, zinc oxide, and the like. These conductive powder preferably include a mean particle diameter of 1 μm or smaller. When the mean particle diameter of the magnetic carrier exceeds 1 μm, the control of electrical resistance may become difficult.

<Toner Collection Roller>

In order to remove toner from a member, a brush cleaning method may be employed as one cleaning method for a cleaning unit of an image forming apparatus. The brush cleaning method can reduce damage such as peeling of a surface of an image carrier, mainly photoconductor, and provide high cleaning performance when removing toner having small particle diameter or spherical shape. The cleaning unit employing the brush cleaning method includes a cleaning brush disposed in slidably contact with the surface of the photoconductor, a toner collection roller disposed in contact with the cleaning brush, and a cleaning member such as a toner collection roller cleaning roller disposed to receive the toner from the toner collection roller. A voltage is applied either to the toner collection roller or to both the toner collection roller and the cleaning brush to remove the toner electrostatically. Therefore, it is useful to collect toner having a spherical shape.

The toner collection roller to which toner does not adhere easily has an advantage to remove the toner and is a preferable member to be applied to the present patent application.

Suitable materials for use as the toner collection roller include material having a volume resistivity not greater than $10^{10}$ Ω·cm. Such toner collection roller include, but are not limited to, a surface including a metal such as aluminum, nickel, chromium, nichrome, copper, gold, silver, platinum, and the like is formed, or a resistant layer on a conductive shaft.

As the resistant layer, thermoplastic resins or thermosetting resins, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly (vinylidene chloride), polyallylate resin, phenoxy resin, polycarbonate, cellulose acetate resin, ethylcellulose resin, poly (vinyl butyral), poly(vinyl formal), poly(vinyltoluene), poly (N-vinylcarbazole), acrylic resin, silicone resin, epoxy resin, melamine resin, urethane resin, phenol resin, and alkyd resins can be provided.

<Charging Unit>

A charge roller is one of a charging member using a roller method to charge at image carrier or photoconductor uniformly. When the charge roller is contaminated, the image carrier cannot be charged uniformly, and which can be a cause to produce defect images to be output from the image forming apparatus. In most cases, the contamination in the charge roller may be caused by toner adhesion to the charge roller. Therefore, it is preferable that the charge roller has good cleaning ability or cleaning performance with respect to toner. Accordingly, the present patent application can be applied effectively.

The charging member including the charge roller includes an ion conductive rubber layer formed over a core including stainless steel. The resistance of the rubber layer is in a range of from approximately $10^4\Omega$ to approximately $10^8\Omega$. The hardness of rubber material used for the charge roller is preferably 40° or greater (JIS-A), and more preferably 70° or greater. The material used for the charge roller is not limited to the rubber material but may include other conductive material such as elastomer, resin, etc. It is desirable that the other conductive materials have a hardness corresponding to the hardness of the rubber material.

Since a resin material is not elastic, it is easy to maintain a gap accurately. That is, the charge roller including a resin material can prevent a change of a distance of a gap to a photoconductor in an axial direction and can maintain a constant distance of the gap.

The surface layer of the charge roller has a resistance value of approximately $10^{10}\Omega$. This surface layer can prevent a phenomenon in which a current flow concentrates to a specific portion on the photoconductor when the specific portion has a low resistance such as a pinhole. The resistance value of the surface layer is preferably $10^{10}\Omega$ or greater.

<Developing Unit>

A developing unit is designed to develop an electrostatic latent image formed on a surface of a photoconductor to a toner image. Such developing unit generally includes a developing roller to supply toner to the photoconductor. Since the developing roller transfers toner to a photoconductor, it is not preferable to have a large adhesion force with respect to toner. Therefore, the present patent application can be applied effectively.

<Developing Roller for One-Component Developer>

To charge the one-component toner frictionally, a developing roller for one-component developer includes a roller part and a metallic axis part. The roller part includes an elastic member having an outer circumference with low friction coefficient such as rubber, etc. The metallic axis part runs in an axial direction through a center of the roller part.

As the elastic member of the developing roller, an elastic rubber, an elastomer and the like applicable to the developing roller may be implemented by one or more of butyl rubber, fluorine-contained rubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrine rubber, polysulfide rubber, polynorbornene rubber, thermoplastic elastomer (e.g., polystyrene, polyolefin, polyvinyl chloride, polyurethane, polyamide, polyurea, polyester, or fluorocarbon resin). However, specific example materials of the elastic member of the developing roller is not limited to the above-described materials.

<Developing Roller for Two-Component Developer>

Similar to the developing roller for two-component developer, a developing roller for two-component developer includes a roller part including an elastic member having low friction coefficient, a metallic axis roller that runs in an axial direction through a center of the roller part, and a roller having a metallic surface. Specific examples of the metallic roller may include, but are not limited to, aluminum, nickel, chromium, nichrome, copper, gold, silver, platinum and the like.

A coating material may be provided to a surface of the developing roller appropriately so as to obtain temporal stability in quality. The material coating the developing roller may be chargeable to polarity opposite to the polarity of the toner or to the same polarity as the toner if the developing roller does not function to charge the toner by friction. The material chargeable to polarity opposite to the polarity of the toner is, e.g., a material containing silicone resin, acryl resin, polyurethane resin or rubber. Typical of the material chargeable to the same polarity as the toner is fluorine. Teflon (registered trademark)-based materials containing fluorine have inherently low surface energy and a desirable parting ability, and therefore cause a minimum of filming ascribable to aging to occur.

Specific examples of general resins for use in the surface of the surface coating material include polytetrafluoroethylene (PTFE), tetrafluoroethylene-perfluoroalkylvinylether copolymers (PFA), tetrafluoroethylene-hexafluo-ropropylene copolymers (FEP), polychlorotrifluoroethylene (PCTFE), tetrafluoroethylene-ethylene copolymers (ETFE), chlorotrifluoroethylene-ethylene copolymers (ECTFE), polyvinylidene fluoride (PVDF), polyvinylfluoride (PVF), etc. Carbon black or similar conductive substance is often added to such resins in order to provide them with conductivity. Further, other resins may be mixed thereto in order to provide uniform coating to a developing roller.

<Intermediate Transfer Member>

Since an intermediate transfer member transfers a toner image onto a recording sheet, it is not preferable that the intermediate transfer member has a large adhesion force with respect to toner. Therefore, the present patent application can preferably be applied to the intermediate transfer member.

Figure 10:
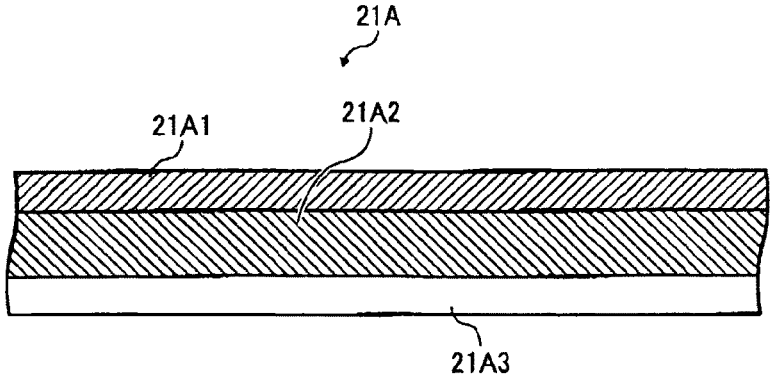
FIG. 10 is a cross-sectional view of an intermediate transfer member included in the printer of FIG. 3.

FIG. 10 is a cross sectional view of an intermediate transfer member 21A that can be applied to an image forming apparatus to which the present patent application is applicable. The intermediate transfer member 21A may correspond to the intermediate transfer belt 21.

The intermediate transfer member 21A includes a surface coat layer 21A1, an elastic layer 21A2, and a base layer 21A3. The elastic layer 21A2 of the intermediate transfer member 21A has a low hardness so as to easily change its shape with respect to a toner layer at a transfer nip and a less smooth sheet. Since the surface of the intermediate transfer member 21A can be flexibly deformed or changed according to a local convex and concave shape, it is not necessary to increase a transfer pressure excessively to a toner layer to obtain good adhesiveness. Further, no hollow defect may occur, and transfer nonuniformity may not occur on a solid area of a non-smooth paper. Therefore, an image with good uniformity can be obtained.

As the elastic member of the intermediate transfer member, an elastic rubber, an elastomer and the like applicable to the intermediate transfer member may be implemented by one or more of butyl rubber, fluorine-contained rubber, acrylic rubber, EPDM, NBR, acrylonitrile-butadiene-styrene rubber, natural rubber, isoprene rubber, styrene-butadiene rubber, butadiene rubber, urethane rubber, syndiotactic 1,2-polybutadiene, epichlorohydrine rubber, polysulfide rubber, polynorbornene rubber, thermoplastic elastomer (e.g., polystyrene, polyolefin, polyvinyl chloride, polyurethane, polyamide, polyurea, polyester, or fluorocarbon resin). However, specific example materials of the elastic member of the intermediate transfer member is not limited to the above-described materials.

<Developing Roller for Two-Component Developer>

Similar to the developing roller for two-component developer, a developing roller for two-component developer includes a roller part including an elastic member having low friction coefficient, a metallic axis roller that runs in an axial direction through a center of the roller part, and a roller having a metallic surface. Specific examples of the metallic roller may include, but are not limited to, aluminum, nickel, chromium, nichrome, copper, gold, silver, platinum and the like.

The thickness of the elastic layer, which may depend on hardness and layer composition, is preferable in a range of from 0.07 mm to 0.3 mm. When the thickness is 0.3 mm or greater, the intermediate transfer member is bowed or bent due to a press force by a cleaning blade or the cleaning blade is pressed against the intermediate transfer member so as to interfere a smooth movement of the intermediate transfer member. To the contrary, when the content is 0.07 mm or smaller, a force on the intermediate transfer member to toner becomes large at the secondary transfer nip. The increase of the force can cause hollow defect easily, and may deteriorate transferability of toner.

Further, the hardness of the elastic layer preferably satisfies a relation of $10 \leqq HS \leqq 65$ (JIS-A). Even though an optimum hardness differs depending on the thickness of layer of the intermediate transfer member, when the hardness is smaller than 10° (JIS-A), the hollow defect can occur easily. By contrast, when the hardness is greater than 65° (JIS-A), the intermediate transfer member cannot be tensioned by rollers. When the intermediate transfer member is tensioned by the rollers for a long time, the intermediate transfer member may be extended unrecoverably, which may require replacement in a shorter life period.

A base layer of the intermediate transfer member includes a less extendable resin. Specific examples of the resin of the base layer may be made of one or more of polycarbonate, fluorine-contained resin (e.g. ETFE or PVDF), polystyrene, chloropolystyrene, poly-.alpha.-methylstyrene, styrene-butadiene copolymer, styrene-vinyl chloride copolymer, styrene-vinyl acetate copolymer, styrene-maleic acid copolymer, styrene-acrylate copolymer (e.g. styrene-methyl acrylate copolymer, styrene-ethyl acrylate copolymer, styrene-butyl acrylate copolymer, styrene-octyl acrylate copolymer or styrene-phenyl acrylate copolymer), styrene-methacrylate copolymer (e.g. styrene-methyl methacrylate copolymer, styrene-ethyl methacrylate copolymer or styrene-phenyl methacrylate copolymer), styrene-.alpha.-methyl chloroacrylate copolymer, styrene-acrylonitrile-acrylate copolymer or similar styrene resin (monomer or polymer containing a styrene substitute product or a styrene substitute product), methyl methacrylate resin, butyl methacrylate resin, ethylacrylate resin, butyl acrylate resin, modified acrylic resin (e.g. silicone-modified acrylic resin, vinyl chloride resin-modulated acrylic resin or acrylic urethane resin), vinyl chloride resin, styrene-vinyl acrylate copolymer, vinyl chloride-vinyl acrylate copolymer, resin-modulated maleic acid resin, phenol resin, epoxy resin, polyester resin, polyester polyurethane resin, polyethylene, polypropylene, polybutadiene, polyvinylidene chloride, ionomer resin, polyurethane resin, silicone resin, ketone resin, ethylene-ethylacrylate copolymer, xylem resin, polyvinyl butyral resin, polyamide resin, and modified polyphenylene oxide resin. However, specific example materials of the base layer of the intermediate transfer member is not limited to the above-described materials.

As the material for the interlining layer, one or two or more of the following anti-tensible materials can be used. As the anti-tensible materials, there are natural fiber, synthetic fiber, inorganic fiber, and metal fiber. As the natural fiber, there are cotton, silk, and so on. As the synthetic fiber, there are polyester fiber, nylon fiber, acrylic fiber, polyolefin fiber, polyvinylalcohol fiber, polyvinyl chloride fiber, polyvinylidene chloride fiber, polyurethane fiber, polyacetal fiber, polyfluoroethylene fiber, phenol fiber, and so on. As the inorganic fiber, there are carbon fiber, glass fiber, boron fiber, and so on. As the metal fiber, there are iron fiber, copper fiber, and so on. One or two or more of the above materials are fabricated to form cloth or yarn and the cloth or the yarn can be used for the core layer. However, the material is not limited to the above. In addition, as a method for twisting filaments of the fiber to form the yarn, there are a single twisting method, a double twisting method, plural-filaments twisting method, and so on; however, any of the methods can be used. Further, two or more of the above fibers can be mixed. Moreover, a conductive process can be applied to the yarn or the cloth. As a method for weaving the cloth by using the yarns, there are a knitting method and so on; however, any of the methods can be used.

In addition to the above materials for the layers, the following materials can be used. In the surface layer of the intermediate transfer member, contamination to the photoconductor body caused by the elastic material must be prevented, toner adhering strength must be lowered by reducing surface friction resistance to the surface of the intermediate transfer belt 10 (for increasing cleaning property), and a toner image must be excellently transferred to a secondary transferability.

Therefore, one or more of polyurethane resin, polyester resin, and epoxy resin can be used for the surface coat layer. Further, lubrication must be high by reducing the surface energy. Therefore, one or more of powders or particles of fluorine resin, fluorine compound, carbon fluoride, titanium dioxide, and silicon carbide can be dispersed in the layer; or the same kinds of the above material whose particle diameter is different can be dispersed in the layer. In addition, the surface energy can be reduced by forming a fluorine-rich layer on the surface by applying heat treatment to a fluorine based rubber material.

A conductive material for adjusting a resistance value is contained in some layers of the base layer 21A3, the elastic layer 21A2, or the surface coat layer 21A1, as necessity. As the conductive materials, there are carbon black, graphite, metal powder made of, for example, aluminum, and nickel, and conductive metal oxides. As the conductive metal oxides, there are tin oxide, titanium oxide, antimony oxide, indium oxide, potassium titanate, composite oxide of antimony oxide-tin oxide (ATO), composite oxide of indium oxide-tin oxide (ITO), etc. The conductive metal oxides can be coated by insulation particles such as barium sulfate, magnesium silicate, calcium carbonate, and so on. The conductive materials are not limited to the above.

<Cleaning Blade>

A cleaning blade scrapes toner from a surface of an image processing member such as a photoconductor, a toner collection roller, and an intermediate transfer belt so as to clean the image processing member. When the cleaning blade has a great adhesion force to toner, a great amount of toner can be removed in a contact area of the cleaning blade and the photoconductor, for example. Since the removed toner can easily accumulate in a proximity to the contact area, this action is not preferable for performing an effective cleaning operation. Accordingly, the present patent application can preferably used.

The cleaning blade may include materials such metal, resin, and rubber. Rubber material such as fluorine-contained rubber, silicone rubber, butyl rubber, butadiene rubber, polyisoprene rubber, and urethane rubber is preferably used. Among these materials, urethane rubber is more preferably used.

The cleaning blade can have conductivity by adding conductive materials as additives thereto when mixing the materials. Also, a protective layer can be provided to the cleaning blade to protect from modification of the surface property related to adhesion forces and abrasion of the surface.

As the protective layer of the cleaning blade, thermoplastic resins or thermosetting resins, such as poly(styrene), styrene-acrylonitrile copolymer, styrene-butadiene copolymer, styrene-maleic anhydride copolymer, polyester, poly(vinyl chloride), vinyl chloride-vinyl acetate copolymer, poly(vinyl acetate), poly(vinylidene chloride), polyallylate resin, phenoxy resin, polycarbonate, cellulose acetate resin, ethylcellulose resin, poly(vinyl butyral), poly(vinyl formal), poly (vinyltoluene), poly(N-vinylcarbazole), acrylic resin, silicone resin, epoxy resin, melamine resin, urethane resin, phenol resin, and alkyd resins can be provided. However, specific example materials of the protective layer of the cleaning blade is not limited to the above-described materials.

Modified Embodiment

Next, a description is given of a modified printer 10A having a configuration partially different from the printer 10 according to the first embodiment.

Figure 11:
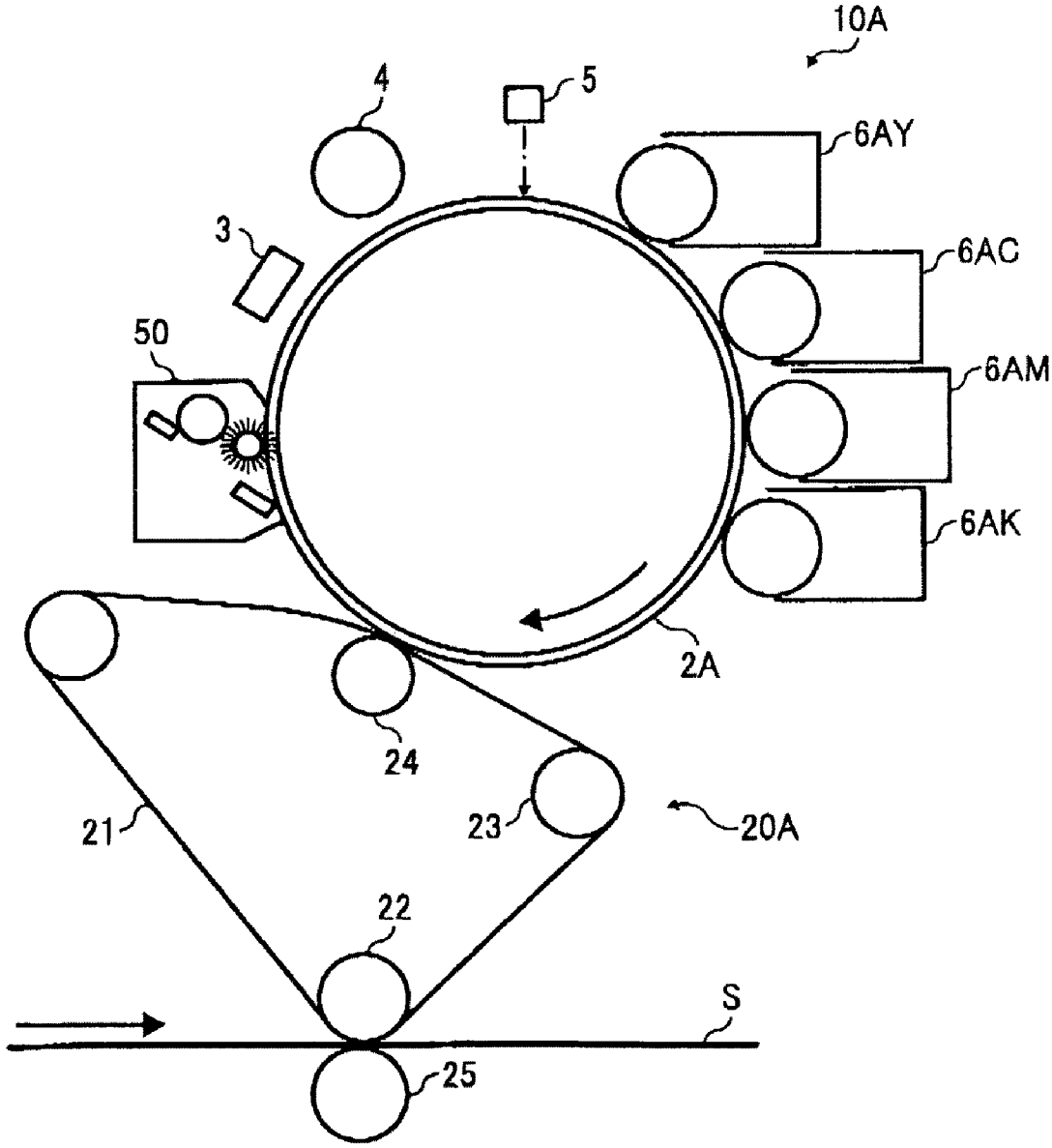
FIG. 11 is a schematic configuration of a printer according to a modified embodiment of the present patent application.

FIG. 11 is a schematic configuration of the printer 10A, which is a revolvable-type full-color printer.

The printer 10A of FIG. 11 includes one photoconductor 2A that is surrounded by the cleaning unit 50, the discharging unit 3, the charge roller 4, the optical writing unit 5, and four developing units 6AY, 6AC, 6AM, and 6AK.

The four developing units 6AY, 6AC, 6AM, and 6AK are respectively driven by a contact and separation mechanism to move reciprocally to contact with and separate from a surface of the photoconductor 2A. Specifically, each of the developing units 6AY, 6AC, 6AM, and 6AK moves its developing sleeve reciprocally between a development position at which the developing sleeve thereof comes close to or contacts with the photoconductor 2A and a retrieval position at which the developing sleeve stays away from the photoconductor 2A. The developing units 6AY, 6AC, 6AM, and 6AK develop a latent image formed on the photoconductor 2A only when moved at the development position.

The structures of the discharging unit 3, the charge roller 4, and the optical writing unit 5 are same as those in the image processing mechanism 1 according to the first embodiment.

The photoconductor 2A is irradiated by the optical writing unit 5 to form an electrostatic latent image for yellow toner to be developed by the developing unit 6AY to a yellow toner image. Then, the yellow toner image is primarily transferred onto the intermediate transfer belt 21 of a transfer unit 20A. The above-described operations are repeated for three times while the intermediate transfer belt 21 rotates for three cycles so as to form cyan toner image, magenta toner image, and black toner image sequentially on the surface of the photoconductor 2A. These toner images are sequentially overlaid on the yellow toner image on the intermediate transfer belt 21. Accordingly, a four-color toner image is formed on the intermediate transfer belt 21.

The transfer unit 20A has a similar structure to the transfer unit 20, except the transfer unit 20A receives toner images one at a time to composite the toner images. The intermediate transfer belt 21 is spanned around and extended by multiple rollers such as the drive roller 22, the driven roller 23, and a primary transfer roller 24 that has the same function as the primary transfer rollers 24Y, 24M, 24C, and 24K of FIG. 3.

The secondary transfer roller 25 is disposed below the intermediate transfer belt 21 and is controlled to contact with and separate from the intermediate transfer belt 25 by a contact and separation mechanism. The secondary transfer roller 25 remains separated from the intermediate transfer belt 21 while the intermediate transfer belt 21 rotates multiple cycles to receive the yellow, cyan, magenta, and black toner images that are sequentially overlaid thereon. After the four-color toner image has formed on the surface of the intermediate transfer belt 21, the secondary transfer roller 25 contacts the intermediate transfer belt 21 to form a secondary transfer nip. The four-color toner image is transferred onto the recording sheet S at the secondary transfer nip.

The cleaning unit 50 removes residual toner remaining on the surface of the photoconductor 2A after the primary transfer operation. The cleaning unit 50 of FIG. 11 includes the cleaning blade 52, the cleaning brush 53, the toner collection roller 54, and the toner collection roller cleaning blade 57.

The cleaning brush 53 is disposed downstream from the cleaning blade 52 in a rotation direction of the photoconductor 2A and arranged in slidably contact with the surface of the photoconductor 2A. The toner collection roller 54 is held in contact with the cleaning brush 53. The toner collection roller cleaning blade 57 is held in contact with the toner collection roller 54 to remove the residual toner on the surface of the photoconductor 2A.

The printer 10A according to the modified example embodiment an also achieve the above-described effects by using the present patent application.

Second Embodiment

Figure 12:
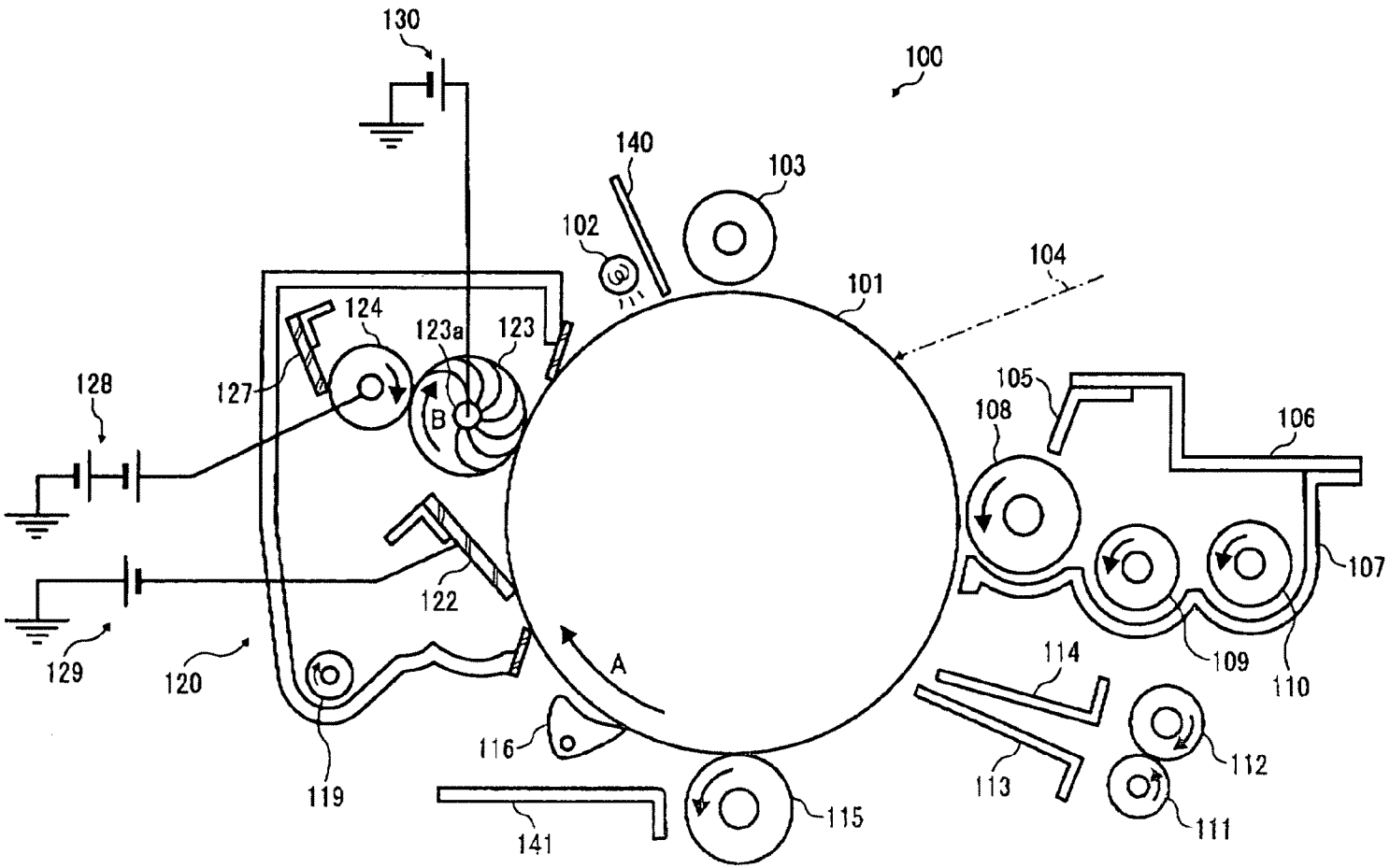
FIG. 12 is a schematic configuration of a copier according to a second embodiment of the present patent application.

Referring to FIG. 12, descriptions are given of an image forming apparatus according to a second embodiment of the present patent application.

FIG. 12 illustrates a schematic configuration of an electrophotographic image forming apparatus, which is hereinafter referred to as a copier 100, according to the second embodiment of the present patent application. The copier 100 scans an image at a scanning part and produces monochrome or black-and-white copies based on the scanned image data.

The copier 100 of FIG. 12 includes a photoconductor 101, a discharge lamp 102, a charge roller 103, a developing unit 106, a transfer roller 115, a cleaning unit 120, and a light blocking plate 140.

The photoconductor 101 is a drum-shaped image carrier, and is surrounded by the charge roller 103 that serves as a charging unit and the developing unit 106 that serves as a toner image forming unit to develop a toner image based on an electrostatic latent image.

The transfer roller 115 serves as a transfer unit to perform a transfer operation in which the toner image developed by the developing unit 106 is transferred onto a recording sheet serving as recording medium. A transfer bias is applied by a power source to the transfer roller 115.

The cleaning unit 120 cleans the photoconductor 101 by removing residual toner remaining on the surface of the photoconductor 101 after the transfer operation.

The discharge lamp 102 discharges electrical charge on the surface of the photoconductor 101.

The light blocking plate 140 is disposed between the discharge lamp 102 and the charge roller 103 to block light emitted by the discharge lamp 102.

The charge roller 103 is disposed facing the surface of the photoconductor 101 with a give gap therebetween, and charges the surface of the photoconductor 101 to a given potential and a given polarity. The photoconductor 101 of the copier 100 is uniformly charged to a minus polarity.

A laser light beam 104 is emitted from an optical writing unit to the uniformly charged surface of the photoconductor 101 so as to form an electrostatic latent image based on image data.

The developing unit 106 includes a developing roller 108 that serves as a developer carrier and a casing 107.

The developing roller 108 includes magnet therein as a magnetic field generator. A developing bias is applied by a power source to the developing-roller 108.

The casing 107 contains two-component developer including toner and carriers, and includes a developer supplying screw 109 and an agitating screw 110 to agitate while conveying the two-component developer to opposite directions to each other along their axes. The toner used in the copier 100 is a pulverized-type, irregular-shaped toner.

The developing unit 106 further includes a doctor 105 to regulate the developer carried on the developing roller 108.

The toner agitated and conveyed by the developer supplying screw 109 and the agitating screw 110 is charged to a negative polarity. By action of the magnet included in the developing roller 108, the developer is conveyed in an upward direction by the developing roller 108. The developer conveyed by the developing roller 108 is regulated by the doctor 105 to form magnetic brush with magnetic bristles that stand on the surface of the developing roller 108 and face the photoconductor 101 in a development area.

Next, a description is given of image forming operations performed in the copier 100.

When a copy start button provided in an operating part, the scanning unit starts scanning a document. A given voltage or current is sequentially applied at given timing to the charge roller 103, the developing roller 108, the transfer roller 115, and a cleaning brush 123, which is described later. In synchronization with this action, a photoconductor drive motor rotates the photoconductor 101 in a direction indicated by arrow "A" in FIG. 12. At the same time of start of the rotation of the photoconductor 101, the developing roller 108, the transfer roller 115, the developer supplying screw 109, the agitating screw 110, and a toner exhausting screw 119, the cleaning brush 123, and a toner collection roller 124 are rotated in their given directions.

While rotating in the direction A, the surface of the photoconductor 101 is charged by the charge roller 103 to a potential of, for example, −700V. Then, the laser light beam 104 based on image data is emitted from the optical writing unit to the surface of the photoconductor 101. At this time, the potential of an irradiated part of the photoconductor 101 is reduced to −120V, for example, to form an electrostatic latent-image.

The photoconductor 101 with the electrostatic latent image thereon slidably contact the magnetic brush of developer formed on the developing roller 108 at a portion facing the developing unit 106. At this time, the negatively charged toner on the developer roller 108 is attracted to the electrostatic latent image formed on the surface of the photoconductor 101 due to the developing bias of −450V, for example, applied to the developing roller 108, so that the electrostatic latent image can be developed to a toner image.

As described above, in the second embodiment, the developing unit 106 develops the electrostatic latent image formed on the photoconductor 101 to a toner image with the negatively charged toner.

In the second embodiment, the developing unit 106 uses a negative-positive non-contact charge roller method, but not limited to the above-described method.

A recording sheet is fed from a sheet feeding unit, passes between a lower registration roller 111 and an upper registration roller 112, is guided by guide plates 113 and 114, and reaches a transfer area formed between the photoconductor 101 and the transfer roller 115. The transfer sheet is stopped at a portion between the lower registration roller 111 and the upper registration roller 112, and moves in synchronization with the leading edge of the toner image Then, the toner image formed on the photoconductor 101 is transferred to the recording sheet in the transfer area. When the toner image is transferred onto the recording sheet, a transfer bias controlled to a constant current of +10 μA, for example, to the transfer roller 115.

The transfer sheet with the toner image is separated from the photoconductor 101 by a separator 116, guided by a conveyance guide plate 141, and conveyed to a fixing unit. The fixing unit fixes the toner image onto the recording sheet by application of heat and pressure. Then, the recording sheet is discharged outside the copier 100.

After the transfer operation, the cleaning unit 120 removes residual toner remaining on the surface of the photoconductor 101, and the discharge lamp 102 discharges electrical charge from the surface of the photoconductor 101.

Next, a detailed description is given of the cleaning unit 120.

As shown in FIG. 12, the cleaning unit 120 includes the cleaning brush 123 to which a plus voltage is applied by a brush power source 130. Further, a conductive cleaning blade 122 is disposed at a position upstream, in a direction of movement of surface of the photoconductor 101, from where the cleaning brush 123 removes residual toner on the surface of the photoconductor 101 and facing the surface of the photoconductor 101. A minus voltage is applied to the cleaning blade 122 by a blade power source 129.

The cleaning brush 123 corresponds to a brush roller that rotates in a direction indicated by arrow "B" in FIG. 12 about a brush rotary shaft 123*a*, and the brush power source 130 applies voltage to the brush rotary shaft 123*a*.

Figure 13:
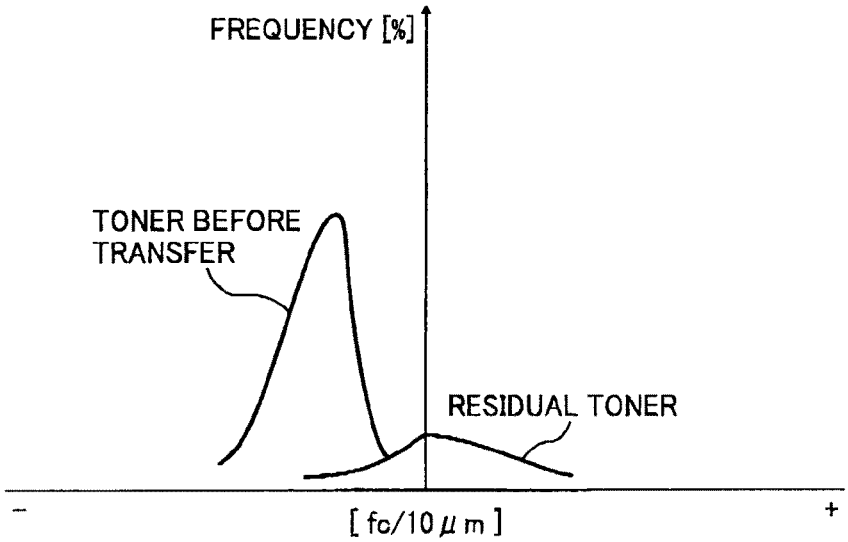
FIG. 13 is a graph showing distributions of charge potential of toner on a photoconductor included in the copier of FIG. 12 before and after a transfer operation.

Referring to FIG. 13, charge amounts of toner that adheres as residual toner to the surface of the photoconductor 101 and reaches a position facing the cleaning unit 120 are described.

FIG. 13 is a graph showing a distribution of charge potentials of toner on the surface of the photoconductor 101 immediately before a transfer operation and a distribution of charge potentials of residual toner remaining on the surface of the photoconductor 101 after the transfer operation.

As shown in the graph of FIG. 13, the toner immediately before the transfer operation is charged substantially to a minus polarity. At the transfer operation, the toner previously charged to a plus polarity before the transfer operation stays on the surface of the photoconductor 101. In addition, some amount of the toner charged to the minus polarity before the transfer operation may be inverted to the plus polarity by the charge injection applied to the transfer roller 115. Accordingly, the residual toner on the surface of the photoconductor 101 after the transfer operation shows a distribution mixed with the toner charged to the plus polarity and the toner charged to the minus polarity, as shown in FIG. 13.

Along with the movement of surface of the photoconductor 101, the residual toner thereon passes the position facing the transfer roller 115 and reaches a position facing the cleaning blade 122.

Figure 14:
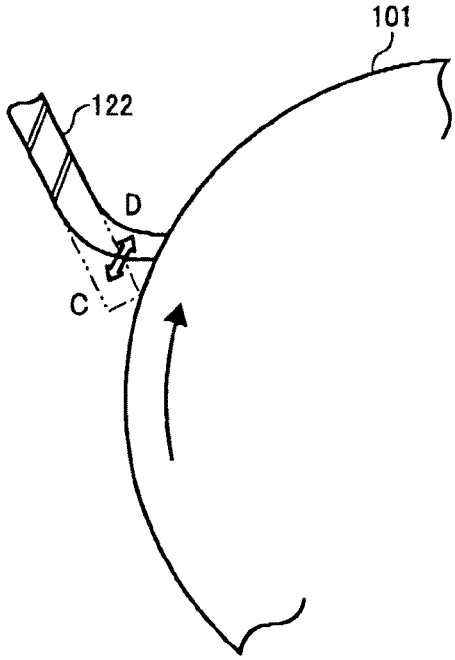
FIG. 14 is a drawing of a cleaning blade, which is included in the copier of FIG. 12, in contact with the photoconductor in rotation.

FIG. 14 illustrates the cleaning blade 122 with the photoconductor 101 in rotation.

When the residual toner on the surface of the photoconductor 101 reaches the position facing the cleaning blade 122, the cleaning blade 122 mechanically removes or scrapes a great amount of the residual toner. However, a stick slip motion may be generated to the cleaning blade 122 while the cleaning blade 122 cleans the surface of the photoconductor 101 as shown in FIG. 14. Specifically, a leading edge of the cleaning blade 122 contacts the photoconductor 101 and moves reciprocally between directions "C" and "D", which is the stick slip motion. As a result, some amount of the residual toner may slip through the position between the photoconductor 101 and the cleaning blade 122.

A voltage having the minus polarity, which is same as the toner charge polarity, may be applied to the cleaning blade 122, and the toner may be charged when the residual toner passes or slips through the position between the cleaning blade 122 and the photoconductor 101. That is, when the toner slips through the position between the cleaning blade 122 and the photoconductor 101, the cleaning blade 122 may be charged to a regular toner charge polarity, which is the minus polarity.

The toner charged to the regular charge polarity by the cleaning blade 122 is conveyed to a position at which the cleaning brush 123 removes the toner from the surface of the photoconductor 101 according to the movement of the surface of the photoconductor 101. As shown in FIG. 13, a voltage having the plus polarity, which is a reverse polarity to the toner charge polarity, is applied to the cleaning brush 123, so that the toner slipped through the position between the cleaning blade 122 and the photoconductor 101 can be electrostatically attracted to the cleaning blade 123.

The toner attracted to the cleaning brush 123 is moved by potential gradient to the toner collection roller 124 to which a voltage of the plus polarity that is greater than the cleaning brush 123 is applied by a toner collection power source 128 (see FIG. 12) The toner moved to the toner collection roller 124 is scraped by a toner collection roller cleaning blade, and is discharged outside the cleaning unit 120 by the toner exhausting screw 119 or is returned into the developing unit 106.

Next, a detailed description is given of a change of the charge polarity of toner passing through the conductive cleaning blade 122 to which a voltage having the same polarity as toner (the minus polarity) is applied.

An electrical resistance of the cleaning blade 122 ranges from $10^6$ Ω·cm to $10^8$ Ω·cm, and a line pressure of the contact position between the cleaning blade 122 and the photoconductor 101 ranges from 20 g/cm to 40 g/cm to contact in a counter manner.

When a voltage is not applied to the cleaning blade 122, the toner passing through the position facing the photoconductor 101 is frictionally charged by a pressure generated at the position between the cleaning blade 122 and the photoconductor 101. In response to this action, the distribution of charge potentials of the toner shifts to the regular toner charge polarity or the minus polarity.

Figure 15:
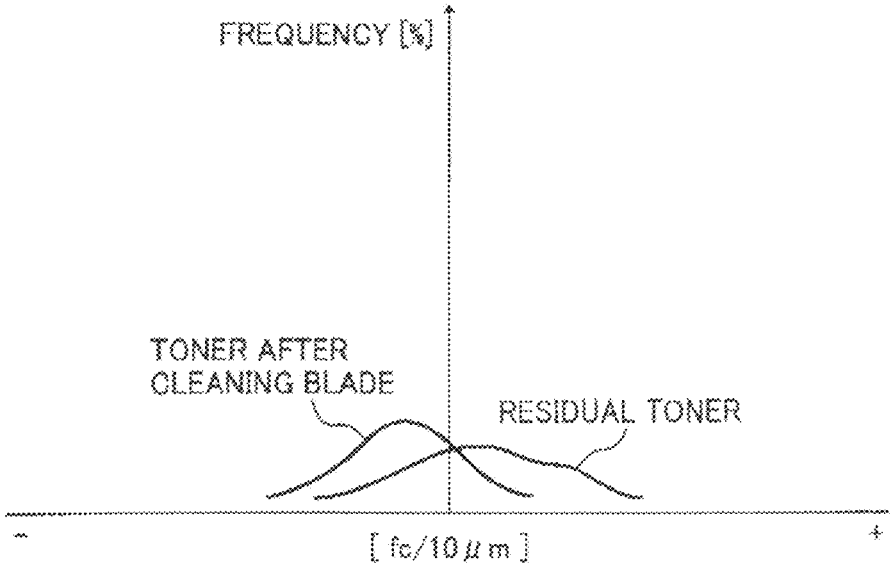
FIG. 15 is a graph showing a distribution of charge potential of toner on the photoconductor after the transfer operation and a distribution thereof after passing the cleaning blade.

FIG. 15 is a graph showing a distribution of charge potentials of residual toner remaining on the surface of the photoconductor 101 after the transfer operation and a distribution of charge potentials of the residual toner after passing through the contact position between the cleaning blade 122 and the photoconductor 101.

As shown in FIG. 15, after passing through the position facing the cleaning blade 122, the toner is charged slightly to the minus polarity and shifts to the regular charge polarity. However, the distribution of the charge potentials of the toner after passing the cleaning blade 122 includes both of the toner charged to the plus polarity and the toner charged to the minus polarity. Since the distribution of charge amounts of the residual toner has a broad peak in the center, not all the toner after the transfer operation is charged to the regular charge polarity. Therefore, to cause the overall residual toner to have the regular charge polarity, a different method or process other than friction charge may be needed.

Further, the cleaning blade 122 can cause the stick slip motion to change the contact status in the direction of rotation of the photoconductor 101. When the leading edge of the cleaning blade 122 moves from a stick status indicated by "D" in FIG. 14 to a slip status indicated by "C" in FIG. 14, toner may slip through the position between the photoconductor 101 and the cleaning blade 122.

As shown in FIG. 12, a minus voltage that is applied to the cleaning blade 122 flows to the toner when the toner is sandwiched between the cleaning blade 122 and the photoconductor 101. The toner is charged to the same polarity as the applied voltage and passes the cleaning blade 122. Further, due to electrical discharge caused in a small gap between an inlet and an outlet of a wedged part formed between the photoconductor 101 and the cleaning blade 122, the toner is charged to the same polarity as the applied voltage.

The toner charged to the same polarity and passed the cleaning blade 122 is removed electrostatically by the cleaning brush 123 to which a voltage having an opposite polarity (the plus polarity) to the toner charge polarity.

Here, a description is given of a known blade-type cleaning in which a surface of a photoconductor is cleaned while a cleaning blade is contacting the surface of the photoconductor.

Image forming apparatuses are constantly required to form an image with higher precision and higher definition. As one of the solutions to achieve the demand, a known image forming apparatus uses toner having a small particle diameter. Further, to increase transferability, a toner particle has been changed to have a more spherical shape from an irregular shape. However, the toner having a small diameter or a spherical shape can easily slip or fall from a gap formed between the cleaning blade and the photoconductor because of the size and shape and can result in poor cleaning performance. Therefore, it is difficult to achieve good cleaning performance with the blade-type cleaning.

The blade-type cleaning may work well to remove spherical toner particles when an extremely high line pressure (specifically, line pressure: 100 gf/cm or greater) is used to press the cleaning blade to the surface of the photoconductor. However, the lives of the photoconductor drum and the cleaning blade may be extremely short. For example, with a normal line pressure (20 gf/cm), the life of the photoconductor 101 (the life when the photoconductive layer of the photoconductor 101 is damaged by scraping ⅓ of the photoconductive layer) lasts approximately 100,000 copies with a diameter of approximately 30 mm, the life of the cleaning blade (when the cleaning blade is damaged by scraping and the cleaning performance becomes poor) lasts approximately 120,000 copies. By contrast, when a line pressure is high (100 gf/cm), the life of the photoconductor 101 lasts approximately 20,000 copies and the life of the cleaning blade 122 lasts approximately 20,000 copies.

However, image quality can be enhanced with toner having a small particle diameter and a spherical shape. Therefore, the second embodiment employs an electrostatic brush-type cleaning that is a cleaning method providing good cleaning performance even when cleaning such toner with small particle diameter or spherical shape and reducing mechanical slidable contact that can reduce damage to film on the surface of the photoconductor 101. Further, a cleaner-less method can achieve the same effect.

Example 1

[Test 1]

In the second embodiment, an adhesion force of one toner particle to a sample surface was measured in the pulsed force mode that was explained in the first embodiment. Specifically, while scanning the surface of the sample in a range of from 0.1 Hz to 10 Hz using the pulsed force mode or adhesion mode called by SII Nano Technology Inc., a sample table with the sample thereon was vibrated in a vertical direction at 100 Hz to 1,000 Hz. The above-described action caused one toner particle attached to the tip of the cantilever to contact with and separate from the surface of the sample continuously, and an adhesion force of one toner particle to the surface of the sample was measured.

Figure 16:
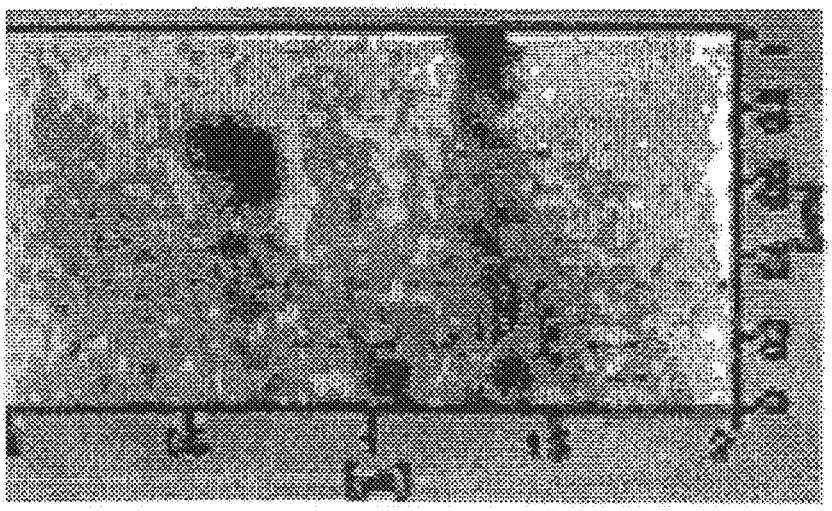
FIG. 16 is image data of the adhesion forces obtained in Test 1.
Figure 17:
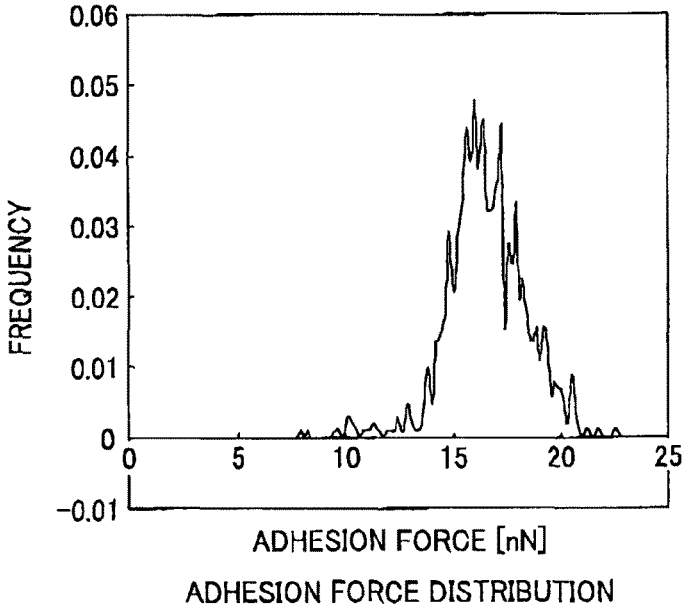
FIG. 17 is a graph showing a distribution of the adhesion forces based on the image data of FIG. 16.

Further, by measuring adhesion forces according to the above-described method, images of the adhesion forces shown in FIG. 16 were obtained. Then, dedicated software was used to gain a frequency distribution as shown in FIG. 17 based on the images of adhesion forces. (When the adhesion mode of SII Nano Technology Inc. is used, error signal images are used.) For example, Scanning Probe Image Processor or SPIO manufactured by Image Metrology A/S can operate this processing. Data volume of the frequency distribution depends on a condition of acquisition of the adhesion force images. According to this acquisition condition, the distribution includes 128×128=16,384 points.

In the second embodiment, the inventors employed three different types of photoconductors used under different conditions as described below, which are photoconductors 101 under Conditions A, B, and C. In evaluation, each surface layer of the photoconductors 101 is separated from each base body and cut into a piece of approximately 10 millimeters square. Then, an adhesion force of one toner particle to the surface layer was measured by an atomic force microscope or AFM.

The following are parameters and conditions of Test 1.

Measurement condition (pulsed force mode):

AFM: Scanning Probe Microscope SPI4000 and Multiple Function Unit SPA400 (manufactured by SII Nano Technology Inc.), Measurement mode: Adhesion mode, Cantilever: Standard-type silicon cantilever OMCL-RC800PSA (manufactured by Olympus Corporation), Spring constant: 0.76 [N/m], Measurement Area: 1 μm×1 μm square, Lines: 128 lines in vertical direction and 128 lines in horizontal direction, Measuring Scan Frequency: 1 [Hz], Z Frequency (Adhesion Frequency): 1 [kHz], Maximum Loading Conditions: Target pushing force of 50 [nN] of the tip of the cantilever onto the surface of a sample (set according to cantilever bending and adhesion amplitude), Toner Particle Diameter of Tip of Cantilever: 7.2 [μm], and Toner Type: Black toner used for imagio MP C3000 (manufactured by Ricoh Company Ltd.).

Test piece photoconductors having the following conditions were used as target objects for evaluation:

Condition A: Unused,

Condition B: Applied lubricant (zinc stearate) by test apparatus, and

Condition C: Applied lubricant (zinc stearate) by test apparatus, then applied a charge voltage by the test apparatus.

Figure 18:
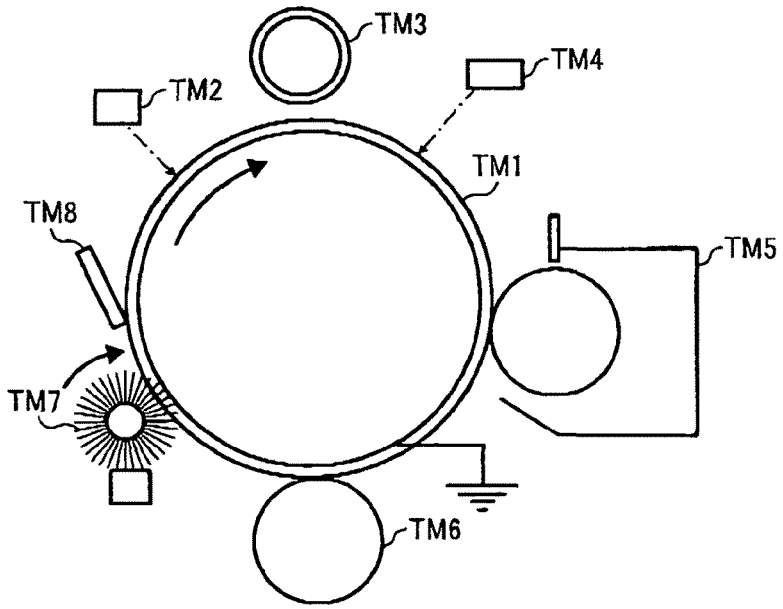
FIG. 18 is a schematic structure of a test machine used in Test 1.

The test piece photoconductor under condition B was applied with lubricant including zinc stearate by a test machine such as an apparatus shown in FIG. 18.

The test machine of FIG. 18 includes a photoconductor TM1, a discharging roller TM2, a charge roller TM3, an optical writing unit TM4, a developing unit TM5, a transfer member TM6, a cleaning brush TM7, and a cleaning blade TM8. Elements or components shown in FIG. 18 may have the same functions as those in the copier 100 of FIG. 12 and the descriptions thereof are omitted here.

The test was conducted under the following conditions:

Period of Application: 5 minutes,

Over-cut distance of lubricant application brush to photoconductor: 1 mm,

Lubricant Regulating Blade: Urethane blade, Hardness of 70 [degree], and

Linear Velocity of Photoconductor: 125 [mm/s].

Figure 19:
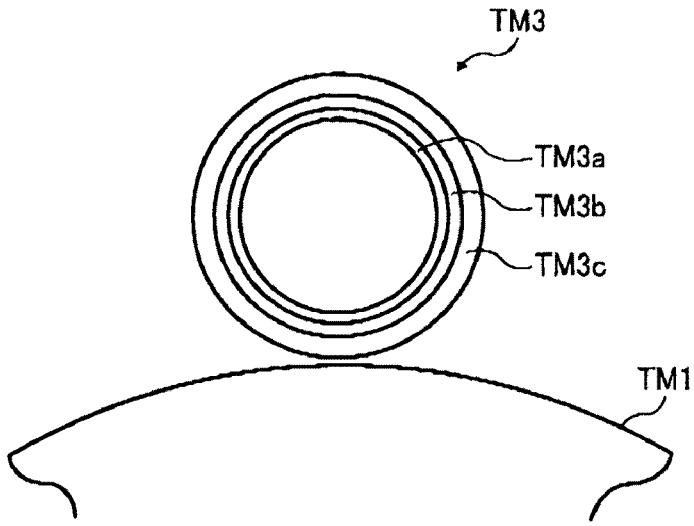
FIG. 19 is a drawing of a charge roller included in the test machine of FIG. 18.
Figure 20:
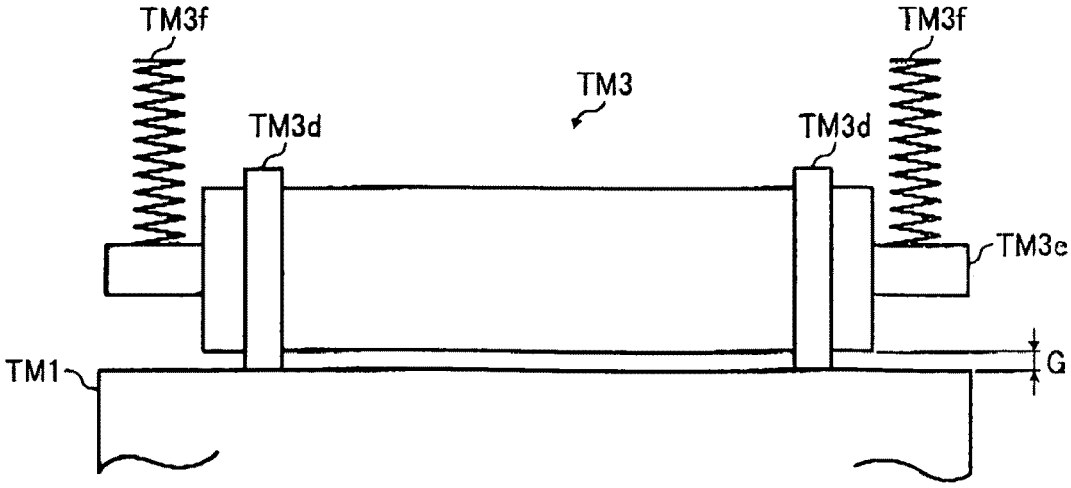
FIG. 20 is a drawing of a non-contact type charge roller.

The test piece photoconductor under condition C was applied with lubricant including zinc stearate by a modified IPSIO color 8000 (manufactured by Ricoh Company Ltd.), and then applied with a charge voltage by the test machine under the following conditions:

Period of Application: 5 minutes,

Over-cut distance of lubricant application brush to photoconductor: 1 mm,

Lubricant Regulating Blade: Urethane blade, JIS-A Hardness of 70 [degree],

Linear Velocity of Photoconductor: 125 [mm/s],

Charging Unit: Charge roller having a rigid outer surface and disposed facing the photoconductor in a non-contact manner (FIG. 19 is a cross sectional view of the charging roller TM3, which includes a conductive core TM3*a*, a mid-resistivity layer TM3*b* that is fixedly disposed around an outer surface of the conductive core TM3*a*, and a surface layer TM3*c* arranged around the mid-resistivity layer TM3*b*.), Support of Gap between Photoconductor and Charge Roller: As shown in FIG. 20, each spacer TM3*d* disposed in a longitudinal direction of the charge roller TM3 is held in contact with a non-image forming area of the photoconductor TM1 so as to form a gap G. Further, by pressing a shaft TM3*e* of the charging roller TM3 using a pressure spring TM3*f* at each end of the shaft TM3*e*, maintenance accuracy of the gap G can be enhanced. Further, an insulating, heat-shrinkable tube was employed as the spacer TM3*d*.

Application Bias to Charging Roller: AC element of Vpp 3.0 [kV], Frequency of 1.35 [kHz], and DC element of −600 [V], Voltage Application Period: 10 seconds.

Figure 21:
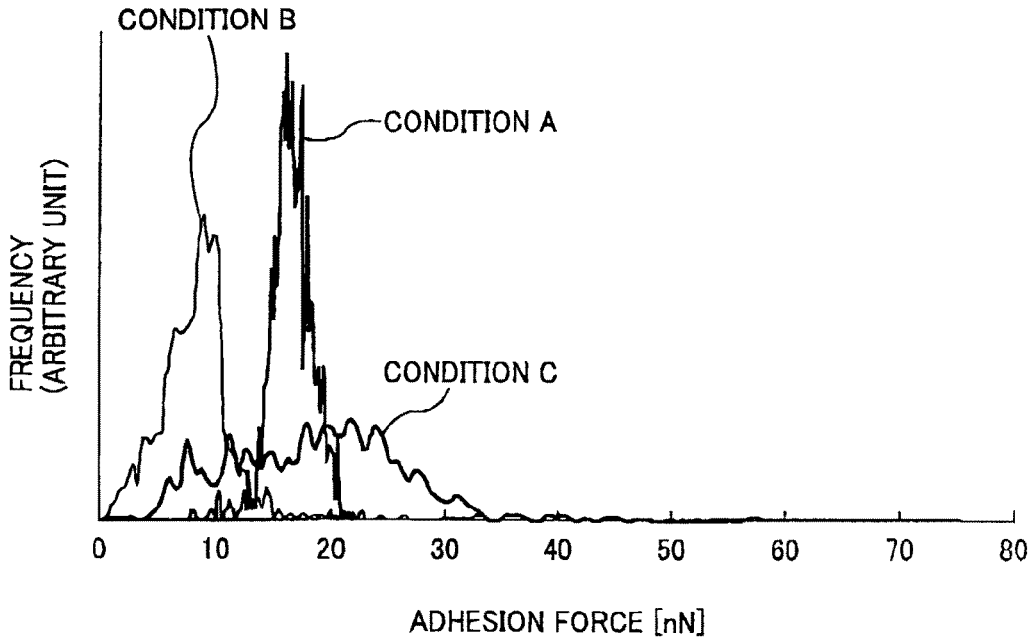
FIG. 21 is a graph showing distributions of adhesion forces obtained under different conditions.

FIG. 21 is a graph showing distribution of adhesion forces obtained by the points of 128×128 adhesion force measurements of the photoconductors 101 under Conditions A, B, and C.

[Test 2]

The inventors attached the photoconductors 101 used under Conditions A, B, and C to the copier 100 shown in FIG. 12 to output images.

The following show parameters and conditions for image output operation in Test 2;

Output paper size and volume: A4L, 100 sheets,

Experimental environment: Temperature 27° C., Humidity 55%, and

Output image: Chart with 5% coverage of image area.

After the image output operation was conducted under the above-described test conditions and image output conditions, the inventors found that the photoconductor 101 used under Conditions A and B contributed to a production of 100 normal images without causing poor cleaning performance. On the other hand, the photoconductor 101 used under Condition C output defect images with streaks thereon due to the poor cleaning performance.

[Evaluation 1]

Based on results of various researches, reports, etc., the inventors have found that, when 95% or greater of the measurements of adhesion forces exist within a range up to an adhesion force 1.5 times the mean value of the measured adhesion forces, the dispersion of the measured adhesion forces greater than the mean value thereof may fall in given classes within a certain range in the frequency distribution of the measured adhesion forces, and therefore the adhesion forces can be substantially equal at any point on the surface of the photoconductor 101. Accordingly, the inventors focused on the above-described result to perform the evaluation in Evaluation 1.

The adhesion force 1.5 times the mean value of the adhesion forces of toner to each photoconductor 101 under Conditions A, B, and C described below is an adhesion force of toner removable from the surface of the photoconductor 101 by the cleaning blade 122. That is, the cleaning blade 122 can smoothly remove toner with the adhesion force 1.5 times the mean value of the adhesion forces of toner to each photoconductor 101 under Conditions A, B, and C.

Table 2 shows measurements in Test 1 and Test 2 with respect to the photoconductor 101 used under Conditions A, B, and C.

TABLE 2

| | Cleaning performance | Mean value of adhesion forces [nN] | Mean value of adhesion forces × 1.5 [nN] | Existing probability [%] equal to or less than mean value of adhesion forces × 1.5 [nN] |
|---|---|---|---|---|
| Condition A | No defect | 16.6 | 25.4 | 100 |
| Condition B | No defect | 8.2 | 12.3 | 95 |
| Condition C | Defected | 18.7 | 28.1 | 92 |

According to the measurements shown in Table 2, the mean values of the adhesion forces of toner to the photoconductor 101 under Conditions A, B, and C were 16.6 nN, 8.2 nN, and 18.7 nN, respectively.

Approximately 100% of the measurements of the adhesion forces of toner to the photoconductor 101 used under Condition A exist at or below 25.4 nN that is an adhesion force 1.5 times the mean value of the adhesion forces to the photoconductor 101 under Condition A. That is, 95% or greater of the measurements of the adhesion forces of toner to the photoconductor 101 under Condition A exist within a range up to an adhesion force 1.5 times the mean value of the adhesion forces of toner thereto.

Approximately 95% of the measurements of the adhesion forces of toner to the photoconductor 101 used under Condition B exist at or below 12.3 nN that is a value 1.5 times the mean value of the adhesion forces to the photoconductor 101 under Condition B. That is, 95% or greater of the measurements of the adhesion forces of toner to the photoconductor 101 under Condition B exist within a range up to an adhesion forces 1.5 times the mean value of the adhesion forces of toner thereto.

As described above, when the photoconductors 101 used under Conditions A and B are used, approximately 95% or greater of the measurements of the adhesion forces of toner thereto exist within a range up to the adhesion force 1.5 times the mean value of the measured adhesion forces. Therefore, the dispersion of the measured adhesion forces greater than the mean value thereof may fall in given classes within a certain range in the frequency distribution of the measured adhesion forces, and therefore the adhesion forces can be substantially equal at any point on the respective surfaces of the photoconductors 101. As a result, it seemed that the cleaning performance was stable at any point on the surface of the photoconductors 101 under Conditions A and B. Therefore, it is contemplated that, when the images were output, the poor cleaning performance as shown in the results of Test 2 did not occur and the output images did not include defect images with streaks.

By contrast, approximately 92% of the measurements of the adhesion forces of toner to the photoconductor 101 used under Condition C exist at or below 28.1 nN that is an adhesion force 1.5 times the mean value of the adhesion forces. That is, 95% or greater of the measurements of the adhesion forces of toner to the photoconductor 101 under Condition C do not exist within a range up to an adhesion force 1.5 times the mean value of the adhesion forces.

When the photoconductor 101 under Condition C is employed, approximately 95% of the measurements of the adhesion forces of toner thereto do not exist at or below 28.1 nN that is an adhesion force 1.5 times as much as the mean value of the adhesion forces. Therefore, the dispersion of the measured adhesion forces greater than the mean value thereof may fall in given classes within a certain range in the frequency distribution of the measured adhesion forces, and therefore the adhesion forces can be significantly different at various points on the surface of the photoconductor 101 under Condition C. It is contemplated that the cleaning operation cannot be performed stably at some points on the surface of the photoconductor 101 under Condition C. It is therefore contemplated that defect images with streaks were output due to the poor cleaning performance on the surface of the photoconductor 101, which is similar to the results of Test 2.

[Evaluation 2]

Based on results of various researches, reports, etc., the inventors have found that, when the following Expression 2 is satisfied where a mean value of adhesion forces is indicated by "X" and a standard deviation is indicated by "Y" in the measurements of adhesion forces, the dispersion of the measured adhesion forces to the mean value of the adhesion forces can fall in given classes within a certain range in the frequency distribution of the measured adhesion forces, and therefore the adhesion forces can be substantially equal at any point on the surface of the photoconductor 101. Accordingly, the inventors focused on the above-described result to perform the evaluation of cleaning performance in Evaluation 2.

$$X/2Y>1.3 \quad \text{Expression 2}$$

Table 3 shows measurements in Test 1 and Test 2 with respect to the photoconductor 101 used under Conditions A, B, and C.

TABLE 3

| | Cleaning performance | Mean value of adhesion forces (X) [nN] | Standard deviation (Y) [nN] | X/2Y |
|---|---|---|---|---|
| Condition A | No defect | 16.6 | 1.8 | 4.6 |
| Condition B | No defect | 8.2 | 3.0 | 1.4 |
| Condition C | Defected | 18.7 | 7.4 | 1.3 |

According to the measurements shown in Table 3, the mean value of the adhesion forces of toner to the photoconductor 101 under Conditions A, B, and C were 16.6 nN, 8.2 nN, and 18.7 nN, respectively.

Further, the standard deviations of the adhesion forces of toner to the photoconductor 101 under Conditions A, B, and C were 1.8 nN, 3.0 nN, and 7.4 nN, respectively.

The following Expression 3 shows a result obtained by assigning the mean value of the adhesion forces "X" and the standard deviation "Y" of the photoconductor 101 under Condition A to Expression 2, which is also shown in Table 3:

$$X/2Y=4.6 \quad \text{Expression 3.}$$

The following Expression 4 shows a result obtained by assigning the mean value of the adhesion forces "X" and the standard deviation "Y" of the photoconductor 101 under Condition B to Expression 2, which is also shown in Table 3:

$$X/2Y=1.4 \quad \text{Expression 4.}$$

The following Expression 5 shows a result obtained by assigning the mean value of the adhesion forces "X" and the standard deviation "Y" of the photoconductor 101 under Condition C to Expression 2, which is also shown in Table 3:

$$X/2Y=1.3 \quad \text{Expression 5.}$$

According to the results obtained by Expressions 3 and 4, the photoconductors 101 used under Conditions A and B satisfy the relation of Expression 2. Therefore, as described above, the dispersion of the adhesion forces with respect to the mean value of the adhesion forces can fall in given classes within a certain range in the frequency distribution of the measured adhesion forces, and therefore the adhesion forces can be substantially equal at any point on the surface of the photoconductors 101. It is contemplated that a stable cleaning operation was performed at any point on the surface thereof. It is therefore contemplated that the cleaning performance was not poor as shown the results of Test 2 and defect images with streaks were not output.

According to the result obtained by Expression 5, the photoconductor 101 used under Condition C does not satisfy the relation of Expression 2. Since the dispersion of the adhesion forces with respect to the mean value of the adhesion forces cannot fall in the given classes within a certain range in the frequency distribution of the measured adhesion forces, the adhesion forces may be significantly different at various points on the surface of the photoconductor 101. It is contemplated that the cleaning performance was not stably performed at some points on the surface of the photoconductor 101. It is therefore contemplated that the cleaning performance was poor similarly to the results of Test 2, and therefore defect images with streaks were output due to the poor cleaning performance.

According to the descriptions above, it is clear that evaluating frequency of toner adhesion generated between the photoconductor and the toner with the standard deviation in addition to the mean value of the adhesion forces can determine the frequency of toner adhesion based on more natural phenomenon. That is, most abnormal phenomena related to the frequency of power adhesion in an image forming apparatus, a blowing apparatus, a power conveying apparatus, and the like do not occur in all over a surface of a member. In other words, abnormal phenomena occur in an area or region that has an extremely large or small adhesion force. Therefore, abnormal phenomena cannot be detected sensitively only with a characteristic value at one point or an average value within an area. Not an evaluation with the characteristic value at one point on the surface of a member but an evaluation with a distribution of adhesion forces of toner on a given area of a surface of a member using the average value and standard deviation of the distribution may be more based on natural phenomenon of adhesion.

Example 2

These methods of evaluation and determination can be applied to a member other than the member to which power directly adheres. For example, the member can be a cleaning blade included in a cleaning unit of an image forming apparatus. When the cleaning unit performs cleaning operations to the surface of the photoconductor, the cleaning blade may be used to clean the photoconductor by, for example, scraping residual toner remaining on the surface of the photoconductor.

For the cleaning blade to effectively perform the cleaning operations, it is important that the cleaning blade is stably held in contact with the surface of the photoconductor in rotation without being curled. When the cleaning blade that abuts against the surface of the photoconductor is curled, toner can slip between the surface of the photoconductor and the cleaning blade at the curled portion, and as a result, residual toner remaining on the surface of the photoconductor cannot be removed.

Figure 22:
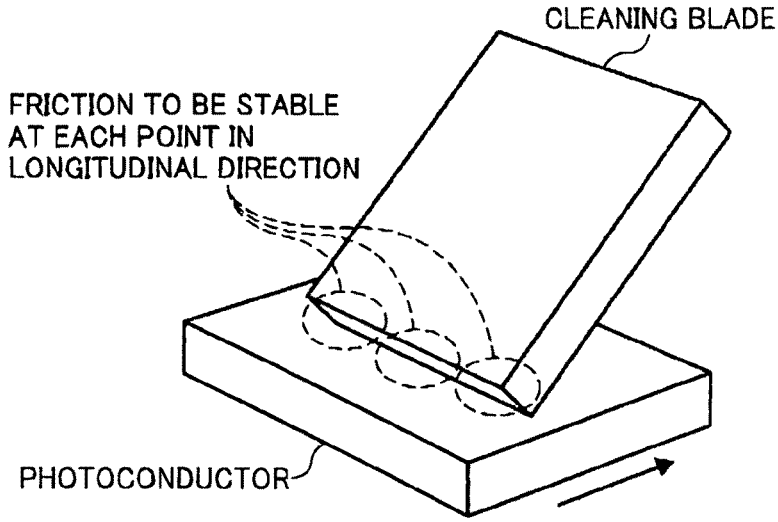
FIG. 22 is a schematic structure of an area in proximity to a contact portion of the cleaning blade and the photoconductor.

To stably contact the cleaning blade to the surface of the photoconductor, a frictional force or adhesion force generated between the photoconductor and the cleaning blade may need to be low and, at the same time, be equal in a longitudinal direction of a contact portion of the surface of the photoconductor and the cleaning blade as shown in FIG. 22.

In Example 2, according to the above-described mechanisms, the inventors evaluated multiple cleaning blades having different cleaning performances with methods or modes described in tests and evaluations below.

There are two important things in such evaluation.

For one thing, an adhesion force that is generated between the surface of the photoconductor and the toner has a correlation with a frictional force that is generated between the surface of the photoconductor and the cleaning blade. That is, the modes used in Example 2 does not directly measure the frictional force that is generated between the surface of the photoconductor and the cleaning blade and has an affect on the original mechanism, but both the photoconductor and the toner are same to include resin material. Therefore, amount of the frictional force between the surface of the photoconductor and the cleaning blade in relation to the adhesion force between the surface of the photoconductor and the toner particle may not change.

For the other thing, the modes used in Example Embodiment 2 can project uniformity of the frictional force between the surface of the photoconductor and the cleaning blade according to the scale of toner. The frictional force between the surface of the photoconductor and the cleaning blade is ideally small at any point in the longitudinal direction of the contact portion of the surface of the photoconductor and the cleaning blade. Even when the frictional force between the surface of the photoconductor and the cleaning blade is locally high, the cleaning blade may curl at the point and the toner particles can slip from the curled portion of the cleaning blade, and therefore appropriate cleaning cannot be performed. Therefore, it is significantly useful to employ the modes used in Example Embodiment 2 can estimate the uniformity of the frictional force between the surface of the photoconductor and the cleaning blade according to the scale of toner that is originally a target to remove from the surface of the photoconductor by the cleaning blade.

[Test 3]

In Test 3, the inventors used three different types of cleaning blades, which are cleaning blades 1, 2, and 3.

The cleaning blade 1 was prepared for Test 3 by modifying a cleaning blade used for IPSIO Color 8000 (manufactured by RICOH CO., LTD.) to fit for imagio Neo C600 (manufactured by RICOH CO., LTD.). The cleaning blade 2 was prepared for Test 3 by modifying a cleaning blade used for imagio NEO C325 (manufactured by RICOH CO., LTD.) to fit for imagio Neo C600. The cleaning blade 3 includes a PVDF layer with a thickness of 0.5 mm on a surface of the cleaning blade 1.

The cleaning blades 1, 2, and 3 were cut by a distance of 1 mm from the tip or the leading edge of each of the cleaning blades 1, 2, and 3. The pieces cut from the cleaning blades 1, 2, and 3 were measured as a target surface that contacts a cleaning target by using an AFM.

The following show parameters and conditions of Test 3:

Measurement condition (force curve mode):

AFM: Scanning Probe Microscope SPI4000 and Multiple Function Unit SPA400 (manufactured by SII Nano Technology Inc.), Measurement mode: AFM mode, Cantilever: Standard-type silicon cantilever OMCL-RC800PSA (manufactured by Olympus Corporation), Spring constant: 0.76 N/m, Measurement Points: 100 points: 10 points in vertical direction and 10 points in horizontal direction at intervals of 200 nm, Maximum Loading Conditions: Target pushing force of 50 nN of the tip of the cantilever onto the surface of a sample, Toner Particle Diameter at Tip of Cantilever: 4.1 μm, and Toner Type: Trial model PxP toner (manufactured by Ricoh Company Ltd.).

The inventors measured the adhesion force between the toner and a given silicon substrate used here and found that the adhesion force was 20.5 nN. The silicon substrate was stored in a desiccator or the like with humidity of 50% or less.

Figure 23:
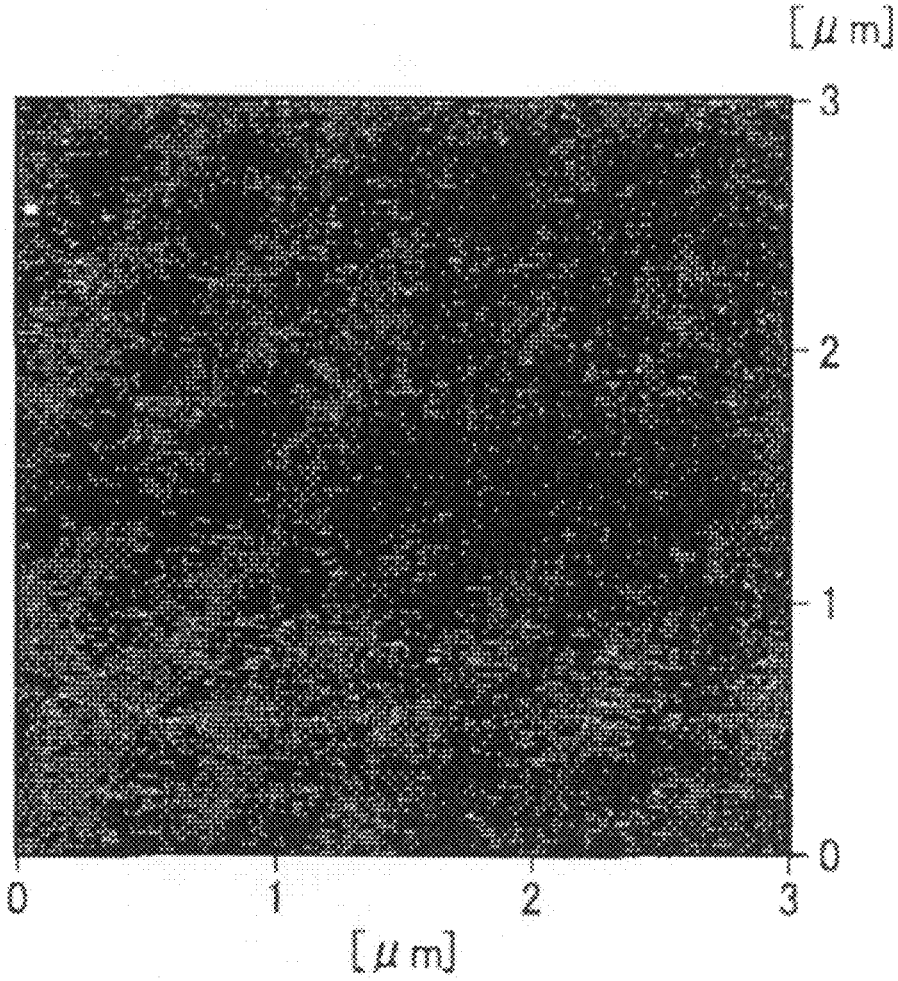
FIG. 23 is image data indicating a surface roughness Ra of a silicon substrate used in Test 3.

Further, before the measurement of adhesion forces generated between the toner particle and the silicon substrate, the inventors used the AFM to confirm that a mean value of surface roughnesses Ra of the silicon substrate was 0.19 nm as shown in FIG. 23, which was smaller than 1 nm. With the silicon substrate with the surface roughness Ra of smaller than 1 nm, the measurement of adhesion force generated between the toner particle and the silicon substrate can be more accurate.

As described above, the measurements of the adhesion force generated between the toner particle and the silicon substrate are used to evaluate a distribution of the adhesion force generated between the toner and the cleaning blade, which is described below.

In Test 3, all adhesion forces were measured with the same probe attached with same toner particles.

Figure 24:
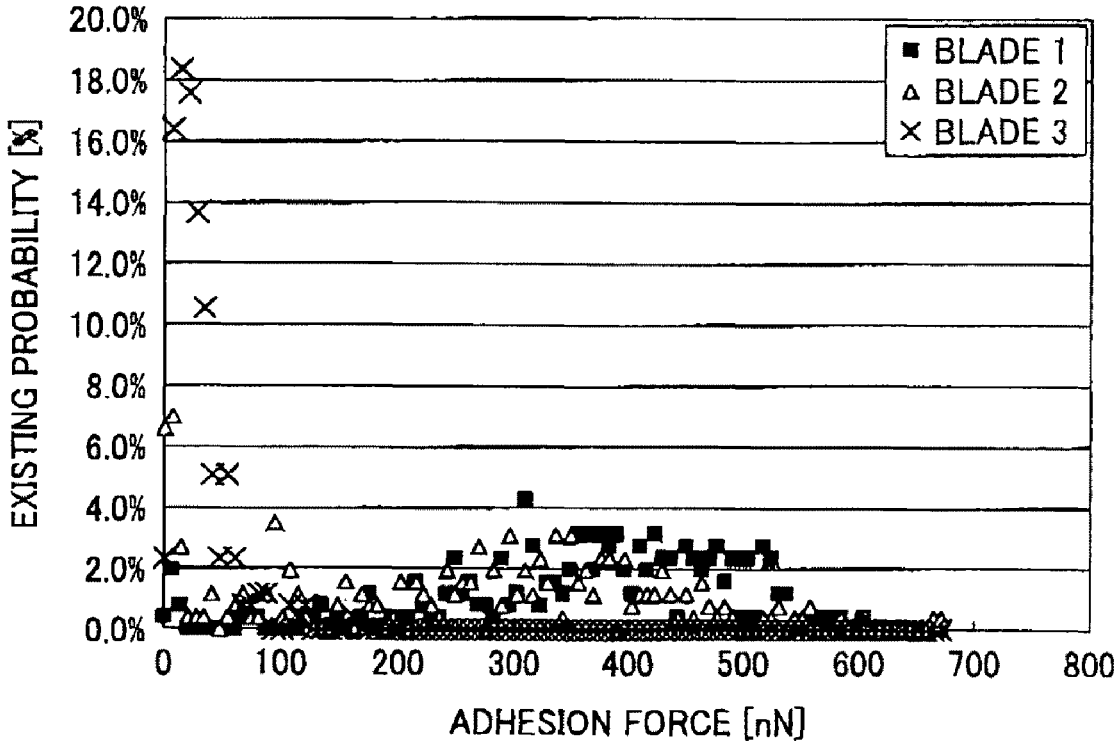
FIG. 24 is a graph showing distributions of adhesion forces of toner to sample cleaning blades.

FIG. 24 is a graph showing distributions of adhesion forces obtained adhesion force measurements of the cleaning blades 1, 2, and 3 in a square area of 10 points×10 points.

[Test 4]

The inventors attached the cleaning blades 1, 2, and 3 to imagio Neo C600 to output images.

The test condition is as follows:

Toner Type: Trial model PxP toner (manufactured by Ricoh Company Ltd.).

The following show parameters and conditions for image output operation in Test 4.

Copier: imagio Neo C600 (manufactured by Ricoh Company Ltd.),

Output paper size and volume: A4L, 100,000 sheets,

Experimental environment: Temperature 23° C., Humidity 55%, and

Output image: Chart with 5% coverage of image area.

After the image output operation was conducted under the above-described test conditions and image output conditions, the inventors found that the cleaning blades 1 and 2 output defect images with streaks thereon due to poor cleaning performance. By contrast, the cleaning blade 3 contributed to a production of 100,000 normal images without causing poor cleaning performance.

[Evaluation 3]

Based on results of various researches, reports, etc., the inventors have found that, in the measurements of the adhesion forces of toner to the cleaning blade, the inventors found that, when the following Expression 6 is satisfied where a mean value of adhesion forces is indicated by "X", a standard deviation is indicated by "Y", and an adhesion force generated between the toner and the silicon substrate is indicated by "Z", the dispersion of the measured adhesion forces with respect to the mean value of the adhesion forces can fall in given classes within a certain range in the frequency distribution of the measured adhesion forces, and therefore the adhesion forces can be substantially equal at any point on the surface of the cleaning blade. Accordingly, the inventors focused on the above-described result to perform the evaluation of cleaning performance in Evaluation 3.

$$X<5Z[\text{nN}],\ Y<5Z[\text{nN}] \qquad \text{Expression 6.}$$

The measured adhesion forces of toner to the silicon substrate is normalized to eliminate differences of the adhesion forces among different types of toners at the tip of the probe so as to evaluate constantly under the identical condition.

According to the adhesion forces measured in Test 4, the mean value of the adhesion forces "X" of toner to the cleaning blades 1, 2, and 3 were 370.7 nN, 250.4 nN, and 31.6 nN, respectively.

Further, the standard deviations "Y" of the adhesion forces of toner to the cleaning blades 1, 2, and 3 were 121.0 nN, 161.5 nN, and 23.1 nN, respectively.

Further, as described above, the adhesion force "Z" generated between the toner and the silicon substrate was 20.5 nN. Since Test 4 was conducted with the identical probe having the identical toner attached was used with respect to the cleaning blades 1, 2, and 3 as described above, the adhesion force "Z" was the same value (20.5 nN in this case), with respect to each of the cleaning blades 1, 2, and 3.

The following Expression 7 shows a result obtained by assigning the mean value of the adhesion forces "X" and the standard deviation "Y" of the cleaning blade 1, and the adhesion force "Z" between the toner particle and the silicon substrate to Expression 6:

$$X=370.7>102.5=5Z,\ Y=121.0>102.5=5Z \qquad \text{Expression 7.}$$

Further, the following Expression 8 shows a result obtained by assigning the mean value of the adhesion forces "X" and the standard deviation "Y" of the cleaning blade 2, and the adhesion force "Z" between the toner particle and the silicon substrate to Expression 6:

$$X=250.4>102.5=5Z,\ Y=161.5>102.5=5Z \qquad \text{Expression 8.}$$

Further, the following Expression 9 shows a result obtained by assigning the mean value of the adhesion forces "X" and the standard deviation "Y" of the cleaning blade 3, and the adhesion force "Z" between the toner particle and the silicon substrate to Expression 6:

$$X=31.6>102.5=5Z,\ Y=23.1>102.5=5Z \qquad \text{Expression 9.}$$

Table 4 shows the above-described mean values of respective adhesion forces, the standard deviations, and measurements of the cleaning blades 1, 2, and 3.

TABLE 4

| | Mean value of adhesion forces (X) [nN] | Standard deviation (Y) [nN] | 5Z [nN] | Condition of output image |
|---|---|---|---|---|
| Blade 1 | 370.7 | 121.0 | 102.5 | Defected |
| Blade 2 | 250.4 | 161.5 | 102.5 | Defected |
| Blade 3 | 31.6 | 23.1 | 102.5 | No defect |

According to the results shown in Table 4 and obtained by Expression 9, the cleaning blade 3 satisfies the relation of Expression 6. Therefore, as described above, the dispersion of the measured adhesion forces with respect to the mean value of the measured adhesion forces can fall in the given classes within a certain range in the frequency distribution of the measured adhesion forces, and therefore the adhesion forces can be substantially equal at any point on the surface of the cleaning blade 3. It is contemplated that a stable cleaning operation was performed at any point on the surface of the cleaning blade 3. It is therefore contemplated that, even when images were output as conducted in the above-described results of Test 4, the cleaning performance was not so poor to output defect images with streaks.

According to the results shown in Table 4 and obtained by Expressions 7 and 8, the cleaning blades 1 and 2 do not satisfy the relation of Expression 6. Since the dispersion of the adhesion forces to the mean value of the adhesion forces cannot fall in the given classes within a certain range in the frequency distribution of the measured adhesion forces, the adhesion forces may be significantly different at various points on the cleaning blades 1 and 2. It is contemplated that the cleaning operation was not stably performed at some points on the surface of the cleaning blade 1 or 2. It is therefore contemplated that, as the above-described results shown in Table 4, the cleaning performance was poor, and therefore defect images with streaks were output.

Further, according to the above-described results, a cleaning blade with good cleaning performance has an adhesion force lower than a cleaning blade with bad cleaning performance and, at the same time, has a uniform adhesion force distribution on the contact area of the cleaning blade.

According to the descriptions above, it is clear that evaluating a degree or frequency of toner adhesion to the cleaning blade by using the standard deviation and the mean value of the adhesion forces can determine the degree or frequency of toner adhesion based on more natural phenomenon. Specifically, most abnormal phenomena related to the frequency of power adhesion in an image forming apparatus, a blowing apparatus, a power conveying apparatus, and the like do not occur in all over a surface of a member. In other words, abnormal phenomena occur in an area or region that has an extremely large or small adhesion force. Therefore, abnormal phenomena cannot be detected sensitively only with a characteristic value at one point or an average value within an area. Not an evaluation with the characteristic value at one point on the surface of a member but an evaluation with a distribution of adhesion forces of toner on a given area of a surface of a member using the average value and standard deviation of the distribution may be more based on natural phenomenon of adhesion.

Example 3

[Test 5]

In Example 3 of the second embodiment, an adhesion force of one toner particle to a surface of a sample was measured with the above-described pulsed force mode method described in the first embodiment. Specifically, while scanning the surface of the sample in a range of from 0.1 Hz to 10 Hz using the pulsed force mode or adhesion mode called by SII Nano Technology Inc., a sample table with the sample thereon was vibrated in a vertical direction at 100 Hz to 1000 Hz. The above-described action caused one toner particle attached to the tip of the cantilever to contact with and separate from the surface of the sample continuously, and an adhesion force of one toner particle to the surface of the sample was measured.

Figure 25A:
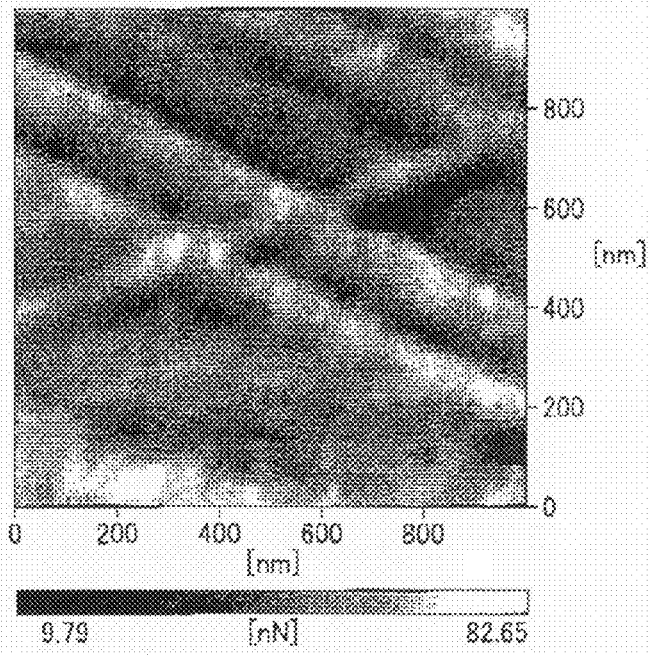
FIG. 25A is image data of measurements of adhesion forces in a scale of nanometer order.
Figure 25B:
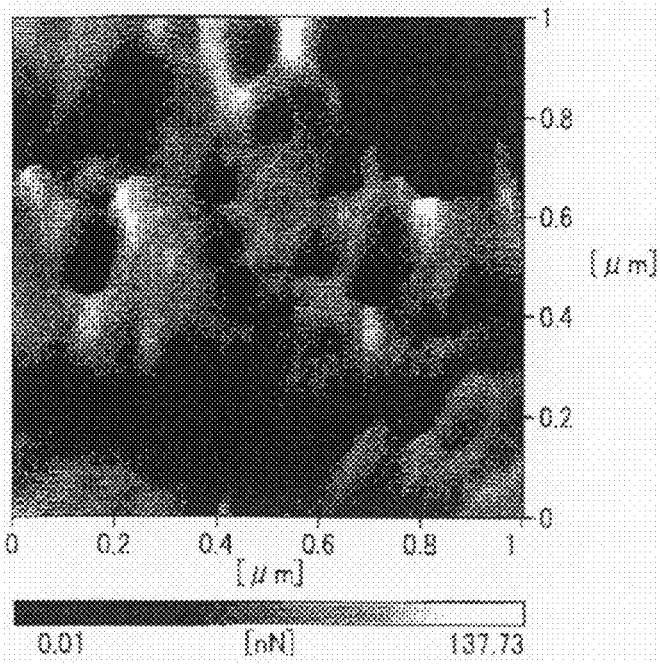
FIG. 25B is image data of measurements of adhesion forces in a scale of micrometer order.

Further, by measuring adhesion forces as above, images of the adhesion forces shown in FIGS. 25A and 25B were obtained. Then, dedicated software was used to gain a frequency distribution based on the images of adhesion forces. (When the adhesion mode of SII Nano Technology Inc. is used, error signal images are used.) For example, Scanning Probe Image Processor or SPIO manufactured by Image Metrology A/S can operate this processing. Data volume of the frequency distribution depends on a condition of acquisition of the adhesion force images. According to this acquisition condition, the distribution includes 128×128=16,384 points.

In Example 3 of the second embodiment, the inventors employed two different types of toner collection rollers having different surface layers as described below, which are toner collection rollers 1 and 2. The toner collection roller 1 includes a core having a stainless steel of a diameter of 30 mm and a PVDF layer having a thickness of 0.5 mm covering the core. Further, a thin layer including acrylate resin is disposed around the PVDF layer. The toner collection roller 2 includes a core having a stainless steel of a diameter of 30 mm and a PVDF layer having a thickness of 0.5 mm covering the core.

In evaluation, each surface layer of the toner collection rollers 1 and 2 is separated from each base body and cut into a piece of approximately 10 millimeters square. Then, adhesion forces of one toner particle to the surface layer were measured by an AFM.

The following show parameters and conditions of the test:

Measurement condition (pulsed force mode):

AFM: Scanning Probe Microscope SPI4000 and Multiple Function Unit SPA400 (manufactured by SII Nano Technology Inc.), Measurement mode: Adhesion mode, Cantilever: Standard-type silicon cantilever OMCL-RC800PSA (manufactured by Olympus Corporation), Spring constant: 0.76 N/m, Measurement Area: 1 μm×1 μm square, Line Number: 128 lines in vertical direction and 128 lines in horizontal direction, Measuring Scan Frequency: 1 Hz, Z Frequency (Adhesion Frequency): 1 kHz, Maximum Loading Conditions: Target pushing force of 50 nN of the tip of the cantilever onto the surface of a sample (set according to cantilever bending and adhesion amplitude), Toner Particle Diameter of Tip of Cantilever: 7.2 μm and Toner Type; Trial model PxP toner (manufactured by Ricoh Company Ltd.).

Figure 26:
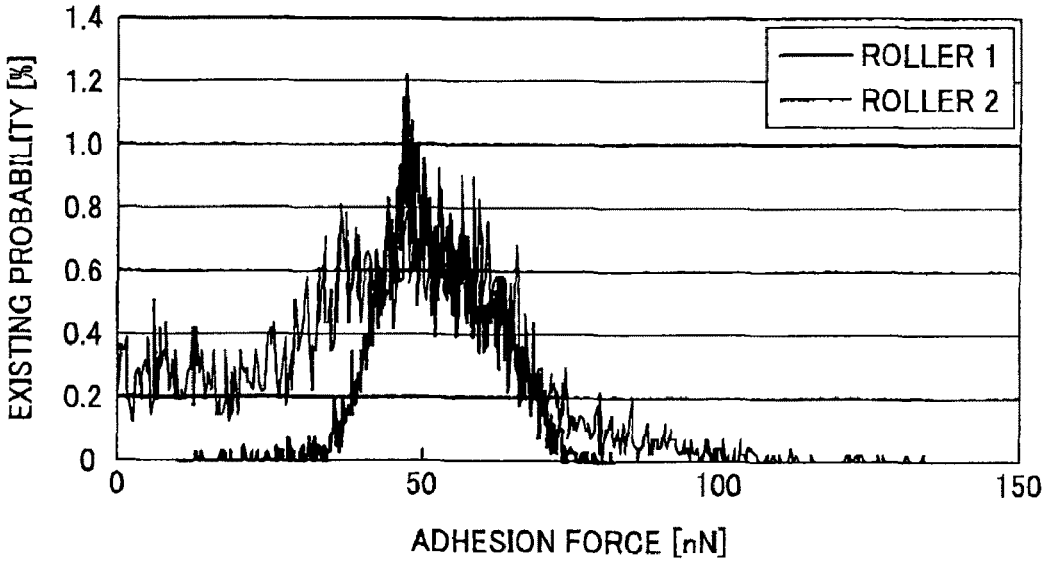
FIG. 26 is a graph showing distribution of adhesion forces of toner to sample toner collection rollers.

FIGS. 25A and 25B illustrate images of the measurements of adhesion forces in an area of 128 points in the vertical direction and 128 points in the horizontal direction of the toner collection rollers 1 and 2. Further, FIG. 26 shows a distribution of the adhesion forces obtained based on the measurements of the adhesion forces of the 128×128 square range. The distribution of the adhesion forces is a component of the measurement of the adhesion forces.

[Test 6]

The inventors attached the toner collection rollers 1 and 2, which serve as the toner collection roller 124 of the cleaning unit 120, to the copier 100 shown in FIG. 12 to output images.

The following show parameters and conditions of Test 6:

Toner Type: Trial model PxP toner (manufactured by Ricoh Company Ltd.),

Cleaning Brush: Brush fiber (Conductive polyester, 3 mm long), diameter of 12 mm, Material of Toner Collection Roller: Core: Stainless steel, Surface Layer: Acrylate coating with thickness of 10 μm, diameter of 10 mm, and Voltages to be applied:

Charge Potential of Photoconductor: −800V,

Developing Roller: −400V,

Conductive Cleaning Blade: −450V,

Cleaning Brush: +350V, and

Toner Collection Roller: +650.

The following show parameters and conditions for image output operation in Test 6:

Copier: imagio Neo C600 manufactured by Ricoh Company Ltd.,

Output paper size and volume: A4L, 100 sheets,

Experimental environment: Temperature 27° C., Humidity 55%, and

Output image: Chart with 5% coverage of image area.

After the image output operation was conducted under the above-described test conditions and image output conditions, the inventors found that the toner collection roller 1 contributed to a production of 100 normal images without causing poor cleaning performance. On the other hand, the toner collection roller 2 output defect images with streaks thereon due to poor cleaning performance.

[Evaluation 4]

Based on results of various researches, reports, etc., the inventors have found that, when 95% or greater of the measurements of adhesion forces exist within a range up to an adhesion force 1.4 times the mean value of the measured adhesion forces, the dispersion of the measured adhesion forces greater than the mean value thereof may fall in given classes within a certain range in the frequency distribution of the measured adhesion forces, and therefore the adhesion forces can be substantially equal at any point on the surface of the toner collection roller. Accordingly, the inventors focused on the above-described result to perform the evaluation in Evaluation 4.

The adhesion force 1.4 times the mean value of the adhesion forces of toner to each toner collection roller described below is an adhesion force of toner removable from the surface of the toner collection roller by the cleaning blade 127 used for cleaning the toner collection roller. That is, the cleaning blade 127 can smoothly remove toner with the adhesion force 1.4 times the mean value of the adhesion forces of toner to each toner collection roller.

According to results of Test 5, the mean value of the adhesion forces of toner to the toner collection roller 1 was 52.7 nN and the mean value of the adhesion forces of toner to the toner collection roller 2 was 44.1 nN.

Approximately 99% of the measurements of the adhesion forces of toner to the toner collection roller 1 exist at or below 73.8 nN that is an adhesion force 1.4 times the mean value of the adhesion forces to the toner collection roller 1. That is, 95% or greater of the measurements of the adhesion forces of toner to the toner collection roller 1 exist within a range up to an adhesion force 1.4 times the mean value of the adhesion forces of toner thereto.

As described above, when the toner collection roller 1 is used as the toner collection roller 124 of the cleaning unit 120, approximately 99% of the measurements of the adhesion forces of toner thereto exist within a range up to 73.8 nN that is the adhesion force 1.4 times the mean value of the adhesion forces. Therefore, the dispersion of the measured adhesion forces greater than the mean value thereof may remain in given classes within a certain range in a frequency distribution of the measured adhesion forces, and therefore the adhesion forces can be substantially equal at any point on the surface of the toner collection roller. As a result, it seemed that the cleaning performance was stable at any point on the surface of the toner collection roller. Therefore, it is contemplated that, when the images were output, the poor cleaning performance as shown in the results of Test 6 did not occur and the output images did not include defect images with streaks. That is, the clean ability that is affected significantly by the toner and the adhesion forces can have excellent features.

By contrast, approximately 81% of the measurements of the adhesion forces of toner to the toner collection roller 2 exist at or below 61.8 nN that is an adhesion force 1.4 times the mean value of the adhesion forces. That is, 95% or greater of the measurements of the adhesion forces of toner to the toner collection roller 2 do not exist at or below an adhesion force 1.4 times the mean value of the adhesion forces.

When the toner collection roller 2 is used as the toner collection roller 124 of the cleaning unit 120, approximately 95% of the measurements of the adhesion forces do not exist at or below 73.8 nN that is the adhesion force 1.4 times the mean value of the adhesion forces. Therefore, the dispersion of the adhesion forces greater than the mean value thereof may fall in given classes within a certain range in a frequency distribution of the measured adhesion forces, and therefore the adhesion forces may be significantly different at various points on the surface of the toner collection roller 2. It is contemplated that the cleaning operation cannot be performed stably at some points on the surface of the toner collection roller 2. It is therefore contemplated that defect images with streaks were output due to the poor cleaning performance on the surface of the toner collection roller 2, which is similar to the results of Test 6.

[Evaluation 5]

Based on results of various researches, reports, etc., the inventors have found that, when the following Expression 10 is satisfied where a mean value of adhesion forces is indicated by "X" and a standard deviation is indicated by "Y" in the measurements of adhesion forces, the dispersion of the measured adhesion forces to the mean value of the adhesion forces can fall in given class within a certain range in a frequency distribution of the measured adhesion forces, and therefore the adhesion forces can be substantially equal at any point on the surface of the toner collection roller. Accordingly, the inventors focused on the above-described result to perform the evaluation of cleaning performance in Evaluation 5.

The mean value of the measured adhesion forces is an adhesion force that can remove toner from the surface of the toner collection roller by the cleaning blade used for cleaning toner from the toner collection roller:

$$X/Y>4 \qquad \text{Expression 10.}$$

According to the results of Test 5, the mean value of the adhesion forces of toner to the toner collection roller 1 was 52.7 nN and the mean value of the adhesion forces of toner to the toner collection roller 2 was 44.1 nN.

Further, the standard deviation of the adhesion force of toner to the toner collection roller 1 was 9.1 nN and the standard deviation of the adhesion force of the toner collection roller 2 was 21.8 nN.

Expression 11 shows a result obtained by assigning the mean value of the adhesion forces and the standard deviation of the roller 1 to Expression 10:

$$X/Y=5.8 \qquad \text{Expression 11.}$$

Expression 12 shows a result obtained by assigning the mean value of the adhesion forces and the standard deviation of the roller 2 to Expression 10:

$$X/Y=2.2 \qquad \text{Expression 12.}$$

According to the results obtained by Expression 11, the toner collection roller 1 satisfies the relation of Expression 10. Therefore, as described above, the variations of the adhesion forces to the mean value of the adhesion forces can fall in given classes within a certain range in the frequency distribution of the measured adhesion forces, and therefore the adhesion forces at any point on the surface of the toner collection roller 1 can be substantially equal. It is contemplated that a stable cleaning operation was performed at any point on the surface thereof. It is therefore contemplated that the cleaning performance was not poor as shown the results of Test 6 and defect images with streaks were not output.

According to the results obtained by Expression 12, the toner collection roller 2 does not satisfy the relation of Expression 10. Since the dispersion of the adhesion forces to the mean value of the adhesion forces cannot fall in given classes within a certain range in the frequency distribution of the measured adhesion forces, the adhesion forces may be significantly different at various points on the surface of the toner collection roller 2. It is contemplated that the cleaning performance was not stably performed at some points on the surface of the toner collection roller 2. It is therefore contemplated that the cleaning performance was poor similarly to the results of Test 6, and therefore defect images with streaks were output due to the poor cleaning performance.

According to the descriptions above, it is clear that evaluating frequency of toner adhesion generated between the toner collection roller and the toner with the standard deviation in addition to the mean value of the adhesion forces can determine the frequency of toner adhesion based on more natural phenomenon. That is, most abnormal phenomena related to the frequency of power adhesion in an image forming apparatus, a blowing apparatus, a power conveying apparatus, and the like do not occur in all over a surface of a member. In other words, abnormal phenomena occur in an area or region that has an extremely large or small adhesion force. Therefore, abnormal phenomena cannot be detected sensitively only with a characteristic value at one point or an average value within an area. Not an evaluation with the characteristic value at one point on the surface of a member but an evaluation with a distribution of adhesion forces of toner on a given area of a surface of a member using the mean value and standard deviation of the distribution may be more based on natural phenomenon of adhesion.

Example 4

In the copier 100 of FIG. 12, the photoconductor 101 and the developing unit 106 are integrally mounted on a process cartridge that is detachably attached to the main body of the copier 100.

Figure 27:
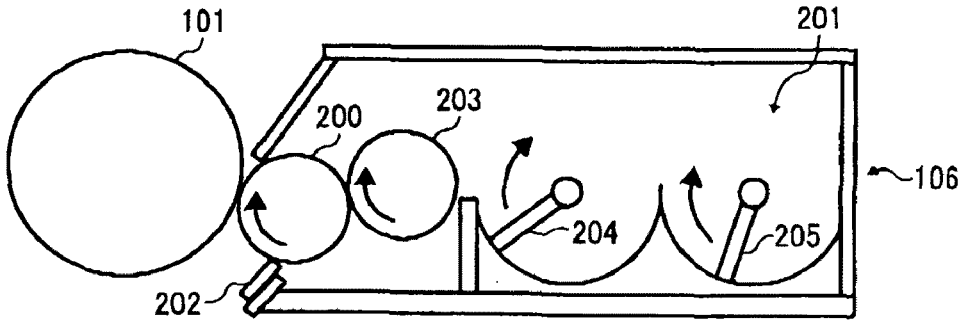
FIG. 27 is a schematic structure of a process cartridge of the copier of FIG. 12.

FIG. 27 illustrates a schematic-structure of a process cartridge that includes the photoconductor 101 and the developing unit 106 of FIG. 12.

The developing unit 106 includes a developing roller 200, a toner container 201, a toner layer regulating member 202, a toner supplying roller 203, and agitating paddles 204 and 205.

The developing roller 200 serves as a toner conveying member and conveys toner to the surface of the photoconductor 101.

The toner layer regulating member 202 serves as a toner regulating member and regulates a thickness of toner layer on the surface of the surface of the developing roller.

The toner supplying roller 203 serves as a toner supplying member and supplies toner to the surface of the developing roller 106.

The agitating paddles 204 and 205 convey one-component developer including toner contained in the toner container 201 to the toner supplying roller 203.

The developing roller 200 includes a roller part that is covered by an elastic rubber layer. The surface of the developing roller 200 further includes a surface coat layer including a material that is easily charge to a polarity opposite to the toner.

The elastic rubber layer of the developing roller 200 is set to a JIS-A hardness of not more than 60 to prevent toner deterioration due to concentration of pressure at a contact point of the developing roller 200 and the toner layer regulating member 202. A surface roughness Ra of the developing roller 200 is set to a range of from 0.1 μm to 3.0 μm to hold an appropriate amount of toner on the surface of the developing roller 200.

The developing roller 200 is also applied with a development bias to form an electrical field between the developing roller 200 and the photoconductor 101. Therefore, the elastic rubber layer is set to a resistance value in a range of from $10^3\Omega$ to $10^{10}\Omega$. The developing roller 200 rotates in a clockwise direction, as shown in FIG. 27, to convey the toner held on the surface thereof to a position facing the toner layer regulating member 202 and the photoconductor 101.

The toner layer regulating member 202 is disposed at a position that is lower than the developing roller 200 disposed downstream from a contact point of the developing roller 200 and the toner supplying roller 203. The toner layer regulating member 202 includes metallic plate spring material such as stainless steel and phosphor bronze. A free end portion or the toner layer regulating member 202 abuts against the surface of the developing roller 200 at a pressing force of from 10 N/m to 40 N/m so that the toner that has passed the toner layer regulating member 202 can be formed to a thin layer and be charged with the frictional charge. Further, to help apply the frictional charge, a regulation bias that is offset in a same direction as a toner charge polarity is applied to the development bias in the toner layer regulating member 202.

An elastic rubber member forming a surface or the elastic rubber layer of the developing roller 200 is not limited to but includes, for example, styrene-butadiene derivative polymer rubber, acrylonitrile-butadiene derivative polymer rubber, acryl rubber, epichlorohydrin rubber, urethane rubber, silicon rubber, and the like. These materials of the elastic rubber member can be used alone or in combination. Among these, a combination of epichlorohydrin rubber and acrylonitrile-butadiene derivative polymer rubber is preferably used.

The developing roller 200 is manufactured by covering an elastic rubber member around an outer circumference of a conductive shaft, for example. The conductive shaft includes, for example, a metallic material such as stainless steel.

[Test 1]

In Test 7 of Example 4, the inventors used three different types of developing rollers, which are developing rollers 1, 2, and 3 having different surface layers. The developing rollers 1, 2, and 3 include an aluminum roller that serves as a core thereof and an elastic rubber layer as a surface layer thereof.

In evaluation, each elastic rubber layer of the developing rollers 1, 2, and 3 is separated from each aluminum roller and cut into a piece of approximately 10 millimeters square. Then, with the above-described force curve method, an adhesion force of one toner particle to the surface layer (of the elastic rubber layer) was measured by an atomic force microscope (AFM).

The following show parameters and conditions of Test 7:

Measurement condition (force curve mode):

AFM; Scanning Probe Microscope SPI4000 and Multiple Function Unit SPA400 (manufactured by SII Nano Technology Inc.), Measurement mode: AFM mode, Cantilever: Standard-type silicon cantilever OMCL-RC800PSA (manufactured by Olympus Corporation), Spring constant: 0.76 N/m, Measurement Points: 100 points: 10 points in vertical direction and 10 points in horizontal direction at intervals of 200 nm, Maximum Loading Conditions: Target pushing force of 50 nN of the tip of the cantilever onto the surface of a sample, Toner Particle Diameter at Tip of Cantilever: 6 μm, and Toner Type: Trial model PxP toner (manufactured by Ricoh Company Ltd.).

The inventors measured the adhesion force between the toner and the silicon substrate used here and found that the adhesion force was 30 nN. The silicon substrate was stored in a desiccator or the like with humidity of 50% or less.

Figure 28:
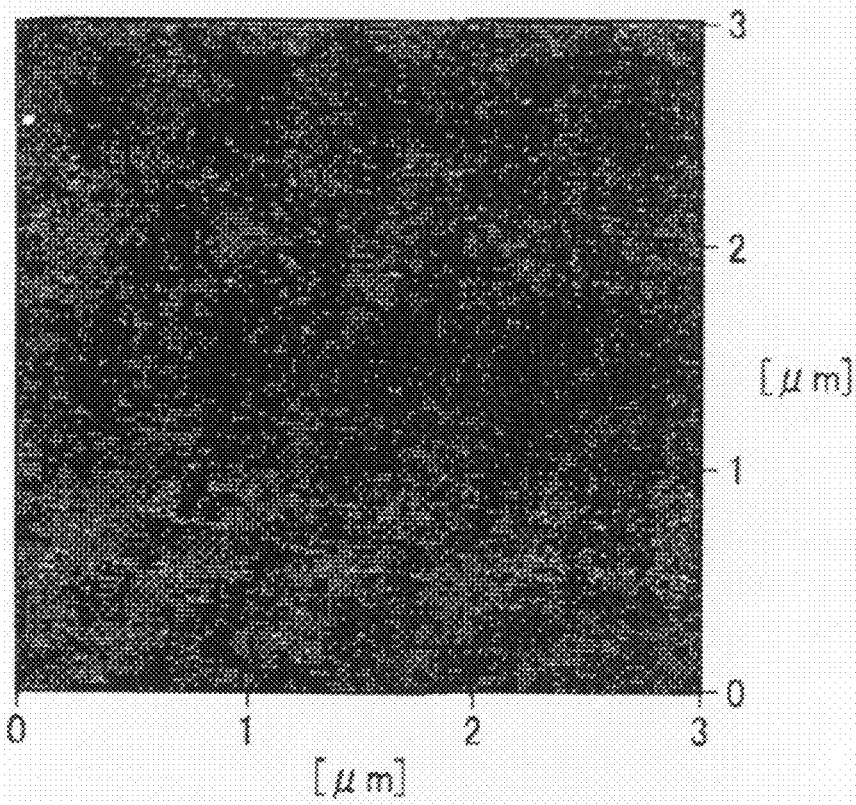
FIG. 28 is image data indicating a surface roughness Ra of a silicon substrate used in Test 7.

Further, the inventors used the AFM to confirm that the surface roughness Ra was 1 nm or smaller (see FIG. 28). The overall adhesion forces were measured using an identical probe with an identical toner attached.

Figure 29:
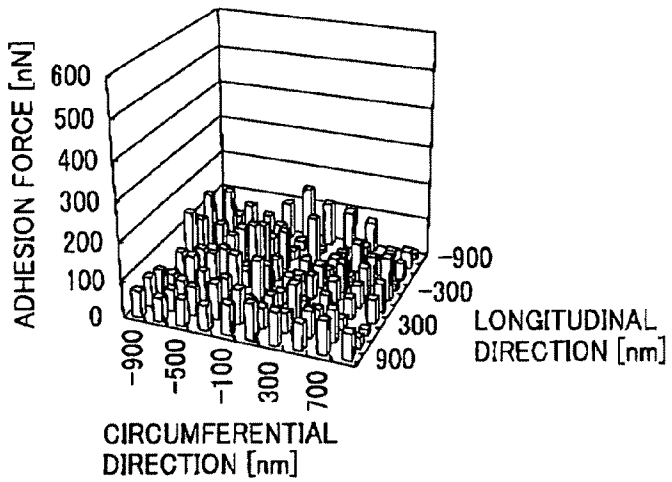
FIG. 29 is a graph showing measurements of adhesion forces of toner to a sample developing roller 1.
Figure 30:
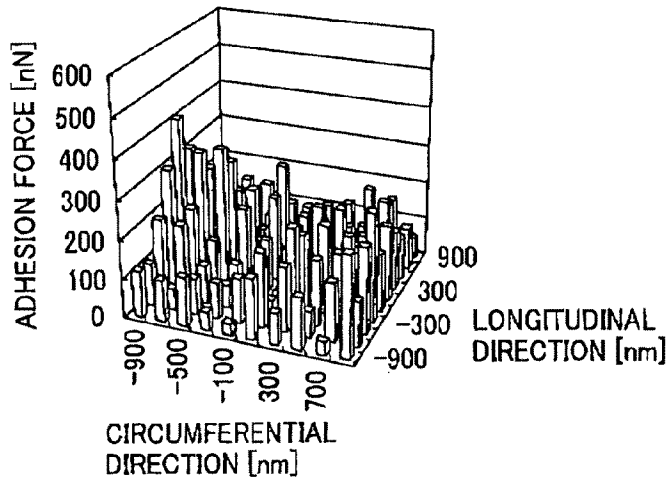
FIG. 30 is a graph showing measurements of adhesion forces of toner to a sample developing roller 2.
Figure 31:
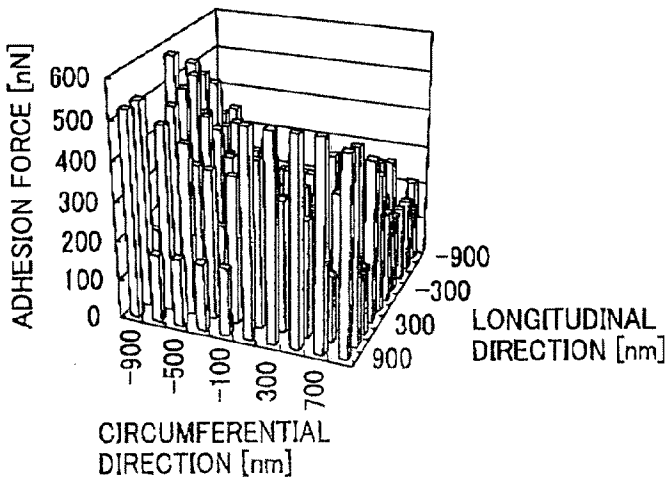
FIG. 31 is a graph showing measurements of adhesion forces of toner to a sample developing roller 3.
Figure 32:
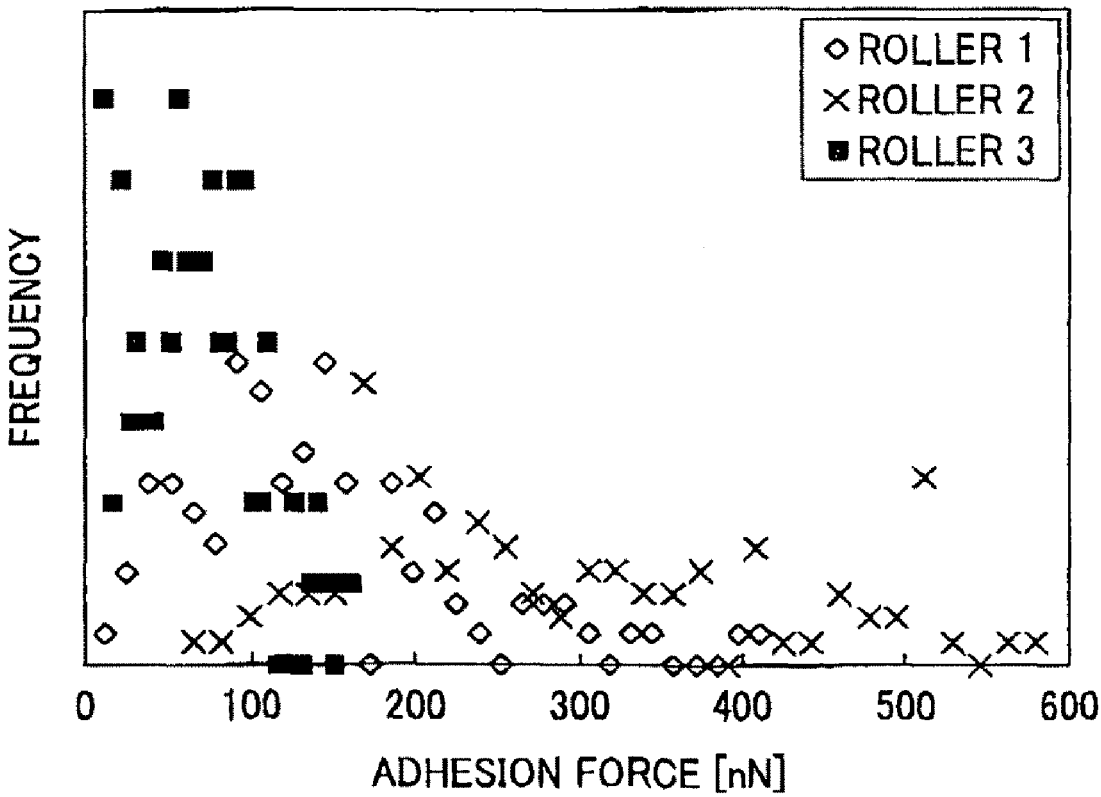
FIG. 32 is a graph showing frequency distributions of adhesion forces based on the measurements of FIGS. 29, 30, and 31.

FIG. 29 shows measurements of adhesion forces of toner to the developing roller 1, FIG. 30 shows measurements of adhesion forces of toner to the developing roller 2, FIG. 31 shows measurements of adhesion forces of toner to the developing roller 3, and FIG. 32 shows a graph of frequency distribution of adhesion forces based on these measurements shown in FIGS. 29, 30, and 31.

[Test 8]

The inventors attached the developing rollers 1, 2, and 3 to the copier 100 shown in FIG. 12 to output images.

The following show parameters and conditions for image output operation in Test 8:

Copier: Ricoh's test machine,

Output paper size and volume: A4L, 1000 sheets,

Experimental environment: Temperature 27° C., Humidity 55%, and

Output image: Chart with 5% coverage of image area.

After the image output operation was conducted under the above-described test conditions and image output conditions, halftone images were output. The inventors found that the developing roller 1 contributed to a production of normal images. The developing rollers 2 and 3, however, had toner filming thereon and therefore output defect images with vertical white streaks due to the toner filming.

Further, the inventors observed each of the developing rollers 1, 2, and 3 through the laser microscope VK8700 (manufactured by Keyence Corporation) and found that the toner filming was progressing on the surfaces of the developing rollers 2 and 3.

Table 5 shows results of Test 8.

TABLE 5

| | Output Halftone Image | Developing Roller State |
|---|---|---|
| Developing Roller 1 | Normal | Substantially same as initial state |
| Developing Roller 2 | White streaks | Toner filming |
| Developing Roller 3 | White streaks | Toner filming |

[Test 9]

Friction coefficients on the surface layer of the developing rollers 1, 2, and 3 were measured by Euler belt method. Table 6 shows results of the measurement.

TABLE 6

| | Friction coefficient |
|---|---|
| Developing Roller 1 | 0.72 |
| Developing Roller 2 | 0.27 |
| Developing Roller 3 | 0.32 |

[Evaluation 6]

After having keen examination, the inventors made it clear that the toner filming is not likely to occur on the surface of the developing roller unless a value satisfying X+Y exceeds a given threshold. (The value that satisfies X+Y is an upper limit of adhesion force that can be measured on the surface of the developing roller.) Specifically, in the measurements of the adhesion forces of toner to the developing roller, the inventors found that, when the following Expression 13 is satisfied where a mean value of adhesion forces is indicated by "X", a standard deviation is indicated by "Y", and an adhesion force generated between the toner and the silicon substrate is indicated by "Z", dispersion of the measured adhesion forces with respect to the mean value of the adhesion forces can fall in given classes within a certain range in the frequency distribution of the measured adhesion forces, and therefore the adhesion forces can be substantially equal at any point on the surface of the developing roller. As a result, the inventors clarified that it is difficult to cause the toner filming on the surface of the developing roller. Accordingly, the inventors focused on the above-described result to perform the evaluation in Evaluation 6:

$$X+Y<5Z \quad \text{Expression 13.}$$

The measured adhesion forces of toner to the silicon substrate is normalized to eliminate differences of the adhesion forces among different types of toners at the tip of the probe so as to evaluate constantly under the identical condition.

According to the adhesion forces measured in Test 7, the mean value of the adhesion forces "X" of toner to the developing rollers 1, 2, and 3 were 67.5 nN, 142.7 nN, and 95.0 nN, respectively.

Further, the standard deviations "Y" of the adhesion forces of toner to the developing rollers 1, 2, and 3 were 34.6 nN, 78.8 nN, and 130.6 nN, respectively.

Further, as described in Test 7, the adhesion force "Z" generated between the toner and the silicon substrate was 30 nN. Since Test 7 was conducted with the identical probe having the identical toner attached was used with respect to the developing rollers 1, 2, and 3 as described above, the adhesion force "Z" was the same value (30 nN in this case) with respect to each of the developing rollers 1, 2, and 3.

The following Expression 14 shows a relation of a value obtained by adding the mean value of the adhesion forces "X" and the standard deviation "Y" of the developing roller 1 and a value obtained by multiplying the adhesion force "Z" generated between the toner and the silicon substrate of the developing roller 1 by five times:

$$X+Y=102.1<150=5Z \quad \text{Expression 14.}$$

The following Expression 15 shows a relation of a value obtained by adding the mean value of the adhesion forces "X" and the standard deviation "Y" of the developing roller 2 and a value obtained by multiplying the adhesion force "Z" generated between the toner and the silicon substrate of the developing roller 2 by five times:

$$X+Y=221.5>150=5Z \quad \text{Expression 15.}$$

The following Expression 16 shows a relation of a value obtained by adding the mean value of the adhesion forces "X" and the standard deviation "Y" of the developing roller 3 and a value obtained by multiplying the adhesion force "Z" generated between the toner and the silicon substrate of the developing roller 3 by five times:

$$X+Y=425.6>150=5Z \quad \text{Expression 16.}$$

Table 7 shows the above-described mean values of the respective adhesion forces, the standard deviations, and calculation results of the developing rollers 1, 2, and 3.

TABLE 7

| | Mean value of adhesion force (X) [nN] | Standard deviation (Y) [nN] | X + Y [nN] | 5Z [nN] |
|---|---|---|---|---|
| Developing roller 1 | 67.5 | 34.6 | 102.1 | 150 |
| Developing roller 2 | 142.7 | 78.8 | 221.5 | 150 |
| Developing roller 3 | 295.0 | 130.6 | 425.6 | 150 |

According to the results shown in Table 7 and obtained by Expression 14, the developing roller 1 satisfies the relation of Expression 13. Therefore, as described above, the dispersion of the measured adhesion forces with respect to the mean value of the measured adhesion forces can fall in given classes within a certain range in the frequency distribution of the measured adhesion forces, and therefore the adhesion forces can be substantially equal at any point on the surface of the developing roller 1. It is contemplated that the toner was effectively collected at any point on the surface of the developing roller 1. It is therefore contemplated that, even when images were output as conducted in the above-described results of Test 8, the cleaning performance was not so poor to output defect images with streaks and the toner filming was not caused.

Further, when comparing the measurements of the friction coefficients measured by Euler belt method, which is shown in Table 6, and the measurements of the adhesion forces, which is shown in Table 7, it is clear that there is no relation between the friction coefficient and the adhesion force of toner to each developing roller. For example, while the developing roller 1 has the friction coefficient greater than the developing rollers 2 and 3, the adhesion force thereto is the smallest. According to the above-described results, the evaluation based on the measurements of the adhesion forces, which was conducted in this example embodiment, can evaluate the cleaning performance of a member more directly than the surface evaluation on the surface of a member (Euler belt method).

Example 5

[Test 10]

In Test 10 of Example 5, the inventors used four different types of developing rollers, which are developing rollers 11, 12, 13, and 14 having different surface layers. The developing rollers 11, 12, 13, and 14 include an aluminum roller serving as a core thereof and an elastic rubber layer serving as a surface layer thereof.

In evaluation, each elastic rubber layer of the developing rollers 11, 12, 13, and 14 is separated from each aluminum roller and cut into a piece of approximately 10 millimeters square. Then, with the above-described force curve method, an adhesion force of one toner particle to the surface layer (of the elastic rubber layer) was measured by the AFM.

In Test 10 of Example 5, the inventors used a new probe that is different from the probe used in Test 7 of Example 4 to evaluate the adhesion forces. That is, the inventors manufactured another probe with a toner particle for Test 10, where the toner type was identical to that used in Test 7 but not identical to the toner particle used in Test 7.

The following show parameters and conditions of Test 10:

Measurement condition (force curve mode):

- AFM: Scanning Probe Microscope SPI4000 and Multiple Function Unit SPA400 (manufactured by SII Nano Technology Inc.),
- Measurement mode: AFM mode,
- Cantilever: Standard-type silicon cantilever OMCL-RC800PSA (manufactured by Olympus Corporation), Spring constant: 0.76 N/m,
- Measurement Points: 100 points: 10 points in vertical direction and 10 points in horizontal direction at intervals of 200 nm,
- Maximum Loading Conditions: Target pushing force of 50 nN of the tip of the cantilever onto the surface of a sample,
- Toner Particle Diameter at Tip of Cantilever: 5.5 μm, and
- Toner Type: Trial model PxP toner (manufactured by Ricoh Company Ltd.).

The inventors measured the adhesion force between the toner and the silicon substrate used here and found that the adhesion force was 10 nN. Even though the same type of toner was used in Test 7 and Test 10, the toner particle attached to the tip of the cantilever in Test 10 was different from the toner particle attached to the tip of the cantilever in Test 7, and therefore the values of the adhesion forces generated between the toner and the silicon substrate were different between the Test 7 and Test 10.

The silicon substrate was stored in a desiccator or the like with humidity of 50% or less. Further, the inventors used the AFM to confirm that the surface roughness Ra is 1 nm or smaller. The overall adhesion forces were measured using the identical probe with an identical toner attached.

Figure 33:
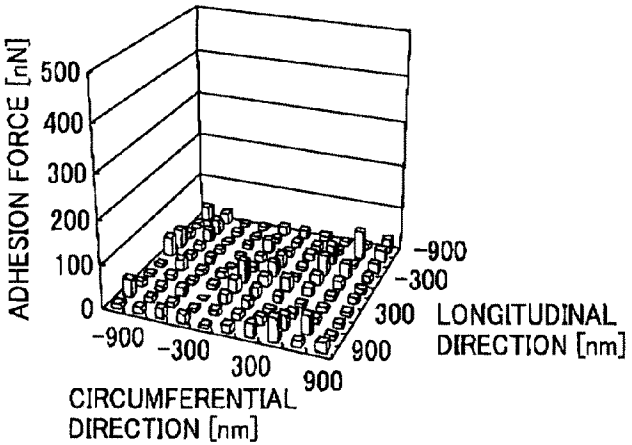
FIG. 33 is a graph showing measurements of adhesion forces of toner to a sample developing roller 11.
Figure 34:
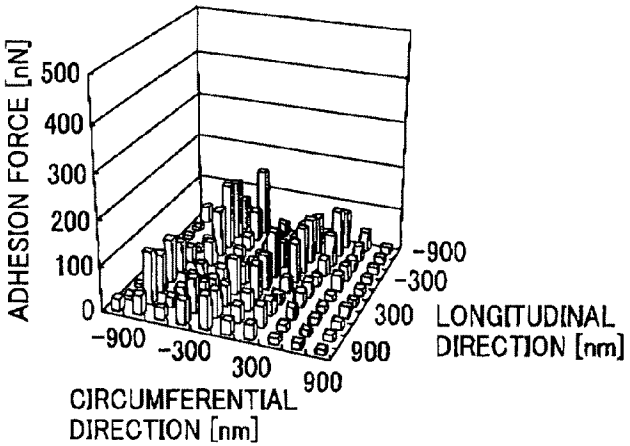
FIG. 34 is a graph showing measurements of adhesion forces of toner to a sample developing roller 12.
Figure 35:
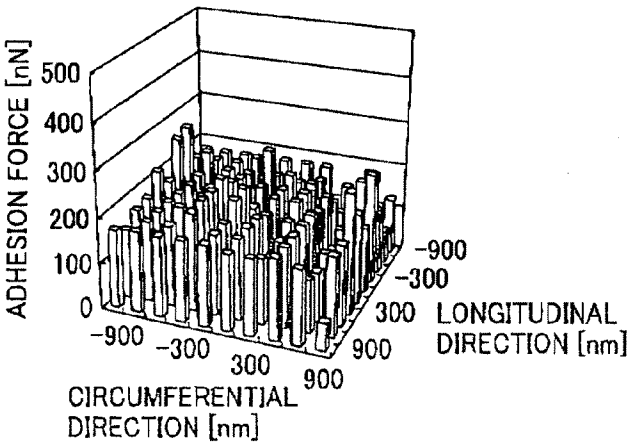
FIG. 35 is a graph showing measurements of adhesion forces of toner to a sample developing roller 13.
Figure 36:
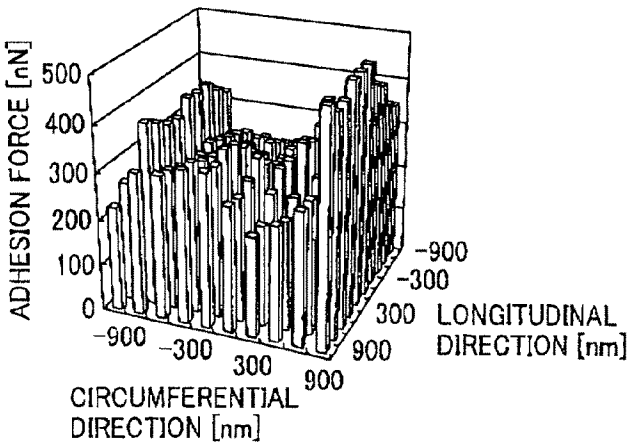
FIG. 36 is a graph showing measurements of adhesion forces of toner to a sample developing roller 14.

FIG. 33 shows measurements of adhesion forces of toner to the developing roller 11, FIG. 34 shows measurements of adhesion forces of toner to the developing roller 12, FIG. 35 shows measurements of adhesion forces of toner to the developing roller 13, and FIG. 36 shows measurements of adhesion forces of toner to the developing roller 14.

[Test 11]

The inventors attached the developing rollers 11, 12, 13, and 14 to the copier 100 shown in FIG. 12 to output images.

The following show parameters and conditions for image output operation in Test 11:

Copier: Ricoh's test machine,

Output paper size and volume: A4L, 1000 sheets,

Experimental environment: Temperature 27° C., Humidity 55%, and

Output image: Chart with 5% coverage of image area.

After the image output operation was conducted under the above-described test conditions and image output conditions, halftone images were output. The inventors found that the developing roller 11 contributed to a production of normal images. On the other hand, the developing rollers 12, 13, and 14 had toner filming thereon and therefore output defect images with vertical white streaks due to the toner filming.

Further, the inventors observed each of the developing rollers 11, 12, 13, and 14 through the laser microscope VK8700 (manufactured by Keyence Corporation) and found that the toner filming was progressing on the surfaces of the developing rollers 12, 13, and 14.

Table 8 shows results of Test 11.

TABLE 8

| | Output Halftone Image | Developing Roller State |
|---|---|---|
| Developing Roller 11 | Normal | Substantially same as initial state |
| Developing Roller 12 | White streaks | Toner filming |
| Developing Roller 13 | White streaks | Toner filming |
| Developing Roller 14 | White streaks | Toner filming |

[Evaluation 7]

As shown in Evaluation 7, in the measurements of the adhesion forces of toner to the developing roller, the inventors have found that, when the following Expression 17 is satisfied where a mean value of adhesion forces is indicated by "X", a standard deviation is indicated by "Y", and an adhesion force between the toner and the silicon substrate is indicated by "Z", the dispersion of the measured adhesion forces with respect to the mean value of the adhesion forces can fall in given classes within a certain range in the frequency distribution of the measured adhesion forces, and therefore the adhesion forces can be substantially equal at any point on the surface of the developing roller. As a result, the inventors clarified that it is difficult to cause the toner filming to progress on the surface of the developing roller. Accordingly, the inventors focused on the above-described result to perform the evaluation in Evaluation 7:

$$X+Y<5Z \quad \text{Expression 17.}$$

The measured adhesion forces of toner to the silicon substrate is normalized to eliminate differences of the adhesion forces among different types of toners at the tip of the probe so as to evaluate constantly under the identical condition.

According to the adhesion forces measured in Test 10, the mean value of the adhesion forces "X" of toner to the developing rollers 11, 12, 13, and 14 were 19.0 nN, 42.0 nN, 174.0 nN, and 313.0 nN, respectively.

Further, the standard deviations "Y" of the adhesion forces of toner to the developing rollers 11, 12, 13, and 14 were 12.0 nN, 33.0 nN, 35.0 nN, and 70.0 nN, respectively.

Further, as described in Test 10, the adhesion force "Z" generated between the toner and the silicon substrate was 10 nN. Since Test 10 was conducted with the identical probe having the identical toner attached was used with respect to the developing rollers 11, 12, 13, and 14 as described above, the adhesion force "Z" was the same value (10 nN in this case) with respect to each of the developing rollers 11, 12, 13, and 14.

The following Expression 18 shows a relation of a value obtained by adding the mean value of the adhesion forces "X" and the standard deviation "Y" of the developing roller 11 and a value obtained by multiplying the adhesion force "Z" generated between the toner and the silicon substrate of the developing roller 11 by five times:

$$X+Y=31.0<50=5Z \quad \text{Expression 18.}$$

The following Expression 19 shows a relation of a value obtained by adding the mean value of the adhesion forces "X" and the standard deviation "Y" of the developing roller 12 and a value obtained by multiplying the adhesion force "Z" generated between the toner and the silicon substrate of the developing roller 12 by five times:

$$X+Y=75.0<50=5Z \quad \text{Expression 19.}$$

The following Expression 20 shows a relation of a value obtained by adding the mean value of the adhesion forces "X" and the standard deviation "Y" of the developing roller 13 and a value obtained by multiplying the adhesion force "Z" generated between the toner and the silicon substrate of the developing roller 13 by five times:

$$X+Y=209.0<50=5Z \quad \text{Expression 20.}$$

The following Expression 21 shows a relation of a value obtained by adding the mean value of the adhesion forces "X" and the standard deviation "Y" of the developing roller 14 and a value obtained by multiplying the adhesion force "Z" generated between the toner and the silicon substrate of the developing roller 14 by five times:

$$X+Y=383.0<50=5Z \quad \text{Expression 21.}$$

Table 9 shows the above-described mean value of the adhesion forces, the standard deviations, and calculation results of the developing rollers 11, 12, 13, and 14.

TABLE 9

| | Mean value of adhesion forces (X) [nN] | Standard deviation (Y) [nN] | X + Y [nN] | 5Z [nN] |
|---|---|---|---|---|
| Developing roller 11 | 19.0 | 12.0 | 31.0 | 50 |
| Developing roller 12 | 42.0 | 33.0 | 75.0 | 50 |
| Developing roller 13 | 174.0 | 35.0 | 209.0 | 50 |
| Developing roller 14 | 313.0 | 70.0 | 383.0 | 50 |

According to the results shown in Table 9 and obtained by Expression 18, the developing roller 11 satisfies the relation of Expression 17. Therefore, as described above, the dispersion of the measured adhesion forces can fall in given classes within a certain range in the frequency distribution of the measured adhesion forces, and therefore the adhesion forces can be substantially equal at any point on the surface of the developing roller 11. It is contemplated that the toner was effectively collected at any point on the surface of the developing roller 11. It is therefore contemplated that the toner filming did not occur and defect images with streaks were not output as shown in Test 11.

According to the results shown in Table 9 and obtained by Expressions 19, 20, and 21, the developing rollers 12, 13, and 14 do not satisfy the relation of Expression 17. Since the dispersion of the adhesion forces with respect to the mean value of the adhesion forces cannot fall in given classes within a certain range in the frequency distribution of the measured adhesion forces, the adhesion forces may be significantly different at various points on the surface of the developing rollers 12, 13, and 14. It is contemplated that the toner was effectively collected at some points on the surface of the developing rollers 12, 13, and 14. It is therefore contemplated that the toner filming was caused and defect images with streaks were output as shown in the results of Test 11.

As described above, it is clear in Evaluation 7 that the intention of easy progress of toner filming on the surface of the developing roller can be foreseen based on the adhesion forces of toner with the same method as Evaluation 6. Further, even when a same type of toner is used, variations in manufacturing can provide different absolute values of the adhesion forces. However, different probes can be equally evaluated by normalizing the measured adhesion forces of toner to the silicon substrate.

According to the descriptions above, it is clear that evaluating frequency of toner adhesion generated between the surface of the developing roller and the toner with the standard deviation in addition to the mean value of the adhesion forces can determine the frequency of toner adhesion based on more natural phenomenon. That is, most abnormal phenomena related to the frequency of power adhesion in an image forming apparatus, for example, do not occur in all over a surface of a member. In other words, abnormal phenomena occur in an area or region that has an extremely large or small adhesion force. Therefore, abnormal phenomena cannot be detected sensitively only with a characteristic value at one point or an average value within an area. Not an evaluation with the characteristic value at one point on the surface of a member but an evaluation with a distribution of adhesion forces of toner on a given area of a surface of a member using the average value and standard deviation of the distribution may be more based on natural phenomenon of adhesion.

Third Embodiment

Next, a description is given of an electrophotographic copier (hereinafter, referred to as a "copier 100") serving as an image forming apparatus according to a third embodiment of the present patent application. Elements or components of the copier 100 serving as an image forming apparatus according to the third embodiment may be denoted by the same reference numerals as those of the copier 100 according to the second embodiment and the descriptions thereof are omitted or summarized.

When measuring the adhesion force with the AFM and, based on the measurements, determining whether the powder can be removed from the member, a target powder particle may needed to be attached to the tip of a cantilever used for measuring the adhesion force. This operation is time and labor consuming.

Based on results of various researches, reports, etc., the inventors have found that this method of determine adhesion force distribution can evaluate powder removability indicating a degree of difficulty of removing a powder particle with a small roughness only between identical materials on a surface of a member.

Results of Test 12 that is described below have proved that, when a photoconductor having a surface formed by a single material of polycarbonate resin is used, the distribution of the average surface roughness Ra on the surface of the photoconductor can determine the cleaning performance of the cleaning blade on the surface of the photoconductor to remove toner from the surface of the photoconductor. The average surface roughness Ra is defined in Expression 22 described as follows:

$$Ra=1/S0\iint|F(X,Y)-Z0|dXdY \qquad \text{Expression 22,}$$

where "F(X,Y)" represents a surface of all measurement data, "S0" represents an area assuming that a designated surface is ideally flat, and "Z0" represents an average value of Z data within the designated surface.

Example 6

[Test 12]

In the third embodiment, the inventors used an AFM to measure and evaluate surface roughness, adhesion force distribution, and actual apparatus characteristics of six different sample photoconductors with different surface roughnesses, which are Sample Photoconductors 1 through 6 shown below.

Evaluation target member: 6 different types of samples of photoconductors having same material and different surface roughnesses, manufactured by a test apparatus for abrasion. Specifically, the sample photoconductors 1 to 6 include a charge transport layer as a most surface layer using a polycarbonate resin as a binder resin. The respective surfaces of the photoconductors 1 to 6 were abraded by rotating the photoconductors 1 to 6 while contacting the respective surfaces of the photoconductors 1 to 6 with a wrapping film sheet manufactured by Sumitomo 3M Limited.

Sample Photoconductor 1: No wear,

Sample Photoconductor 2: Friction and wear by the wear testing machine: 1 minute, film particle size: 2 μm, Sample Photoconductor 3: Friction and wear by the wear testing machine: 2 minutes, film particle size: 5 μm, Sample Photoconductor 4: Friction and wear by the wear testing machine: 3 minutes, film particle size: 12 μm, Sample Photoconductor 5: Friction and wear by the wear testing machine: 4 minutes, film particle size: 12 μm, and Sample Photoconductor 6: Friction and wear by the wear testing machine: 16 minutes, film particle size: 12 μm.

The following are parameters and conditions of Test 12:

Surface roughness measurement condition (with atomic force microscope):

AFM: Scanning Probe Microscope SPI4000 and Multiple Function Unit SPA400 (manufactured by SII Nano Technology Inc.), Measurement mode: DFM mode (Dynamic Force Mode), Cantilever: Silicon cantilever SI-DF20 (manufactured by SII Nano Technology Inc.), Spring constant: 20 N/m, Measurement area: 1 μm×1 μm square, Measurement points: 5 points or more, and Data processing: Conducting primary inclination correction with dedicated software, and then calculating average surface roughness Ra.

A cantilever is not limited to the above-described cantilever. For example, a cantilever for measurement of tapping forms can be applied since the cantilever is guaranteed to have a diameter of a tip thereof of approximately 10 nm.

Adhesion force measurement condition (pulsed force mode):

AFM: Scanning Probe Microscope SPI4000 and Multiple Function Unit SPA400 (manufactured by SII Nano Technology Inc.), Measurement mode: Adhesion mode, Cantilever: Standard-type silicon cantilever OMCL-RC800PSA (manufactured by Olympus Corporation), Spring constant: 0.76 N/m, Measurement Area: 10 μm×10 μm square, Line Number: 128 lines in vertical direction and 128 lines in horizontal direction, Measuring Scan Frequency: 0.5 Hz, Z Frequency (Adhesion Frequency): 1 kHz, Maximum Loading Conditions: Target pushing force of 50 nN of the tip of the cantilever onto the surface of a sample (set according to cantilever bending and adhesion amplitude), Toner Particle Diameter of Tip of Cantilever: 6 μm, Toner Type: Black toner for imagio MP C3000 (manufactured by Ricoh Company Ltd.), and Actual apparatus characteristics:

The actual apparatus characteristics were evaluated based on cleaning performance of the cleaning blade with respect to the surface of the photoconductor with toner thereon. When the toner passes through a contact portion or cleaning portion of the photoconductor and the cleaning blade in forms of streaks or bands, poor cleaning performance occurs, and the toner slipped in the forms of streaks or bands can appear on a printed image. The evaluation was conducted to eliminate this significant problem.

Figure 37:
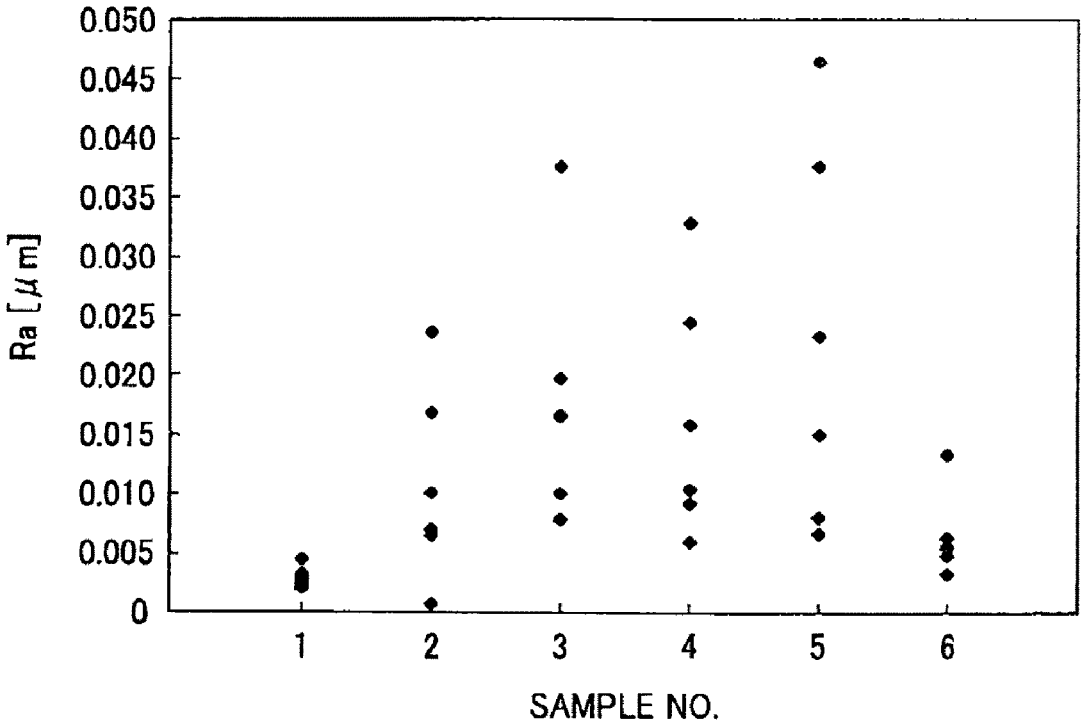
FIG. 37 is a graph showing measurements of average surface roughnesses of sample photoconductors, according to a third embodiment of the present patent application.

FIG. 37 is a graph showing measurements of average surface roughnesses Ra of each sample photoconductor measured by the atomic force microscope. It is important measure the average surface roughnesses Ra at multiple points to evaluate significantly small roughness. Specifically, it is preferable to measure the average surface roughnesses Ra at 5 points or more.

Figure 38:
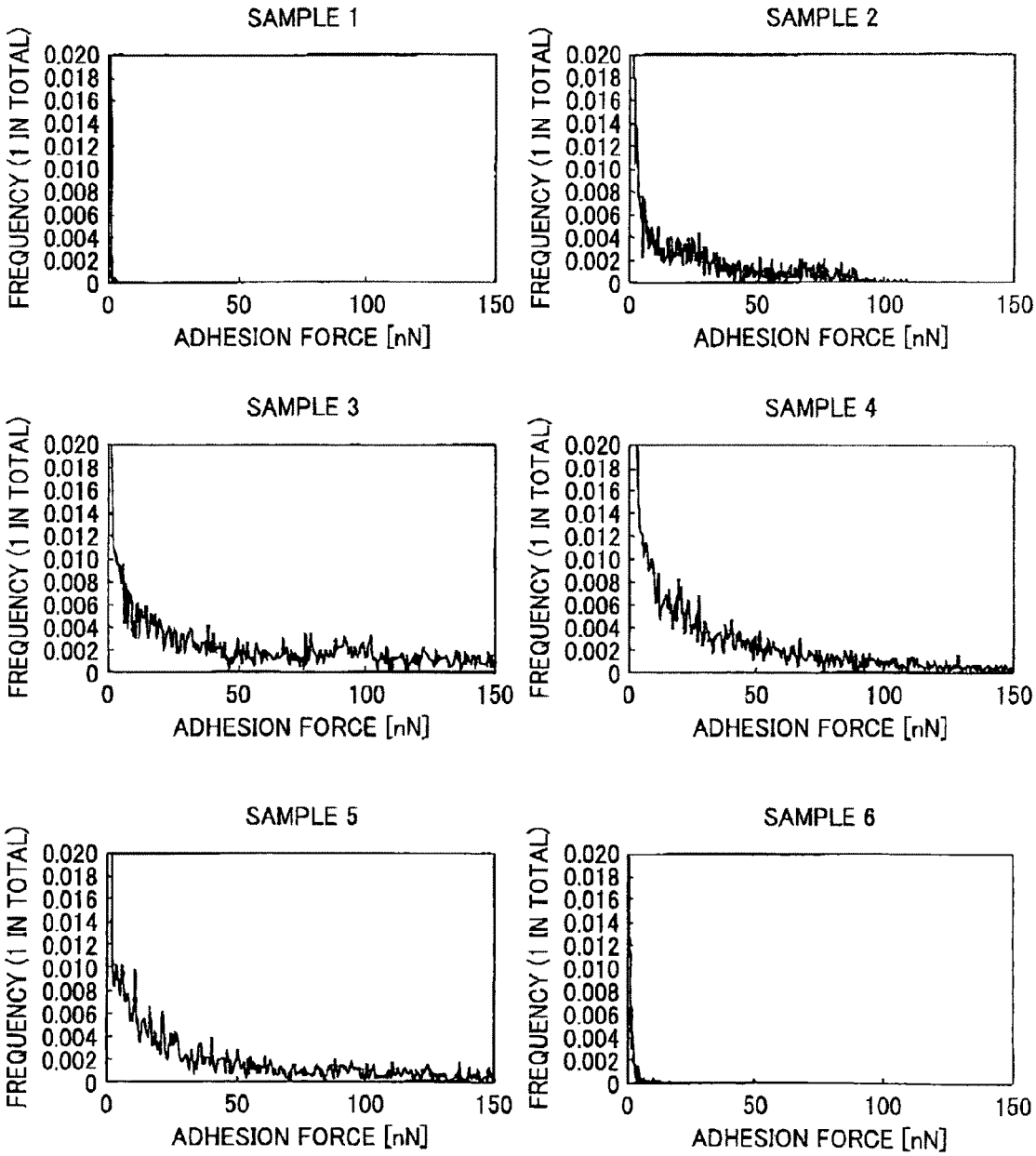
FIG. 38 is a drawing of graphs showing measurements of distributions of adhesion forces of toner to the sample photoconductors of FIG. 37.
Figure 39:
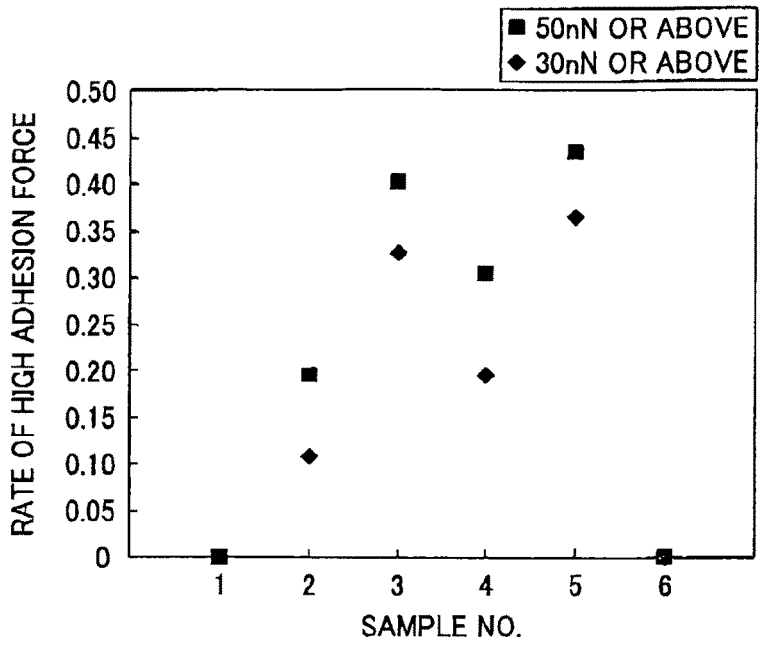
FIG. 39 is a graph showing results of rates of high adhesion force elements of the sample photoconductors of FIG. 37.

FIG. 38 illustrates graphs showing measurements of a distribution of adhesion forces of toner to each sample photoconductor. Further, FIG. 39 is a graph showing results of rates of high adhesion force elements (rate of 30 nN or greater and rate of 50 nN or greater) to evaluate the dispersion based on the adhesion force distribution.

Table 10 shows results of comparison of the average surface roughnesses Ra, the adhesion force distribution, and the actual apparatus characteristics of the sample photoconductors 1 to 6.

TABLE 10

| | Roughness distribution | Adhesion force distribution | Cleaning performance |
|---|---|---|---|
| Sample Photoconductor 1 | Narrow | Narrow | Excellent |
| Sample Photoconductor 2 | Average | Average | Good |
| Sample Photoconductor 3 | Wide | Wide | Bad |
| Sample Photoconductor 4 | Wide | Wide | Bad |
| Sample Photoconductor 5 | Wide | Wide | Bad |
| Sample Photoconductor 6 | Narrow | Narrow | Excellent |

Sample photoconductors 1 and 6 have a significantly small average surface roughness Ra at all measurement points, small dispersion of distribution of adhesion forces, and good characteristics of the actual apparatus.

By contrast, sample photoconductors 3, 4, and 5 have large variations of distribution of average surface roughness Ra, and the poor or bad characteristics of the actual apparatus. Therefore, it is clear that this method can make an estimation of the distribution of adhesion forces of toner to a member such as the photoconductor more easily.

As shown in FIG. 37, it is desirable that the average surface roughnesses Ra on the surface of the photoconductor are small and equal. Specifically, it is desirable that the average surface roughness Ra is 30 nm or below like Sample Photoconductor 2 in FIG. 37. In addition, it may need to consider cost in actual manufacturing of photoconductors. Specifically, it is difficult to manufacture a photoconductor having a surface thereof smoother than Sample Photoconductor 1. Therefore, the average surface roughness Ra of a photoconductor may be equalized in a range of from 1 nm to 30 nm, thereby providing a photoconductor having good cleaning performance more effectively.

Comparative Example

[Test 13]

Figure 40:
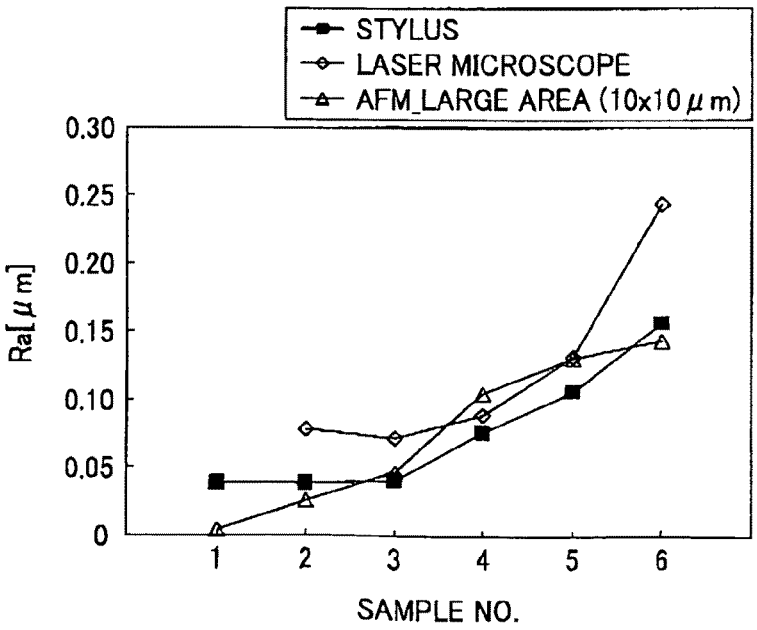
FIG. 40 is a graph showing results of average surface roughnesses of sample photoconductors in Comparative Example of the third embodiment.

FIG. 40 is a graph showing results of average surface roughnesses Ra measured by a stylus instrument and laser microscope not having sufficient resolution, as a comparison example conducted with an inappropriate measurement unit to measure the average surface roughnesses Ra, and results of average surface roughnesses Ra measured by an atomic force microscope even in a large area (10 μm×10 μm square), as a comparative example conducted with an inappropriate measurement condition of the average surface roughnesses Ra. Further, measurement conditions of each average surface roughness in each comparison are as follows:

Evaluation target member: 6 different types of samples of photoconductors having same material and different surface roughness, manufactured by a test apparatus for abrasion. Specifically, the photoconductors include a charge transport layer as a most surface layer using a polycarbonate resin as a binder resin. The respective surfaces of the photoconductors were abraded by rotating the photoconductors while contacting the respective surfaces of the photoconductors with a wrapping film sheet manufactured by Sumitomo 3M Limited.

Sample Photoconductor 1: No wear,

Sample Photoconductor 2: Friction and wear by the wear testing machine: 1 minute, film particle size: 2 μm.

Sample Photoconductor 3: Friction and wear by the wear testing machine: 2 minutes, film particle size: 5 μm, Sample Photoconductor 4: Friction and wear by the wear testing machine: 3 minutes, film particle size: 12 μm, Sample Photoconductor 5: Friction and wear by the wear testing machine: 4 minutes, film particle size: 12 μm, and Sample Photoconductor 6: Friction and wear by the wear testing machine: 16 minutes, film particle size: 12 μm.

Average surface roughness measurement condition (laser microscope):

Laser microscope VK-7500 (manufactured by Keyence Corporation),

Measurement Area: 20 μm×20 μm square, and

Data processing: Calculating average surface roughness Ra with dedicated software.

Average surface roughness measurement condition (stylus instrument):

Surfcom (manufactured by Tokyo Seimitsu Co., Ltd.),

Measurement Area: 4 μm×4 μm square, and

Data processing: Calculating average surface roughness Ra with dedicated software.

Average surface roughness measurement condition (atomic force microscope):

AFM: Scanning Probe Microscope SPI4000 and Multiple Function Unit SPA400 (manufactured by SII Nano Technology Inc.), Measurement mode: DFM mode (Dynamic Force Mode), Cantilever: Silicon cantilever SI-DF20 (manufactured by SII Nano Technology Inc.), Spring constant: 20 N/m, Measurement Area: 10 μm×10 μm square, and Data processing: Conducting primary inclination correction with dedicated software, and then calculating average surface roughness Ra.

When comparing the measurements of the average surface roughness Ra according to an example embodiment of the present patent application, which is shown in FIG. 37, and the measurements of the average surface roughness Ra as a comparison example, which is shown in FIG. 40, it is clear that there are different tendencies in roughness between these measurements. Especially, while the average surface roughness Ra of sample photoconductor 6 in the comparison example is significantly large as can be seen from FIG. 40, the characteristics of the actual machine is significantly preferable or excellent as shown in Table 10. According to the above-described results, the average surface roughness Ra in FIG. 40 measured with the method used in the comparison example cannot foresee the variations of adhesion forces and the characteristics of the actual machine.

According to the results of Tests 12 and 13, it is therefore desirable that the average surface roughness Ra is measured in a range of 100 nm or smaller when evaluating the cleaning performance of a cleaning blade to the surface of a photoconductor based on a distribution of the average surface roughnesses Ra of the photoconductor with the surface including a single polycarbonate resin.

Figure 41:
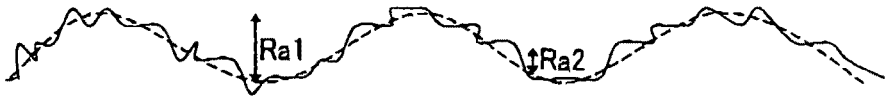
FIG. 41 is a graph showing measurements of surface roughnesses for explaining affects of the surface roughnesses to adhesion forces.

When the surface of the photoconductor has a surface roughness as shown in FIG. 41, it is not preferable to measure a surface roughness Ra1 of 100 nm or greater, but is preferable to measure a surface roughness Ra2 of 100 nm or smaller. It is therefore preferable to change a setting of a measurement unit or measurement condition to measure the average surface roughness Ra of 100 nm or smaller when an measurement area of the average surface roughness Ra is set to a condition to measure the average surface roughness Ra of 100 nm or greater, for example.

Figure 42:
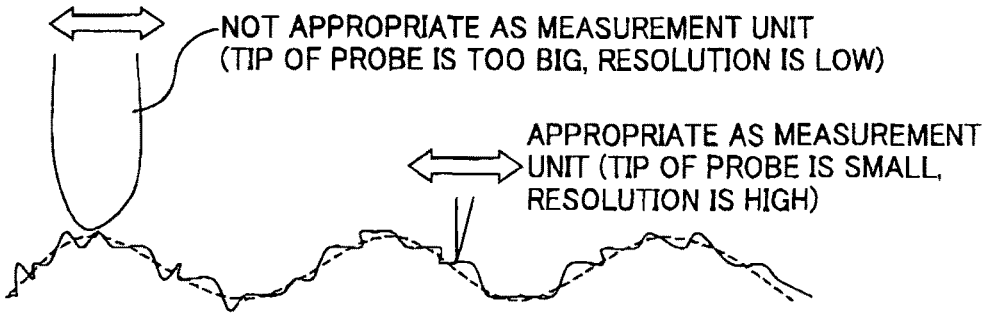
FIG. 42 is a graph showing measurements of surface roughnesses measured by different units.

As the measurement unit, any measurement unit capable of measuring the average surface roughness Ra in a range of 100 nm or smaller with a tapping form measurement mode of the AFM as shown in FIG. 42 can be applied.

Figure 43:
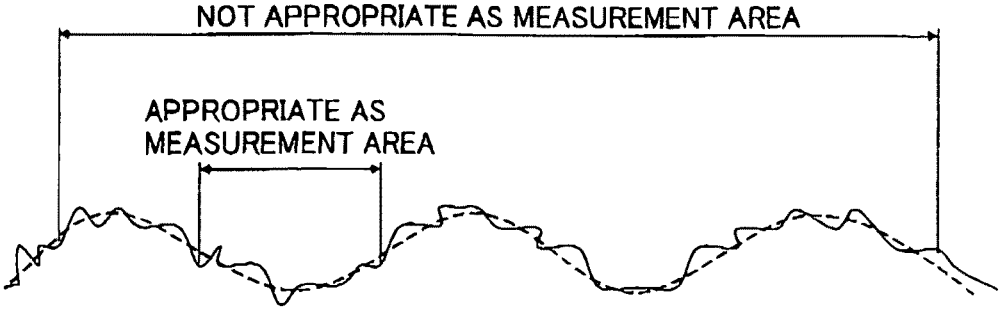
FIG. 43 is a graph showing measurements of surface roughnesses measured in different conditions.

To measure the average surface roughness Ra in the range of 100 μm or smaller, as shown in FIG. 43, the average surface roughness Ra is measured in a large area on the surface of the photoconductor. Then, while narrowing the measurement region in steps, an area to measure the average surface roughness Ra in the range of 100 nm or smaller is determined.

Further, as shown in the measurement condition of the adhesion forces in Test 12, when measuring the adhesion force generated between the surface of the photoconductor and the toner with the AFM, one toner particle that is a target power particle may needed to be attached to the tip of the cantilever used for measuring the adhesion force, which is time and labor consuming. By contrast, as shown in the measurement condition of the surface roughness, when measuring the surface roughness of the photoconductor with the AFM, it is not necessary to attach one toner particle to the tip of the cantilever. Therefore, measuring the average surface roughness Ra on the surface of the photoconductor is less time spending and labor consuming and can evaluate the cleaning performance easier than evaluating the cleaning performance than measuring the adhesion force between the surface of the photoconductor and the toner.

As described above, according to the first and second embodiments, adhesion forces that can be generated between a surface of a given image processing member (i.e., a photoconductor, a cleaning blade, a toner collection roller, and a developing roller) and one powder particle (i.e., one toner particle) are measured at multiple points on the surface of the given image processing member, and a distribution of adhesion forces of toner to the surface of the image processing member is evaluated and determined based on a status of a frequency distribution of the measured adhesion forces. For example, when the frequency distribution has a small dispersion, it is determined that the adhesion forces of toner to the given image processing member are distributed with substantially equal forces at any point on the surface of the given image processing member. By contrast, when the frequency distribution has a large dispersion, it is determined that the adhesion forces of toner to the given image processing member are distributed with significantly different forces at points on the surface of the given image processing member. Such determination of the adhesion force distribution on the given image processing member can contribute to the following estimation. By determining that the adhesion forces of toner to the given image processing member are distributed with substantially equal forces at any point on the surface of the given image processing member, when the adhesion forces are distributed with a value that can remove toner from the surface of the given image processing member, it can be estimated that the toner is removable at any point of the given image processing member. Further, by determining that the adhesion forces of toner to the given image processing member are distributed with significantly different forces at points on the surface of the given image processing member, it can be estimated that the adhesion forces at some points on the surface of the given image processing member are too strong to remove the toner from the given image processing member.

Accordingly, it can be determined whether the toner can be removed effectively from the surface of the given image processing member.

Further, according to the first and second embodiments, the above-described distribution status is indicated by a dispersion or standard deviation of the measured adhesion forces. Therefore, it is easy to grasp dispersion to a mean value of the measured adhesion forces based on the frequency distribution of the measured adhesion forces. Accordingly, when the mean value of the measured adhesion forces indicates that the toner on the surface of the image processing member can be removed therefrom, the above-described determination can be conducted easily.

Further, according to the second embodiment 2, the above-described distribution status is indicated by a cumulative relative frequency of given adhesion forces or a ratio obtained by dividing the number of the measurements of the adhesion forces in a given range (cumulative frequency) by the total number of the measurements of the adhesion forces. Accordingly, it is easy to grasp the frequency (number) of the above-described measured adhesion forces that fall in a given range or up to a given ratio. Accordingly, it is easy to grasp whether or not the above-described measured adhesion forces fall within a range in which the image processing member can remove the toner on the surface thereof, and it is therefore easy to conduct the above-described determination.

Further, according to the first and second embodiments, by the addition of the mean value of the measured adhesion forces to determine the distribution of the adhesion forces of toner to the given image processing member, the above-described adhesion tendency can be determined more accurately.

Further, according to the second embodiment, the given image processing member may correspond to an image carrier included in an image forming apparatus. The image carrier satisfies a relation of $X/2Y>1.3$, where "X" represents the mean value of the measured adhesion forces and "Y" represents the standard deviation or a root square of the variance of the measured adhesion forces. By satisfying the above-described relation, the dispersion of the measured adhesion forces falls in given classes within a certain range in the frequency distribution of the measured adhesion forces. Therefore, the determination of the above-described good member can be performed.

Further, according to the second embodiment, the given image processing member may correspond to a cleaning blade to remove powder from a surface of a target member. The cleaning blade satisfies relations of $X<5Z$ [nN] and $Y<5Z$ [nN], where "X" represents the mean value of the measured adhesion forces, "Y" represents the standard deviation or a root square of the variance of the measured adhesion forces, and "Z" represents an adhesion force generated between toner serving as the powder and a silicon substrate. By satisfying the above-described relations, the dispersion of the measured adhesion forces falls in given classes within a certain range in the frequency distribution of the measured adhesion forces. Therefore, the determination of the above-described good member can be performed.

Further, according to the second embodiment, a surface roughness of the silicon substrate of the cleaning blade may be equal to or less than 1 nm. With the above-described setting, the measurement accuracy of the adhesion force between the toner and the silicon substrate can be increased.

Further, according to the second embodiment, the above-described given adhesion forces correspond to an adhesion force 1.5 times the mean value of the above-described measured adhesion forces and a cumulative relative frequency of the measurements of the adhesion forces, which is a ratio obtained by dividing the number of the measurements of the adhesion forces in a given range (cumulative frequency) by the total number of the measurements of the adhesion forces is 95% (0.95) or greater. By meeting the above-described conditions, the dispersion of the measured adhesion forces greater than the mean value thereof may fall in given classes within a certain range in the frequency distribution of the measured adhesion forces. Therefore, the determination of the above-described good member can be performed.

Further, according to the first and second embodiments, the above-described adhesion forces were obtained by a measurement of adhesion forces between one toner particle attached to a tip of a needle and the given image processing member, using an AFM. Accordingly, the adhesion forces between one toner particle and the above-described image processing member can be measured accurately and effectively.

Further, according to the first and second example embodiments, the powder may include a toner. Therefore, a member to which toner is difficult to adhere (the given image processing member) and/or toner that is difficult to adhere to a specific member (the given image processing member) can be determined.

Further, according to the first and second embodiments, the above-described given image processing member is used in an image forming apparatus such as a printer and a copier including an image carrier, a charging unit, a developing unit, and a transfer unit that includes an intermediate transfer member. Particularly, the present patent application can be applied to the image carrier, the developing unit, the intermediate transfer member, and a cleaning unit to which toner directly contact, and to the charging unit that should avoid adhesion of toner. By so doing, an image processing member to which toner cannot easily adhere can be determined and developed effectively.

Further, according to the first and second embodiments, a diameter of a toner particle may be in a range of from 1 μm to 20 μm. Accordingly, a member to which toner is difficult to adhere (the given image processing member) and/or toner that is difficult to adhere to a specific member (the given image processing member) can be determined with high definition.

Further, according to the second embodiment, a photoconductor serving as an image carrier that is disposed in an image forming apparatus to carry an image on a surface thereof may be used as the given image processing member. By using the photoconductor, adhesion forces generated between a surface of the photoconductor and one toner particle are measured at multiple points on the surface of the photoconductor. When the photoconductor satisfies a relation of $X/2Y>1.3$, where "X" represents the mean value of the measured adhesion forces and "Y" represents the standard deviation or a root square of the variance of the measured adhesion forces, the photoconductor can be provided with good cleaning performance, as described above.

Further, according to the second embodiment, adhesion forces generated between one toner particle and the surface of the photoconductor that serves as an image carrier disposed in an image forming apparatus to carry a latent image are measured at multiple points on the surface of the photoconductor, and the cumulative relative frequency of the above-described given adhesion forces corresponding to adhesion forces 1.5 times the mean value of the above-described measured adhesion forces, which is the ratio obtained by dividing the number of the measurements of the adhesion forces in a given range (the cumulative frequency) by the total number of the measurements of the adhesion forces is 95% (0.95) or greater. By meeting the above-described conditions, a photoconductor having good cleaning performance can be provided as described above.

Further, according to the above-described embodiments, the above-described photoconductor may be used in an image forming apparatus such as a printer and copier including a photoconductor serving as an image carrier to carry an image on a surface thereof and an image processing mechanism configured to form the image. By so doing, a cleaning operation for the surface of the photoconductor can be effectively performed without reproducing defect images due to poor cleaning performance and a sequential image forming may be conducted well.

Further, according to the second embodiment, a cleaning blade that removes powder from a surface of a target member. The cleaning blade is specified by the mean value of the adhesion forces, which is a powder removability value obtained by measuring the adhesion forces between a surface of the cleaning blade and one toner particle, the standard deviation of the root square of the variance of the adhesion forces, and the adhesion force between the toner and the silicon substrate. When the cleaning blade satisfies relations of $X<5Z$ [nN] and $Y<5Z$ [nN], where "X" represents the mean value of the measured adhesion forces, "Y" represents the standard deviation or the root square of the variance of the measured adhesion forces, and "Z" represents the adhesion force generated between the toner and the silicon substrate, the cleaning blade can be provided with good cleaning performance, as described above.

Further, according to the first and second embodiments, in the cleaning unit that cleans a target member to be cleaned, the above-described cleaning blade can be used to preferably clean the surface of the photoconductor.

Further, according to the first and second embodiments, the image forming apparatus includes the photoconductor that is a target member to be cleaned and the cleaning unit that cleans the photoconductor. By using the cleaning unit including the above-described cleaning blade that serves as the cleaning unit, the cleaning operation on the surface of the photoconductor can be performed without reproducing defect images due to poor cleaning performance, and can perform preferable image forming operations.

Further, according to the second embodiment, the given image processing member that corresponds to a toner collection roller included in an image forming apparatus satisfies a relation of $X/2Y>4$, where "X" represents the mean value of the measured adhesion forces and "Y" represents the standard deviation or a root square of the variance of the measured adhesion forces. By satisfying the above-described relation, the dispersion of the measured adhesion forces falls in given classes within a certain range in the frequency distribution of the measured adhesion forces. Therefore, the determination of the above-described good member can be performed effectively.

Further, according to the second embodiment, the above-described given adhesion forces with respect to the toner collection roller correspond to an adhesion force 1.4 times the mean value of the above-described measured adhesion forces and a cumulative relative frequency of the measurements of the adhesion forces, which is a ratio obtained by dividing the number of the measurements of the adhesion forces in a given range (cumulative frequency) by the total number of the measurements of the adhesion forces is 95% (0.95) or greater. By meeting the above-described conditions, the dispersion of the measured adhesion forces greater than the mean value thereof may fall in given classes within a certain range in the frequency distribution of the measured adhesion forces. Therefore, the determination of the above-described good member can be performed.

Further, according to the above-described second embodiment, the toner collection roller to collect powder or toner from the cleaning roller serving as a target cleaned roller may be used as the given image processing member. By using the toner collection roller, adhesion forces generated between a surface of the toner collection roller and one toner particle are measured at multiple points on the surface of the toner collection roller. When the toner collection roller satisfies a relation of $X/2Y>4$, where "X" represents the mean value of the measured adhesion forces and "Y" represents the standard deviation or a root square of the variance of the measured adhesion forces, the toner collection roller can be provided with good cleaning performance, as described above.

Further, according to the second embodiment, the toner collection roller to collect powder or toner from the cleaning roller serving as a target cleaned roller may be used as the given image processing member. By using the toner collection roller, adhesion forces generated between one toner particle and the surface of the toner collection roller are measured at multiple points on the surface of the toner collection roller, and the cumulative relative frequency of the above-described given adhesion forces that correspond to adhesion forces 1.4 times the mean value of the above-described measured adhesion forces, which is the ratio obtained by dividing the number of the measurements of the adhesion forces in a given range (the cumulative frequency) by the total number of the measurements of the adhesion forces is 95% (0.95) or greater. By meeting the above-described conditions, a toner collection roller having good cleaning performance can be provided as described above.

Further, according to the above-described embodiments, the above-described toner collection roller may be used in a cleaning unit used in an image forming apparatus. By so doing, a cleaning unit can provide a good cleaning performance even after change of properties with time.

Further, according to the above-described embodiments, an image forming apparatus including the above-described cleaning unit provided with the above-described toner collection roller can provide a good cleaning performance even after change of properties with time.

Further, according to the second embodiment, the given image processing member may correspond to a developing roller to develop a latent image formed on a surface of a photoconductor to a visible toner image. The developing roller satisfies relations of $X+Y<5Z$ [nN], where "X" represents the mean value of the measured adhesion forces, "Y" represents the standard deviation or a root square of the variance of the measured adhesion forces, and "Z" represents an adhesion force generated between toner serving as the powder and a silicon substrate. By satisfying the above-described relations, the dispersion of the measured adhesion forces falls in given classes within a certain range in the frequency distribution of the measured adhesion forces. Therefore, the excellent developing roller that hardly causes the toner filming can be determined, as described above.

Further, according to the second embodiment, a developing roller is included in a developing unit configured to develop, with developer including toner, a latent image formed on a surface of a photoconductor to a visible toner image. The developing roller carries the developer on a surface thereof and conveys the developer to a development facing the surface of the photoconductor. The adhesion forces between the surface of the developing roller and one toner particle are measured and satisfies relations of $X+Y<5Z$ [nN], where "X" represents the mean value of the measured adhesion forces, "Y" represents the standard deviation or the root square of the variance of the measured adhesion forces, and "Z" represents the adhesion force generated between the toner and the silicon substrate. By meeting the above-described relation, the developing roller that may hardly cause the toner filming can be provided, as described above.

Further, according to the second embodiment, in the developing unit configured to develop a latent image formed on a surface of a photoconductor to a visible toner image with developer, the above-described developing roller is used to carry the developer on the surface thereof in an endless manner and convey the developer to the development area facing the photoconductor. By using the above-described developing roller, the developer on the surface of the developing roller can be replaced appropriately, thereby effectively developing the above-described latent image.

Further, according to the second embodiment, the above-described developer corresponds to one-component developer, and the image forming apparatus using the above-described developer includes a developing unit that includes a developer supplying roller that is disposed in contact with the developing roller and serves as a developer supplying member rotatable about a shaft thereof to supply and scrape the one-component developer to the developing roller contacting thereto, and a developer regulating member that corresponds to a surface layer regulating member to regulate an amount of developer supplied on the surface of the developing roller. With the above-described configuration, the developer supplying roller can effectively scrape and remove toner that has not used or consumed during the developing operation, from the surface of the developing roller. Therefore, the above-described configuration can prevent such toner subject to significant repetitive stress and deterioration from remaining on the surface of the developing roller, thereby preventing the toner filming occurring on the surface of the developing roller and further preventing a production of defect images due to the toner filming.

Further, according to the second embodiment, the image forming apparatus includes the photoconductor serving as a latent image carrier and the developing member developing the latent image formed on the surface of the photoconductor to a visible toner image by using the developer. By using the developing unit including the above-described developing roller serving as the developing member, a production of defect images due to the toner filming appeared on the surface of the developing roller can be prevented, and therefore good image forming operations can be performed.

Further, according to the third embodiment, when powder such as toner that adheres to the given processing member such as the photoconductor having the surface formed by a single material is removed by the cleaning blade that serves as a powder removing unit, the cleaning performance that is powder removability on the surface of the given processing member can be determined based on the distribution of the surface roughnesses. Accordingly, the cleaning performance on the surface of the given image processing member can be determined easily.

Further, according to the third embodiment, the average surface roughness on the surface of the photoconductor is measured in a range of 100 nm or smaller so that the cleaning performance on the surface of the photoconductor can be determined more accurately and more easily.

Further, according to the third embodiment, the mean value of the surface roughnesses Ra are measured at 5 or more points in a 1 μm square on the surface of the photoconductor, and the results of the measured mean values of the above-described points are 30 nm or smaller. By so doing, as described above, the surface roughnesses on the surface of the photoconductor can be equalized in a micro-order and the above-described adhesion forces can be equal. Therefore, a photoconductor with good cleaning performance can be provided.

Further, according to the third embodiment, the mean value of the surface roughnesses Ra are measured at 5 or more points in a 1 μn square on the surface of the photoconductor, and the results of the measured mean values of the above-described points are 1 nm or greater. By equalizing the surface roughnesses of the photoconductor in a valid range of the above-described adhesion forces, an increase of cost for manufacturing photoconductors may be reduced and a photoconductor with good cleaning performance can be provided.

Various features of the present patent application are described in different embodiments. However, the present patent application includes each feature being applied to each and every disclosed embodiment, figure, or container.

It is obvious that the present patent application is not limited by the embodiments and that the embodiments can be changed as necessary within the scope of the technological idea of the present patent application other than the suggestion in the embodiments. Furthermore, each number, position, and shape of the components are not limited to those which are appropriate for implementation of the present patent application.

The above-described embodiments are illustrative, and numerous additional modifications and variations are possible in light of the above teachings. For example, elements and/or features of different illustrative and embodiments herein may be combined with each other and/or substituted for each other within the scope of this disclosure. It is therefore to be understood that, the disclosure of the present patent application may be practiced otherwise than as specifically described herein.

Obviously, numerous modifications and variations of the present patent application are possible in light of the above teachings. It is therefore to be understood that, the invention may be practiced otherwise than as specifically described herein.

What is claimed is:

1. An image forming apparatus, comprising:

an optical writing unit configured to optically write an image; and an image carrier configured to carry the image on a surface thereof, wherein adhesion forces generated between a surface of the image carrier and a particle of a powder used to reproduce the image in the image forming apparatus are measured at multiple points on the surface of the image carrier, and the image carrier satisfies a relation of $X/2Y>1.3$, where "X" represents a mean value of the adhesion forces and "Y" represents a standard deviation or a root square of variance of the measured adhesion forces.

2. The image forming apparatus according to claim 1, wherein the powder includes a toner.

3. The image forming apparatus according to claim 2, wherein particles of the toner have a diameter in a range of from 1 μm to 20 μm.

4. An image forming apparatus, comprising:

an optical writing unit configured to optically write an image; and an image carrier configured to carry the image on a surface thereof, wherein adhesion forces generated between a surface of the image carrier and a particle of a powder used to reproduce the image in the image forming apparatus are measured at multiple points on the surface of the image carrier, and a cumulative relative frequency of the measured adhesion forces, which is a ratio obtained by dividing a cumulative frequency corresponding to the number of the measured adhesion forces in a given range by the total number of the measured adhesion forces is 95% or greater.

5. The image forming apparatus according to claim 4, wherein the powder includes a toner.

6. The image forming apparatus according to claim 5, wherein particles of the toner have a diameter in a range of from 1 μm to 20 μm.

7. An image forming apparatus, comprising:

an optical writing unit configured to optically write an image; and a cleaning blade configured to remove powder on a surface of a target member, wherein adhesion forces generated between a surface of the cleaning blade and a particle of a powder used to reproduce the image in the image forming apparatus are measured at multiple points on the surface of the cleaning blade, and the cleaning blade satisfies relations of $X<5Z$ and $Y<5Z$, where "X" represents a mean value of the adhesion forces, "Y" represents a standard deviation or a root square of variance of the measured adhesion forces, and "Z" represents an adhesion force generated between the powder and a silicon substrate of the cleaning blade.

8. The image forming apparatus according to claim 7, wherein a surface roughness of the silicon substrate of the cleaning blade is equal to or less than 1 nm.

9. The image forming apparatus according to claim 8, wherein the powder includes a toner.

10. The image forming apparatus according to claim 9, wherein particles of the toner have a diameter in a range of from 1 μm to 20 μm.

11. An image forming apparatus, comprising:

an optical writing unit configured to optically write an image; and a collection roller configured to remove powder on a surface of a target member, wherein adhesion forces generated between a surface of the collection roller and a particle of a powder used to reproduce the image in the image forming apparatus are measured at multiple points on the surface of the collection roller, and the collection roller satisfies a relation of $X/Y>4$, where "X" represents a mean value of the adhesion forces and "Y" represents a standard deviation or a root square of variance of the measured adhesion forces.

12. The image forming apparatus according to claim 11, wherein the powder includes a toner.

13. The image forming apparatus according to claim 12, wherein particles of the toner have a diameter in a range of from 1 μm to 20 μm.

14. An image forming apparatus, comprising:

an optical writing unit configured to optically write an image; and a developing roller provided to a developing unit configured to develop a latent image formed on an image carrier with a developer, the developing roller configured to carry the developer on a surface thereof to convey the developer to a development area facing the image carrier in an endless loop, wherein adhesion forces generated between a surface of the developing roller and a particle of a powder used to reproduce the image in the image forming apparatus are measured at multiple points on the surface of the developing roller, and the developing roller satisfies a relation of $X+Y<5Z$, where "X" represents a mean value of the adhesion forces, "Y" represents a standard deviation or a root square of variance of the measured adhesion forces, and "Z" represents an adhesion force generated between the powder and a silicon substrate of the developing roller.

15. The image forming apparatus according to claim 14, wherein the powder includes a toner.

16. The image forming apparatus according to claim 15, wherein particles of the toner have a diameter in a range of from 1 μm to 20 μm.

17. The image forming apparatus according to claim 16, wherein a surface roughness of the silicon substrate of the developing roller is equal to or less than 1 nm.

18. The image forming apparatus according to claim 14, wherein the powder includes a toner.

19. The image forming apparatus according to claim 18, wherein particles of the toner have a diameter in a range of from 1 μm to 20 μm.

* * * * *